US010796642B2

(12) United States Patent
Choi et al.

(10) Patent No.: US 10,796,642 B2
(45) **Date of Patent: *Oct. 6, 2020**

(54) DISPLAY DEVICE

(71) Applicant: Samsung Display Co., Ltd., Yongin-si, Gyeonggi-do (KR)

(72) Inventors: Sang Moo Choi, Yongin-si (KR); Min Woo Byun, Yongin-si (KR); Chae Han Hyun, Yongin-si (KR); Min Kyu Woo, Yongin-si (KR); Jae Du Noh, Yongin-si (KR); Jae Sic Lee, Yongin-si (KR); Seung Yeon Cho, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/864,914

(22) Filed: Jan. 8, 2018

(65) Prior Publication Data

US 2018/0197481 A1 Jul. 12, 2018

(30) Foreign Application Priority Data

Jan. 11, 2017 (KR) ..... 10-2017-0003969
Feb. 17, 2017 (KR) ..... 10-2017-0021860

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01);
(Continued)

(58) Field of Classification Search
CPC ..... G09G 3/3233; G09G 3/3266; G09G 2310/0221
(Continued)

(56) References Cited

U.S. PATENT DOCUMENTS 9,035,976 B2 * 5/2015 Lee ..... G09G 3/3283 345/691
9,183,781 B2 11/2015 Jang
(Continued)

FOREIGN PATENT DOCUMENTS

EP 3343545 A1 7/2018
JP 2016-532900 A 10/2016
(Continued)

OTHER PUBLICATIONS

EPO Extended Search Report dated Jun. 5, 2018, for corresponding European Patent Application No. 18151000.9 (10 pages).
(Continued)

*Primary Examiner* — Prabodh M Dharia
(74) *Attorney, Agent, or Firm* — Lewis Roca Rothgerber Christie LLP

(57) ABSTRACT

A display device includes first pixels in a first pixel area, a first scan driver configured to supply first scan signals to first scan lines, second pixels in a second pixel area, a second scan driver configured to supply second scan signals to second scan lines, third pixels in a third pixel area, a third scan driver configured to supply third scan signals to third scan lines, and a timing controller configured to supply a first start signal to the first scan driver, a second start signal to the second scan driver, and a third start signal to the third scan driver, wherein an order in which the first, second, and third start signal are supplied in a first mode, and an order in which the first, second, and third start signal are supplied in a second mode that is different from the first mode, are different from each other.

25 Claims, 30 Drawing Sheets

(52) U.S. Cl.
CPC ..... *G09G 2300/0842* (2013.01); *G09G 2300/0861* (2013.01); *G09G 2310/0205* (2013.01); *G09G 2310/0218* (2013.01); *G09G 2310/0232* (2013.01); *G09G 2310/0286* (2013.01); *G09G 2310/08* (2013.01); *G09G 2320/08* (2013.01); *G09G 2340/04* (2013.01); *G09G 2340/0442* (2013.01)

(58) Field of Classification Search
USPC ..... 345/8, 76, 99, 100, 204, 212, 690, 691; 359/630; 324/760.01
See application file for complete search history.

(56) References Cited

U.S. PATENT DOCUMENTS 9,286,831 B2 3/2016 Qing et al.
2004/0189583 A1* 9/2004 Park ..... G09G 3/3677 345/100
2005/0024301 A1* 2/2005 Funston ..... G09G 3/32 345/76
2005/0078076 A1* 4/2005 Kim ..... G09G 3/3659 345/98
2005/0270873 A1* 12/2005 Lee ..... G09G 3/3611 365/205
2006/0017666 A1* 1/2006 Kim ..... G09G 3/3216 345/76
2006/0139294 A1* 6/2006 Tanaka ..... G09G 3/3611 345/100
2006/0256066 A1* 11/2006 Moon ..... G09G 3/3677 345/100
2006/0267623 A1* 11/2006 Yoo ..... G01R 31/318533 324/760.01
2007/0040792 A1 2/2007 Kwag et al.
2007/0159441 A1* 7/2007 Yang ..... G09G 3/3677 345/99
2010/0020059 A1* 1/2010 Suh ..... G09G 3/3233 345/212
2010/0073335 A1* 3/2010 Min ..... G09G 3/3233 345/204
2010/0079356 A1* 4/2010 Hoellwarth ..... G02B 27/017 345/8
2010/0085335 A1* 4/2010 Kato ..... G09G 3/3677 345/204
2010/0097366 A1* 4/2010 Kitayama ..... G09G 3/3614 345/213
2010/0188375 A1 7/2010 Lee et al.
2011/0227889 A1 9/2011 Choi
2013/0293597 A1 11/2013 Mori et al.
2013/0335537 A1 12/2013 Goro et al.
2013/0335538 A1 12/2013 Shestak et al.
2014/0022289 A1* 1/2014 Lee ..... G09G 3/3283 345/691
2014/0268356 A1* 9/2014 Bolas ..... G02B 27/0093 359/630
2014/0368417 A1 12/2014 Yamazaki et al.
2015/0002558 A1* 1/2015 Kumeta ..... G09G 3/3233 345/690
2015/0109353 A1* 4/2015 Yu ..... G11C 19/28 345/691
2015/0137118 A1* 5/2015 Umezaki ..... G09G 3/3677 257/43
2015/0154902 A1 6/2015 Lee et al.
2015/0154925 A1 6/2015 Koyama et al.
2015/0187262 A1 7/2015 Eom
2015/0187320 A1* 7/2015 Ren ..... G09G 3/3696 345/87
2015/0243238 A1* 8/2015 Jung ..... G09G 3/3677 345/103
2015/0331482 A1 11/2015 Sawada et al.
2016/0005351 A1 1/2016 Jeon et al.
2016/0014402 A1 1/2016 Lee et al.
2016/0111053 A1 4/2016 Yamazaki et al.
2016/0117987 A1 4/2016 Byun
2016/0140921 A1 5/2016 Koyama et al.
2016/0190166 A1 6/2016 Kim et al.
2016/0299683 A1 10/2016 Kwon et al.
2016/0343315 A1 11/2016 Richards et al.
2016/0364198 A1 12/2016 Song et al.
2017/0052635 A1* 2/2017 Yu ..... G06F 3/044
2017/0221411 A1* 8/2017 Chang ..... G09G 3/20
2017/0357091 A1 12/2017 Jin
2018/0059420 A1 3/2018 Woo et al.
2018/0075808 A1 3/2018 Yamashita et al.
2018/0158409 A1* 6/2018 Byun ..... G09G 3/3208
2018/0190202 A1 7/2018 Kong
2018/0197480 A1* 7/2018 Choi ..... G09G 3/3266
2018/0197481 A1 7/2018 Choi et al.
2018/0197482 A1* 7/2018 Choi ..... G09G 3/3266

FOREIGN PATENT DOCUMENTS

KR 10-2004-0024915 A 3/2004
KR 10-2013-0000020 A 1/2013
KR 10-1341010 B1 12/2013
KR 10-2015-0078980 A 7/2015
KR 10-2016-0070445 A 6/2016
KR 10-2016-0120143 10/2016
KR 10-2017-0078980 A 7/2017
KR 10-2018-0082692 7/2018
KR 10-2018-0082698 7/2018
KR 10-2018-0083237 7/2018
WO 2015/137706 A1 9/2015

OTHER PUBLICATIONS

U.S. Office Action dated Sep. 9, 2019, issued in U.S. Appl. No. 15/864,971, 21 pages.
U.S. Office Action dated Sep. 26, 2019, issued in U.S. Appl. No. 15/856,807, 11 pages.
U.S. Notice of Allowance dated Jan. 8, 2020, issued in U.S. Appl. No. 15/856,807 (9 pages).
EPO Office Action dated Nov. 25, 2019, for corresponding European Patent Application No. 18151000.9, 6 pages.
Office action issued in related U.S. Appl. No. 15/835,170 by the UPSTO, dated Jul. 11, 2019, 13 pages.
U.S. Notice of Allowance dated Apr. 16, 2020, issued in U.S. Appl. No. 15/856,807 (9 pages).

* cited by examiner

DISPLAY DEVICE

CROSS-REFERENCE TO RELATED APPLICATION

This application claims priority to, and the benefit of, Korean Patent Application No. 10-2017-0003969, filed on Jan. 11, 2017, and No. 10-2017-0021860, filed on Feb. 17, 2017, in the Korean Intellectual Property Office, the entire disclosure of which is incorporated by reference herein.

BACKGROUND

1. Field

An aspect of the present disclosure relates to a display device.

2. Description of the Related Art

Recently, various types of electronic devices directly wearable on a body of a user have been developed. These devices are generally called a wearable electronic device.

In particular, as an example of the wearable electronic device, a head mounted display device (hereinafter, referred to as a "HMD") displays a realistic image, and hence provides high-degree immersion. Accordingly, the HMD has various uses including movie appreciation.

SUMMARY

Embodiments provide a display device having improved display quality.

According to an aspect of the present disclosure, there is provided a display device including first pixels in a first pixel area and coupled to first scan lines, a first scan driver configured to supply first scan signals to the first scan lines, second pixels in a second pixel area and coupled to second scan lines, a second scan driver configured to supply second scan signals to the second scan lines, third pixels in a third pixel area and coupled to third scan lines, a third scan driver configured to supply third scan signals to the third scan lines, and a timing controller configured to supply a first start signal to the first scan driver, to supply a second start signal to the second scan driver, and to supply a third start signal to the third scan driver, wherein an order in which the first start signal, the second start signal, and the third start signal are supplied in a first mode, and an order in which the first start signal, the second start signal, and the third start signal are supplied in a second mode that is different from the first mode, are different from each other.

An effective image may be displayed in the second pixel area in the first mode, and the effective image may be displayed in the first pixel area, the second pixel area, and the third pixel area in the second mode.

The display device may be configured to be driven in the first mode when the display device is mounted in a wearable device, and may be configured to be driven in the second mode otherwise.

The first scan driver may be configured to start the supply of the first scan signals corresponding to the first start signal, the second scan driver may be configured to start the supply of the second scan signals corresponding to the second start signal, and the third scan driver may be configured to start the supply of the third scan signals corresponding to the third start signal.

The first scan driver may include a first dummy stage and first scan stages, wherein the first dummy stage is configured to receive the first start signal, and wherein a first first scan stage of the first scan stages is configured to receive an output signal of the first dummy stage.

Ones of the first pixels on a first horizontal line of the first pixel area may be coupled to the first dummy stage and to the first first scan stage.

The second scan driver may include a second dummy stage and second scan stages, wherein the second dummy stage is configured to receive the second start signal, and wherein a first second scan stage of the second scan stages is configured to receive an output signal of the second dummy stage.

Ones of the second pixels on a first horizontal line of the second pixel area may be coupled to the second dummy stage and the first second scan stage.

The third scan driver may include a third dummy stage and third scan stages, wherein the third dummy stage is configured to receive the third start signal, and wherein a first third scan stage of the third scan stages is configured to receive an output signal of the third dummy stage.

Ones of the third pixels on a first horizontal line of the third pixel area may be coupled to the third dummy stage and the first third scan stage.

The third scan driver may include third scan stages, and a third dummy stage between two of the third scan stages that is configured to receive the third start signal.

The third dummy stage may be between a first third scan stage of the third scan stages and a second third scan stage of the third scan stages.

The first third scan stage may be configured to receive an output signal of a last second scan stage of the second scan stages, and the second third scan stage may be configured to receive an output signal of the third dummy stage.

Ones of the third pixels on the first horizontal line of the third pixel area may be coupled to the last second scan stage and the first third scan stage.

Ones of the third pixels on a second horizontal line of the third pixel area may be coupled to the third dummy stage and the second third scan stage.

The display device may further include a first auxiliary line coupled to ones of the second pixels on a first horizontal line of the second pixel area.

The timing controller may be configured to supply the second start signal to the first auxiliary line and the second scan driver.

The ones of the second pixels on the first horizontal line of the second pixel area may be configured to be driven corresponding to the second start signal and a second scan signal supplied from a first second scan line.

The display device may further include a second auxiliary line coupled to ones of the third pixels on a first horizontal line of the third pixel area.

The timing controller may be configured to supply the third start signal to the second auxiliary line and the third scan driver.

The ones of the third pixels on the first horizontal line of the third pixel area may be configured to be driven corresponding to the third start signal and a third scan signal supplied from a first third scan line.

The timing controller may be configured to supply a first clock signal to a first clock line, to supply a second clock signal to a second clock line, to supply a third clock signal to a third clock line, and to supply a fourth clock signal to a fourth clock line.

Signal characteristics of the first clock signal and the third clock signal may be substantially identical, and signal characteristics of the second clock signal and the fourth clock signal may be substantially identical.

The first dummy stage and some stages among the first scan stages may be configured to receive the first clock signal and the second clock signal through the first clock line and the second clock line, and the first dummy stage and other stages among the first scan stages may be configured to receive the third clock signal and the fourth clock signal through the third clock line and the fourth clock line.

The second dummy stage and some stages among the second scan stages may be configured to receive the first clock signal and the second clock signal through the first clock line and the second clock line, and the second dummy stage and other stages among the second scan stages may be configured to receive the third clock signal and the fourth clock signal through the third clock line and the fourth clock line.

The third dummy stage and some stages among the third scan stages may be configured to receive the first clock signal and the second clock signal through the first clock line and the second clock line, and the third dummy stage and other stages among the third scan stages may be configured to receive the third clock signal and the fourth clock signal through the third clock line and the fourth clock line.

Odd stages may be coupled to the first clock line or the third clock line, and even stages may be coupled to the second clock line or the fourth clock line.

The first scan driver and the third scan driver may be configured to receive the first clock signal and the second clock signal through the first clock line and the second clock line, and the second scan driver may be configured to receive the third clock signal and the fourth clock signal through the third clock line and the fourth clock line.

In the second mode, the timing controller may be configured to sequentially supply the first start signal, the second start signal, and the third start signal.

In the first mode, the timing controller may be configured to set a supply order of the first start signal, the second start signal, and the third start signal such that the first scan signals and the third scan signal are supplied while the second scan signals are being supplied.

BRIEF DESCRIPTION OF THE DRAWINGS

Embodiments will now be described more fully hereinafter with reference to the accompanying drawings; however, they may be embodied in different forms, and should not be construed as limited to the embodiments set forth herein. Rather, these embodiments are provided so that this disclosure will be thorough and complete, and will fully convey the scope of the embodiments to those skilled in the art.

In the drawings, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1A:
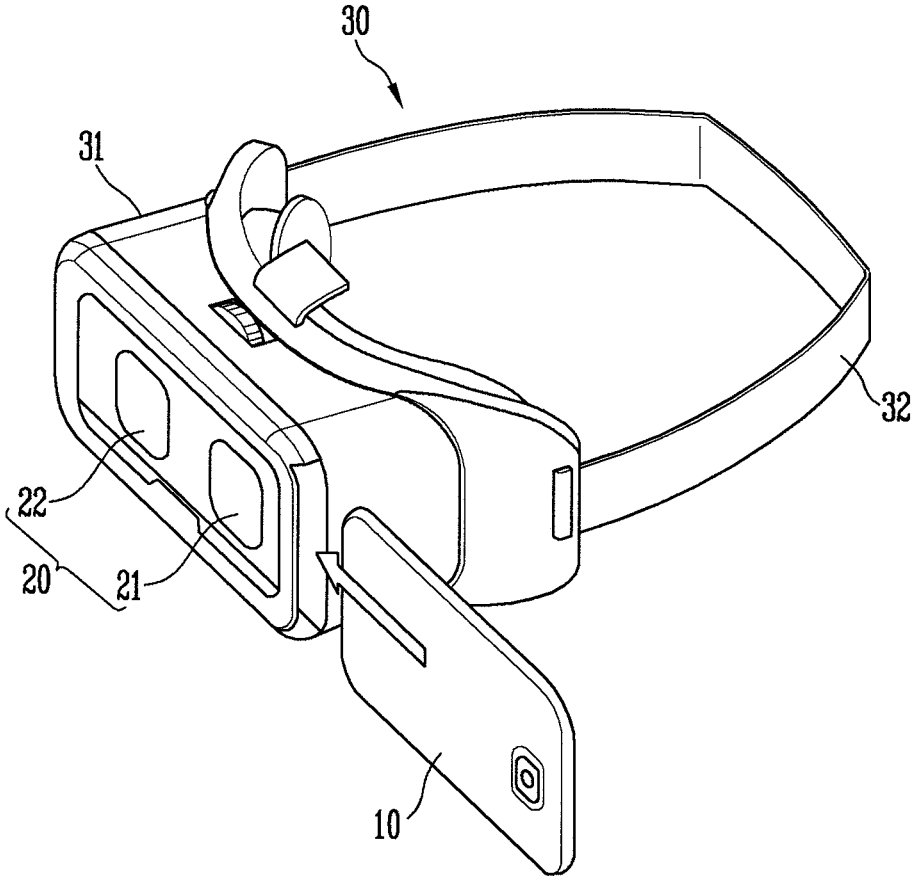
FIGS. 1A to 1C are diagrams illustrating a state in which a display device is mounted in a wearable device according to an embodiment.

Features of the inventive concept and methods of accomplishing the same may be understood more readily by reference to the following detailed description of embodiments and the accompanying drawings. Hereinafter, embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. In addition, it will also be understood that when an element or layer is referred to as being "between" two elements or layers, it can be the only element or layer between the two elements or layers, or one or more intervening elements or layers may also be present.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

The electronic or electric devices and/or any other relevant devices or components according to embodiments of the present invention described herein may be implemented using any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, display devices will be described with reference to embodiments in conjunction with the accompanying drawings.

Figure 1B:
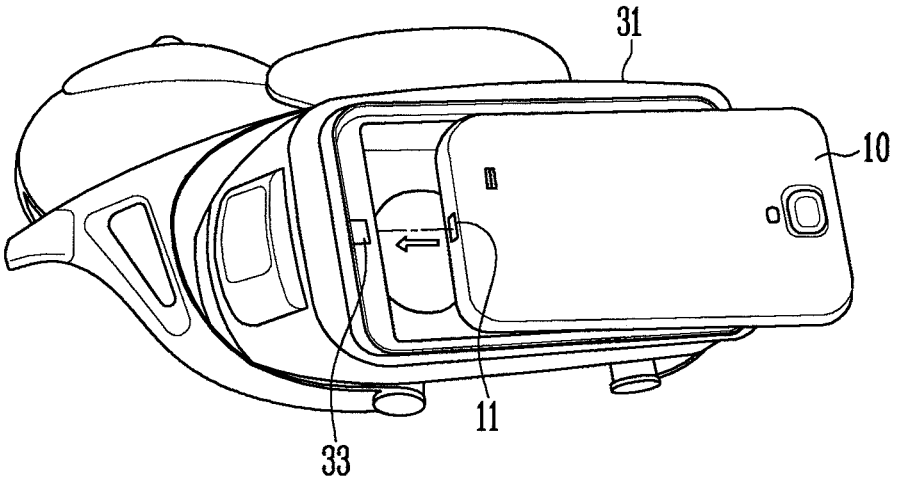
Figure 1C:
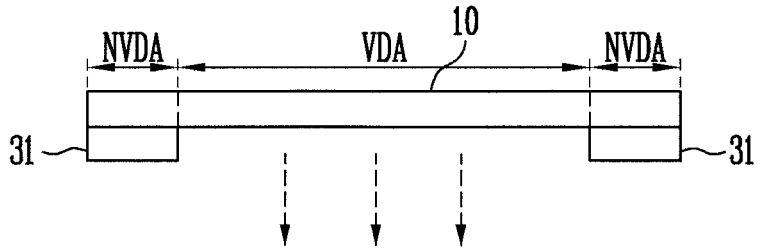

FIGS. 1A to 1C are diagrams illustrating a state in which a display device is mounted in a wearable device according to an embodiment. In FIGS. 1A to 1C, an HMD (a head mounted display device) is illustrated as an embodiment of a wearable device, but the wearable device according to the present disclosure is not limited thereto.

Referring to FIGS. 1A and 1B, the wearable device 30 according to the present embodiment may include a frame 31. A band 32 may be coupled to the frame 31, and a user may wear the frame 31 on their head by using the band 32. The frame 31 has a structure in which a display device 10 can be detachably mounted thereto.

The display device 10 capable of being mounted in the wearable device 30 may be a smart phone, but the present disclosure is not limited thereto. For example, in addition to the smart phone, the display device 10 may be any electronic device that is capable of being mounted in the wearable device 30 and that has display means, such as a tablet PC, an electronic book reader, a personal digital assistant (PDA), a portable multimedia player (PMP), and a camera.

If the display device 10 is mounted to the frame 31, the display device 10 may be electrically coupled to the wearable device 30 when a connection part 11 of the display device 10 is coupled to a connection part 33 of the frame 31. That is, communication between the wearable device 30 and the display device 10 may be performed.

To control the display device 10 mounted to the frame 31, the wearable device 30 may include at least one of a touch sensor, a button, and a wheel key.

If the display device 10 is mounted in the wearable device 30, the display device 10 may be operated as the HMD.

For example, when the display device 10 is mounted in the wearable device 30, the display device 10 may be driven in a first mode (e.g., a VR mode). When the display device 10 is separated from the wearable device 30, the display device 10 may be driven in a second mode (e.g., a normal mode).

The driving mode of the display device 10 may be changed automatically or may be changed manually. For example, if the display device 10 is mounted in the wearable device 30, the display device 10 may be automatically driven in the first mode. When the display device 10 is separated from the wearable device 30, the driving mode of the display device 10 may be automatically changed from the first mode to the second mode.

Alternatively, the display device 10 may be driven in the first mode or the second mode according to a setting of the user.

The wearable device 30 may include a lens, or lenses, 20 corresponding to two eyes of the user. For example, the wearable device 30 may include a left-eye lens 21 and a right-eye lens 22, which respectively correspond to a left eye and a right eye of the user.

Alternatively, the wearable device 30 may include one integrated lens 20 such that the user can simultaneously view the same image with the left and right eyes thereof.

The lens 20 may be a fisheye lens, a wide-angle lens, or the like, so as to increase the field of view (FOV) of the user, but the present disclosure is not limited thereto.

If the display device 10 is fixed to the frame 31, the user views an image displayed in the display device 10 through the lens 20. Accordingly, it is possible to provide an effect as if the user views images displayed on a large-sized screen located at a certain distance therefrom.

Referring to FIG. 1C, when the display device 10 is mounted in the wearable device 30, a partial area of the display device 10 may be blocked by the frame 31. For example, when the display device 10 is mounted in the wearable device 30, a portion of the entire display area of the display device 10 may be covered by the frame 31.

When the display device 10 is mounted in the wearable device 30, an area able to be viewed by the user through the lens 20 of the wearable device 30 in the entire display area of the display device 10 may be referred to as a visible area VDA.

The other display area of the display device 100 not including the visible area VDA of the display device 10 may be referred to as a non-visible area NVDA that is covered by the frame 31 in the first mode, so that the user does not view the non-visible area NVDA when the display device 10 is mounted in the wearable device 30.

When the display device 10 is mounted in the wearable device 30 to be driven in the first mode, an effective image may be displayed in the visible area VDA at a central portion of the display device 10. In addition, no image need be displayed in the non-visible area NVDA, or a black or dummy image may be displayed in the non-visible area NVDA.

Alternatively, when the display device 10 is separated from the wearable device 30 to be driven in the second mode, the entire display area of the display device 10 may be viewed by the user. That is, if the display device 10 is separated from the wearable device 30, the entire display area of the display device 10 may be the visible area VDA. In this case, an effective image may be displayed in the entire display area of the display device 10.

In an embodiment, the area in which the effective image is displayed may be changed depending on the driving mode of the display device 10.

In an embodiment, when the display device 10 is used together with the wearable device 30, various types of images may be viewed.

However, as a first pixel area, a second pixel area, and a third pixel area are non-sequentially driven when the display device 10 is driven in the first mode, a boundary line between the first pixel area and the second pixel area, and a boundary line between the second pixel area and the third pixel area, may be viewed.

Therefore, in an embodiment, which will be described later, a display device and a driving method thereof can prevent boundary lines between a plurality of areas constituting a display area from being viewed, and can prevent or minimize the occurrence of an afterimage or light leakage at boundaries between the areas.

Figure 2:
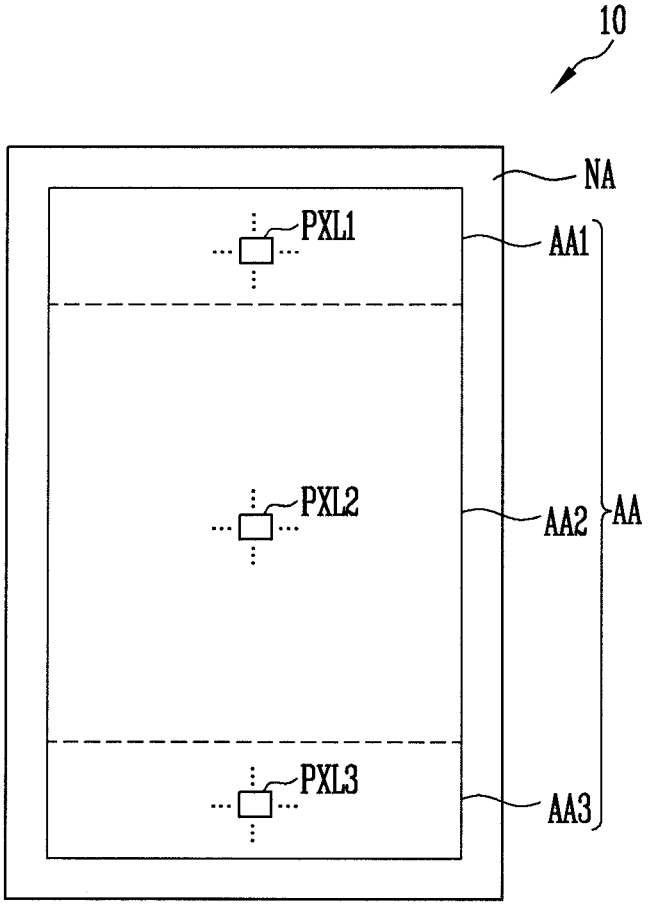
FIG. 2 is a diagram illustrating a pixel area of the display device according to the present embodiment.

FIG. 2 is a diagram illustrating a pixel area of the display device according to the present embodiment.

Referring to FIG. 2, the display device 10 according to the present embodiment may include a display area AA and a peripheral area NA.

A plurality of pixels PXL1, PXL2, and PXL3 may be provided in the display area AA, and the display area AA may be an active area in which an image is displayed.

The peripheral area NA may be located at a periphery of the display area AA, and may have a shape surrounding the display area AA.

Components (e.g., lines and the like) for driving the pixels PXL1, PXL2, and PXL3 may be located in the peripheral area NA. Because the pixels PXL1, PXL2, and PXL3 are not located in the peripheral area NA, the peripheral area NA may be referred to as a non-active area or as a non-display area.

The display area AA may include a first pixel area AA1, a second pixel area AA2, and a third pixel area AA3.

The first pixel area AA1 is located at one side of the second pixel area AA2, and the third pixel area AA3 may be located at the other side of the second pixel area AA2. That is, the second pixel area AA2 may be located between the first pixel area AA1 and the third pixel area AA3.

The second pixel area AA2 may have a larger area than the first pixel area AA1 and the third pixel area AA3.

First pixels PXL1 may be provided in the first pixel area AA1, second pixels PXL2 may be provided in the second pixel area AA2, and third pixels PXL3 may be provided in the third pixel area AA3.

The first to third pixels PXL1, PXL2, and PXL3 may emit light (e.g., light with a predetermined luminance) under the control of drivers. To this end, each of the first to third pixels PXL1, PXL2, and PXL3 may include a light emitting device (e.g., an organic light emitting diode).

The second pixel area AA2 located at a central portion of the display area AA may correspond to the visual area VDA shown in FIG. 1C. The first pixel area AA1 and the third pixel area AA3, which are respectively located at both sides of the display area AA, may correspond to the non-visible area(s) NVDA shown in FIG. 1C.

When the display device 10 is driven in the first mode, the user cannot view images displayed in the first pixel area AA1 and in the third pixel area AA3, and can only view an image displayed in the second pixel area AA2. To this end, the display device 10 may display an effective image in the second pixel area AA2, and may display a dummy image in the first and third pixel areas AA1 and AA3.

Alternatively, when the display device 10 is driven in the second mode, the user may view an image displayed in the first to third display areas AA1, AA2, and AA3. To this end, when the display device 10 is driven in the second mode, an effective image may be displayed in the entire display area AA including the first to third display areas AA1, AA2, and AA3. For example, when the display device 10 is driven in the second mode, one screen may be implemented in the entire display area AA by connecting images displayed in first to third display areas AA1, AA2, and AA3.

Meanwhile, in FIG. 2, it is illustrated that the first pixel area AA1, the second pixel area AA2, and the third pixel area AA3 have the same width, but the present disclosure is not limited thereto. For example, the first pixel area AA1 and/or the third pixel area AA3 may have a shape of which width of the area becomes narrower at portions that are more distant from the second pixel area AA2.

Alternatively, one of the first pixel area AA1 and the third pixel area AA3 may be narrower than the other. In this case, the first pixel area AA1 and/or the third pixel area AA3 may be disposed in plurality along the vertical or horizontal direction.

Figure 3:
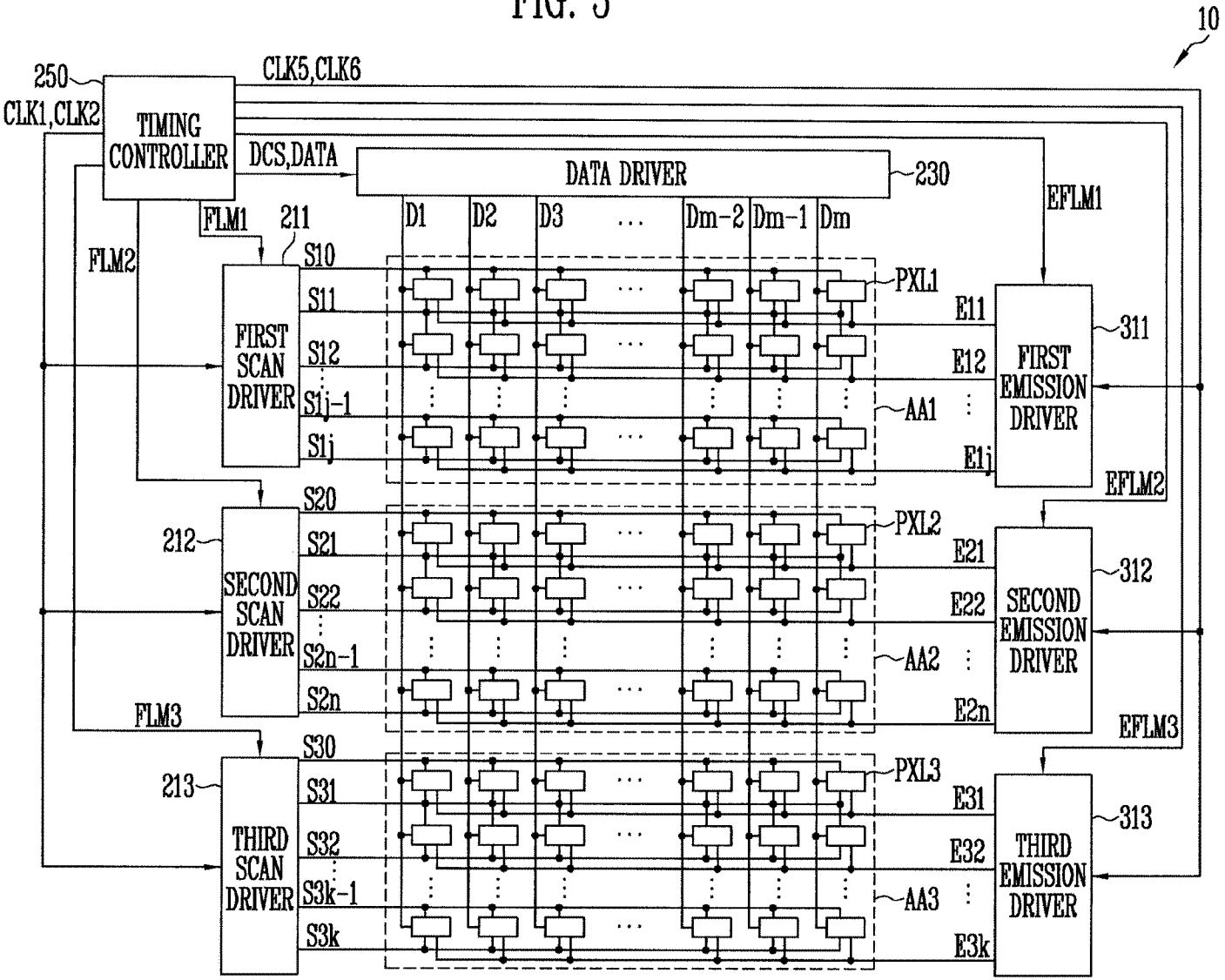
FIG. 3 is a diagram illustrating in detail a configuration of the display device according to the present embodiment.

FIG. 3 is a diagram illustrating in detail a configuration of the display device according to the present embodiment.

Referring to FIG. 3, the display device 10 according to the present embodiment may include pixels PXL1, PXL2, and PXL3 and a display driver.

The display driver may include a first scan driver 211, a second scan driver 212, a third scan driver 213, a data driver 230, a first emission driver 311, a second emission driver 312, a third emission driver 313, and a timing controller 250.

First pixels PXL1 may be located in a first pixel area AA1 defined by a first dummy scan line S10, first scan lines S11 to S1*j*, and data lines D1 to Dm.

First pixels PXL1 located on a first horizontal line of the first pixel area AA1 may be coupled to the first dummy scan line S10 and a first first scan line S11, and first pixels PXL1 located on any of a second horizontal line to a last horizontal line may be respectively coupled to adjacent first scan lines S11 to S1*j*. For example, first pixels PXL1 located on an ith (i is a natural number of 2 or more) horizontal line may be coupled to an ith first scan line S1*i* and an (i−1)th first scan line S1*i*−1.

The first pixels PXL1 may be supplied with a data signal from the data lines D1 to Dm when a scan signal is supplied from the first scan lines S11 to S1*j*.

Figure 4:
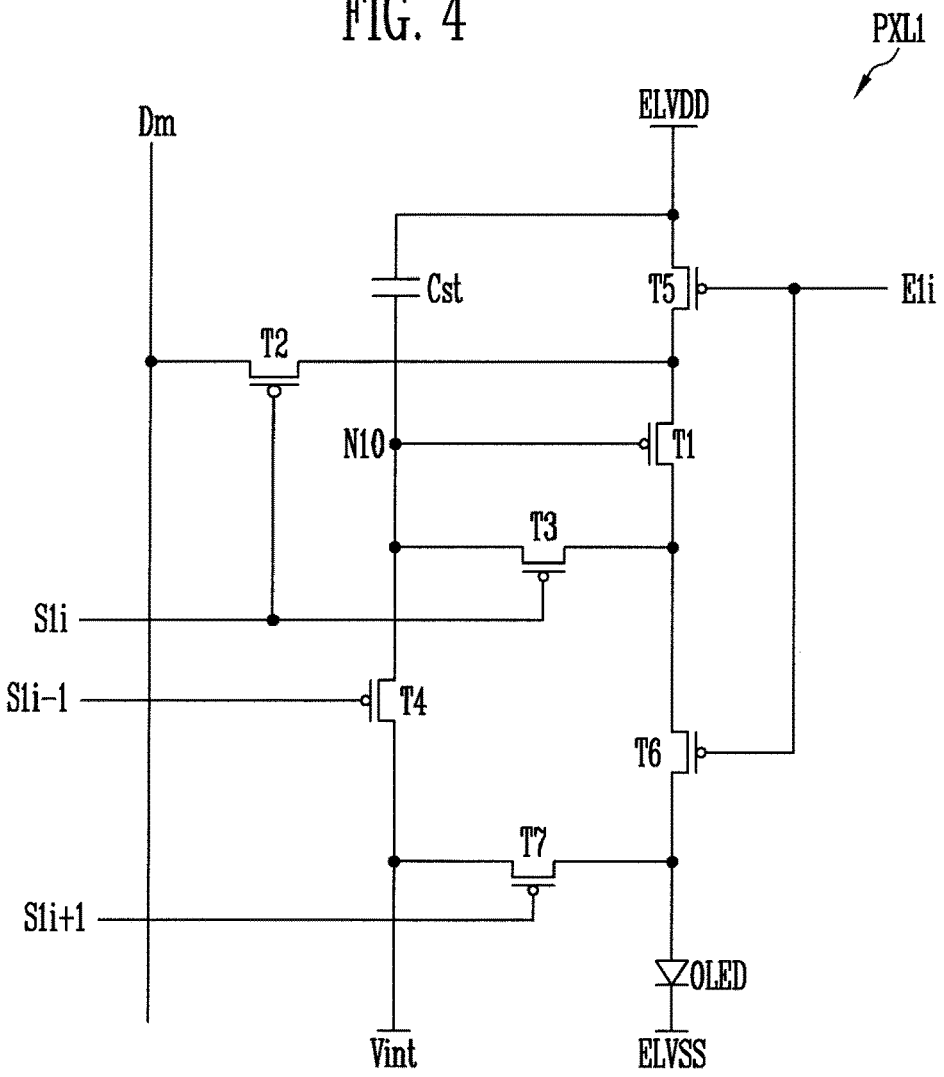
FIG. 4 is a diagram illustrating an embodiment of a first pixel shown in FIG. 3.

Each of the first pixels PXL1 supplied with the data signal may control the amount of current flowing from a first power source ELVDD to a second power source ELVSS via an organic light emitting diode OLED (e.g., see FIG. 4). In this case, the organic light emitting diode may generate light with a luminance corresponding to the amount of the current.

Second pixels PXL2 may be located in a second pixel area AA2 defined by a second dummy scan line S20, second scan lines S21 to S2*n*, and the data lines D1 to Dm.

Second pixels PXL2 located on a first horizontal line of the second pixel area AA2 may be coupled to the second dummy scan line S20 and a first second scan line S21, and second pixels PXL2 located on any of a second horizontal line to a last horizontal line may be coupled to respective adjacent second scan lines S21 to S2*n*. For example, second pixels PXL2 located on an ith horizontal line may be coupled to an ith second scan line S2*i* and an (i−1)th second scan line S2*i*−1.

The second pixels PXL2 may be supplied with a data signal from the data lines D1 to Dm when a scan signal is supplied from the second scan lines S21 to S2*n*.

Each of the second pixels PXL2 supplied with the data signal may control the amount of current flowing from the first power source ELVDD to the second power source ELVSS via an organic light emitting diode OLED. In this case, the organic light emitting diode may generate light with a luminance corresponding to the amount of the current.

Third pixels PXL3 may be located in a third pixel area AA3 defined by a third dummy scan line S30, third scan lines S31 to S3*k*, and the data lines D1 to Dm.

Third pixels PXL3 located on a first horizontal line of the third pixel area AA3 may be coupled to the third dummy scan line S30 and to a first third scan line S31, and third pixels PXL3 located on any of a second horizontal line to a last horizontal line may be coupled to respective adjacent third scan lines S31 to S3*k*. For example, third pixels PXL3 located on an ith horizontal line may be coupled to an ith third scan line S3*i* and an (i−1)th third scan line S3*i*−1.

The third pixels PXL3 may be supplied with a data signal from the data lines D1 to Dm when a scan signal is supplied from the third scan lines S31 to S3*k*.

Each of the third pixels PXL3 supplied with the data signal may control the amount of current flowing from the first power source ELVDD to the second power source ELVSS via an organic light emitting diode OLED. In this case, the organic light emitting diode may generate light with a luminance corresponding to the amount of the current.

In an embodiment, each of the first pixel area AA1 and the third pixel area AA3 may have a smaller area than the second pixel area AA2. In this case, a number of each of the first pixels PXL1 and the third pixels PXL3 may be smaller than a number of the second pixels PXL2, and a number of each of the first scan lines S11 to S1*j* and the third scan lines S31 to S3*k* may be smaller than a number of the second scan lines S21 to S2*n*.

When the display device 10 is driven in the second mode, an effective image may be displayed in the first pixel area AA1, the second pixel area AA2, and the third pixel area AA3. That is, the user may view an image displayed in the first pixel area AA1, the second pixel area AA2, and the third pixel area AA3.

When the display device 10 is driven in the first mode, an effective image may be displayed in the second pixel area AA2, and the first pixel area AA1 and the third pixel area AA3 may be covered by the frame 31 of the wearable device 30.

When the display device 10 is driven in the first mode, the first pixel area AA1 and the third pixel area AA3 correspond to areas that are not viewed by the user, and therefore, image display operations of the first pixel area AA1 and the third pixel area AA3 may be stopped. To this end, no scan signal need be supplied to the first scan lines S11 to S1*j* and the third scan lines S31 to S3*k* coupled to the first pixels PXL1 and the third pixels PXL3, and any separate data signal need not be supplied to the first pixels PXL1 and the third pixels PXL3.

Alternatively, when the display device 10 is driven in the first mode, because the first pixel area AA1 and the third pixel area AA3 correspond to areas that are not viewed by the user, a dummy image may therefore be displayed in the first pixel area AA1 and the third pixel area AA3. To this end, a scan signal may be supplied to the first scan lines S11 to S1*j* and the third scan lines S31 to S3*k* coupled to the first pixels PXL1 and the third pixels PXL3. In this case, a dummy data signal may be supplied to the first pixels PXL1 and the third pixels PXL3.

The first scan driver 211 may supply a first dummy scan signal to the first dummy scan line S10, and may supply first scan signals to the first scan lines S11 to S1*j*, corresponding to a first scan driver control signal(s) FLM1, CLK1, and CLK2 from the timing controller 250. For example, the first scan driver 211 may sequentially supply the first dummy scan signal and the first scan signals to the first dummy scan line S10 and the first scan lines S11 to S1*j*, respectively. If the first dummy scan signal and the first scan signals are sequentially supplied, the first pixels PXL1 may be sequentially selected in units of horizontal lines.

The second scan driver 212 may supply a second dummy scan signal to the second dummy scan line S20, and may supply second scan signals to the second scan lines S21 to S2*n*, corresponding to a second scan driver control signal(s) FLM2, CLK1, and CLK2 from the timing controller 250. For example, the second scan driver 212 may sequentially supply the second dummy scan signal and the second scan signals to the second dummy scan line S20 and the second scan lines S21 to S2*n*, respectively. If the second dummy scan signal and the second scan signals are sequentially supplied, the second pixels PXL2 may be sequentially selected in units of horizontal lines.

The third scan driver 213 may supply a third dummy scan signal to the third dummy scan line S30, and may supply third scan signals to the third scan lines S31 to S3*k*, corresponding to a third scan driver control signal(s) FLM3, CLK1, and CLK2 from the timing controller 250. For example, the third scan driver 213 may sequentially supply the third dummy scan signal and the third scan signals to the third dummy scan line S30 and the third scan lines S31 to S3*k*, respectively. If the third dummy scan signal and the third scan signals are sequentially supplied, the third pixels PXL3 may be sequentially selected in units of horizontal lines.

As for the entire display device 10, when the display device 10 is driven in the first mode or in the second mode, the first pixels PXL1, the second pixels PXL2, and the third pixels PXL3 may be sequentially selected in units of horizontal lines for every frame period.

The first emission driver 311 may supply first emission control signals to first emission control lines E11 to E1*j* corresponding to a first emission driver control signal(s) EFLM1, CLK5, and CLK6 from the timing controller 250. For example, the first emission driver 311 may sequentially supply the first emission control signals to the first emission control lines E11 to E1*j*.

The second emission driver 312 may supply second emission control signals to second emission control lines E21 to E2*n*, corresponding to a second emission driver control signal(s) EFLM2, CLK5, and CLK6 from the timing controller 250. For example, the second emission driver 312 may sequentially supply the second emission control signals to the second emission control lines E21 to E2*n*.

The third emission driver 313 may supply third emission control signals to third emission control lines E31 to E3*k* corresponding to a third emission driver control signal(s) EFLM3, CLK5, and CLK6 from the timing controller 250. For example, the third emission driver 313 may sequentially supply the third emission control signals to the third emission control lines E31 to E3*k*.

Meanwhile, the emission control signals may be set to a gate-off voltage (e.g., a high voltage) such that corresponding transistors included in the pixels PXL1, PXL2, and PXL3 can be turned off. In addition, the scan signals may be set to a gate-on voltage (e.g., a low voltage) such that corresponding transistors included in the pixels PXL1, PXL2, and PXL3 can be turned on.

The data driver 230 may supply data signals to the data lines D1 to Dm corresponding to a data control signal DCS.

The data signals supplied to the data lines D1 to Dm are supplied to pixels PXL1, PXL2, and PXL3 selected by a received scan signal.

The timing controller 250 may supply the data control signal DCS to the data driver 230. Also, the timing controller 250 may convert externally input image data into image data DATA suitable for specifications of the data driver 230, and may supply the image data DATA to the data driver 230.

The data control signal DCS may include a source start signal, a source output enable signal, a source sampling clock, and the like. The source start signal may control a sampling start time of the data driver 230. The source sampling clock may control a sampling operation of the data driver 230, based on a rising edge or a falling edge. The source output enable signal may control an output timing of the data driver 230.

The timing controller 250 may respectively supply, to the scan drivers 211, 212, and 213, the scan driver control signals FLM1, FLM2, FLM3, CLK1, and CLK2 generated based on externally supplied timing signals.

The first scan driver control signal may include a first start signal FLM1 and clock signals CLK1 and CLK2. The first start signal FLM1 may control a supply timing of the first dummy scan signal, and the clock signals CLK1 and CLK2 may be used to shift the first start signal FLM1.

The second scan driver control signal may include a second start signal FLM2 and the clock signals CLK1 and CLK2. The second start signal FLM2 may control a supply timing of the second dummy scan signal, and the clock signals CLK1 and CLK2 may be used to shift the second start signal FLM2.

The third scan driver control signal may include a third start signal FLM3 and the clock signals CLK1 and CLK2. The third start signal FLM3 may control a supply timing of the third dummy scan signal, and the clock signals CLK1 and CLK2 may be used to shift the third start signal FLM3.

The same clock signals CLK1 and CLK2 may be supplied to the scan drivers 211, 212, and 213.

The timing controller 250 may respectively supply, to the emission drivers 311, 312, and 313, the emission driver control signals EFLM1, EFLM2, EFLM3, CLK5, and CLK6 generated based on timing signals supplied from the outside.

The first emission driver control signal may include a fourth start signal EFLM1 and clock signals CLK5 and CLK6. The fourth start signal EFLM1 may control supply timings of the first emission control signals, and the clock signals CLK5 and CLK6 may be used to shift the fourth start signal EFLM1.

The second emission driver control signal may include a fifth start signal EFLM2 and the clock signals CLK5 and CLK6. The fifth start signal EFLM2 may control supply timings of the second emission control signals, and the clock signals CLK5 and CLK6 may be used to shift the fifth start signal EFLM2.

The third emission driver control signal may include a sixth start signal EFLM3 and the clock signals CLK5 and CLK6. The sixth start signal EFLM3 may control supply timings of the third emission control signals, and the clock signals CLK5 and CLK6 may be used to shift the sixth start signal EFLM3.

The same clock signals CLK5 and CLK6 may be supplied to the emission drivers 311, 312, and 313.

Meanwhile, in FIG. 3, it is illustrated that the fourth start signals EFLM1 is supplied to the first emission driver 311, the fifth start signal EFLM2 is supplied to the second emission driver 312, and the sixth start signal EFLM3 is supplied to the third emission driver 313, but the present disclosure is not limited thereto. For example, a start signal may be supplied to only the first emission driver 311, and the second emission driver 312 may be supplied with an output signal of the last first emission control line E1*j* to be used as the start signal. In addition, the third emission driver 313 may be supplied with an output signal of the last second emission control line E2*n* as the start signal.

In FIG. 3, it is illustrated that the scan drivers 211, 212, and 213, the emission drivers 311, 312, and 313, the data driver 230, and the timing controller 250 are individually provided. However, at least some of the components may be integrated, if suitable. In addition, the scan drivers 211, 212, and 213, the emission drivers 311, 312, and 313, the data driver 230, and the timing controller 250 may be implemented in various ways, including chip on glass, chip on plastic, tape carrier package, chip on film, and the like.

FIG. 4 is a diagram illustrating an embodiment of the first pixel shown in FIG. 3.

For convenience of description, a first pixel PXL1 coupled to an mth data line Dm and an ith first scan line S1*i* is illustrated in FIG. 4.

Referring to FIG. 4, the first pixel PXL1 according to the present embodiment may include an organic light emitting diode OLED, first to seventh transistors T1 to T7, and a storage capacitor Cst.

An anode of the organic light emitting diode OLED may be coupled to the first transistor T1 via the sixth transistor T6, and a cathode of the organic light emitting diode OLED may be coupled to the second power source ELVSS. The organic light emitting diode OLED may generate light (e.g., light with a predetermined luminance) corresponding to the amount of current supplied from the first transistor T1.

The first power source ELVDD may be a voltage that is higher than that of the second power source ELVSS such that current can flow through the organic light emitting diode OLED.

The seventh transistor T7 may be coupled between an initialization power source Vint and the anode of the organic light emitting diode OLED. In addition, a gate electrode of the seventh transistor T7 may be coupled to an (i+1)th first scan line S1*i*+1. The seventh transistor T7 may be turned on when a scan signal is supplied to the (i+1)th first scan line S1*i*+1 to supply the voltage of the initialization power source Vint to the anode of the organic light emitting diode OLED. Here, the initialization power source Vint may be a voltage that is lower than a data signal.

Meanwhile, in FIG. 4, it is illustrated that the (i+1)th first scan line S1*i*+1 is coupled to the gate electrode of the seventh transistor T7, but the present disclosure is not limited thereto. For example, the gate electrode of the seventh transistor T7 may be coupled to the ith first scan line S1*i*, or may be coupled to an (i−1)th first scan line S1*i*−1.

The sixth transistor T6 may be coupled between the first transistor T1 and the organic light emitting diode OLED. In addition, a gate electrode of the sixth transistor T6 may be coupled to an ith first emission control line E1*i*. The sixth transistor T6 may be turned off when an emission control signal is supplied to the ith first emission control line E1*i*, and may be turned on otherwise.

The fifth transistor T5 may be coupled between the first power source ELVDD and the first transistor T1. In addition, a gate electrode of the fifth transistor T5 may be coupled to the ith first emission control line E1*i*. The fifth transistor T5 may be turned off when the emission control signal is supplied to the ith first emission control line E1*i*, and may be turned on otherwise.

A first electrode of the first transistor (e.g., driving transistor) T1 may be coupled to the first power source ELVDD via the fifth transistor T5, and a second electrode of the first transistor T1 may be coupled to the anode of the organic light emitting diode OLED via the sixth transistor T6. In addition, a gate electrode of the first transistor T1 may be coupled to a tenth node N10. The first transistor T1 may control the amount of current flowing from the first power source ELVDD to the second power source ELVSS via the organic light emitting diode OLED according to a voltage of the tenth node N10.

The third transistor T3 may be coupled between the second electrode of the first transistor T1 and the tenth node N10. In addition, a gate electrode of the third transistor T3 may be coupled to the ith first scan line S1*i*. The third transistor T3 may be turned on when a scan signal is supplied to the ith first scan line S1*i* to allow the second electrode of the first transistor T1 and the tenth node N10 to be electrically coupled to each other. Therefore, when the third transistor T3 is turned on, the first transistor T1 may be diode-coupled.

The fourth transistor T4 may be coupled between the tenth node N10 and the initialization power source Vint. In addition, a gate electrode of the fourth transistor T4 may be coupled to the (i−1)th first scan line S1*i*−1. The fourth transistor T4 may be turned on when a scan signal is supplied to the (i−1)th first scan line S1*i*−1 to supply the voltage of the initialization power source Vint to the tenth node N10.

Meanwhile, when the first pixel PXL1 shown in FIG. 4 is located on the first horizontal line of the first pixel area AA1, the gate electrode of the fourth transistor T4 may be coupled to the first dummy scan line 10, which corresponds to, or functions as, the (i−1)th first scan line S1*i*−1.

The second transistor T2 may be coupled between the mth data line Dm and the first electrode of the first transistor T1. In addition, a gate electrode of the second transistor T2 may be coupled to the ith first scan line S1*i*. The second transistor T2 may be turned on when the scan signal is supplied to the ith first scan line S1*i* to allow the mth data line Dm and the first electrode of the first transistor T1 to be electrically coupled to each other.

The storage capacitor Cst may be coupled between the first power source ELVDD and the tenth node N10. The storage capacitor Cst may store a voltage corresponding to the data signal and a threshold voltage of the first transistor T1.

Meanwhile, the second pixel PXL2 and the third pixel PXL3 may be implemented with the same circuit as the first pixel PXL1. Therefore, repeated detailed descriptions of the second pixel PXL2 and the third pixel PXL3 will be omitted.

In addition, the pixel structure described in FIG. 4 merely corresponds to one example using three scan lines and one emission control line, and therefore, the pixels PXL1, PXL2, and PXL3 of the present disclosure are not limited to the above-described pixel structure. Instead, the pixel may be any circuit structure that enables current to be supplied to the organic light emitting diode OLED, and may be selected as any one of various structures.

In the present disclosure, the organic light emitting diode OLED may generate light of various colors (e.g., red, green, and blue) corresponding to the amount of current supplied from the driving transistor, but the present disclosure is not limited thereto. For example, the organic light emitting diode OLED may generate white light corresponding to the amount of the current supplied from the driving transistor. In this case, a color image may be realized using a separate color filter, etc.

Figure 5:
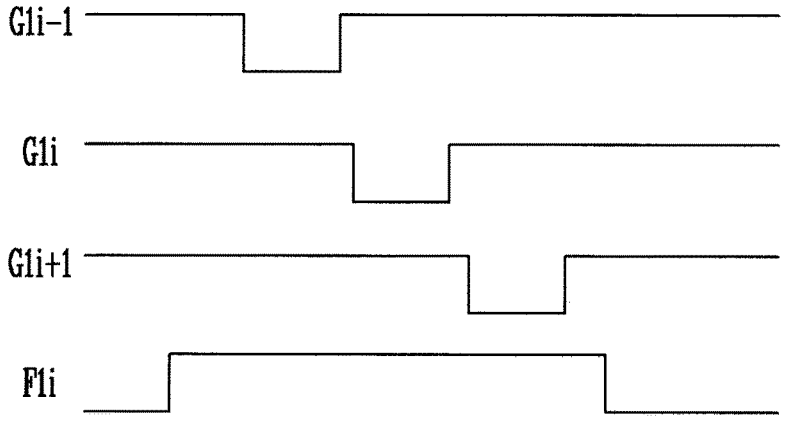
FIG. 5 is a diagram illustrating a driving method of the first pixel shown in FIG. 4.

FIG. 5 is a diagram illustrating a driving method of the first pixel shown in FIG. 4.

First, an emission control signal F1*i* is supplied to the ith first emission control line E1*i*. When the emission control signal F1*i* is supplied to the ith first emission control line E1*i*, the fifth transistor T5 and the sixth transistor T6 are turned off. In this case, the first pixel PXL may be set to a non-emission state.

After that, the fourth transistor T4 is turned on as a scan signal G1*i*−1 is supplied to the (i−1)th first scan line S1*i*−1. When the fourth transistor T4 is turned on, the voltage of the initialization power source Vint is supplied to the tenth node N10. Then, the tenth node N10 may be initialized to the voltage of the initialization power source Vint.

After the tenth node N10 is initialized to the voltage of the initialization power source Vint, a scan signal G1*i* is supplied to the ith first scan line S1*i*. When the scan signal G1*i* is supplied to the ith first scan line S1*i*, the second transistor T2 and the third transistor T3 are turned on.

When the third transistor T3 is turned on, the first transistor T1 is diode-coupled. When the second transistor T2 is turned on, a data signal from the mth data line Dm is supplied to the first electrode of the first transistor T1. In this case, because the tenth node N10 is initialized to the voltage of the initialization power source Vint, which is lower than the voltage of the data signal, the first transistor T1 may be turned on. When the first transistor T1 is turned on, a voltage obtained by subtracting the threshold voltage of the first transistor T1 from the data signal is applied to the tenth node N10. The storage capacitor Cst stores the voltage corresponding to the data signal and the threshold voltage of the first transistor T1, which is applied to the tenth node N10.

After that, a scan signal G1*i*+1 is supplied to the (i+1)th first scan line S1*i*+1. When the scan signal G1*i*+1 is supplied to the (i+1)th first scan line S1*i*+1, the seventh transistor T7 is turned on.

When the seventh transistor T7 is turned on, the voltage of the initialization power source Vint is supplied to the anode of the organic light emitting diode OLED. Then, a parasitic capacitor parasitically formed in the organic light emitting diode OLED is discharged, and accordingly, the black expression ability of the first pixel PXL1 can be improved.

After that, the supply of the emission control signal F1*i* to the ith first emission control line E1*i* is stopped. When the supply of the emission control signal F1*i* to the ith first emission control line E1*i* is stopped, the fifth transistor T5 and the sixth transistor T6 are turned on. Then, there is formed a current path from the first power source ELVDD to the second power source ELVSS via the fifth transistor T5, the first transistor T1, the sixth transistor T6, and the organic light emitting diode OLED.

At this time, the first transistor T1 controls the amount of current flowing from the first power source ELVDD to the second power source ELVSS via the organic light emitting diode OLED according to the voltage of the tenth node N10. The organic light emitting diode OLED generates light (e.g., with a predetermined luminance) corresponding to the amount of the current supplied from the first transistor T1. The first pixel PXL1 may generate light while repeating the above-described process. In addition, the second pixel PXL2 and the third pixel PXL3 may be driven in the same manner as the first pixel PXL1.

The emission control signal F1*i* supplied to the ith first emission control line E1*i* may be supplied to overlap with at least one scan signal such that the pixels PXL1, PXL2, and PXL3 are set to the non-emission state during a period in which the data signal is charged in the pixels PXL1, PXL2, and PXL3. The supply timing of the emission control signal F1*i* may be changed in various forms.

Figure 6:
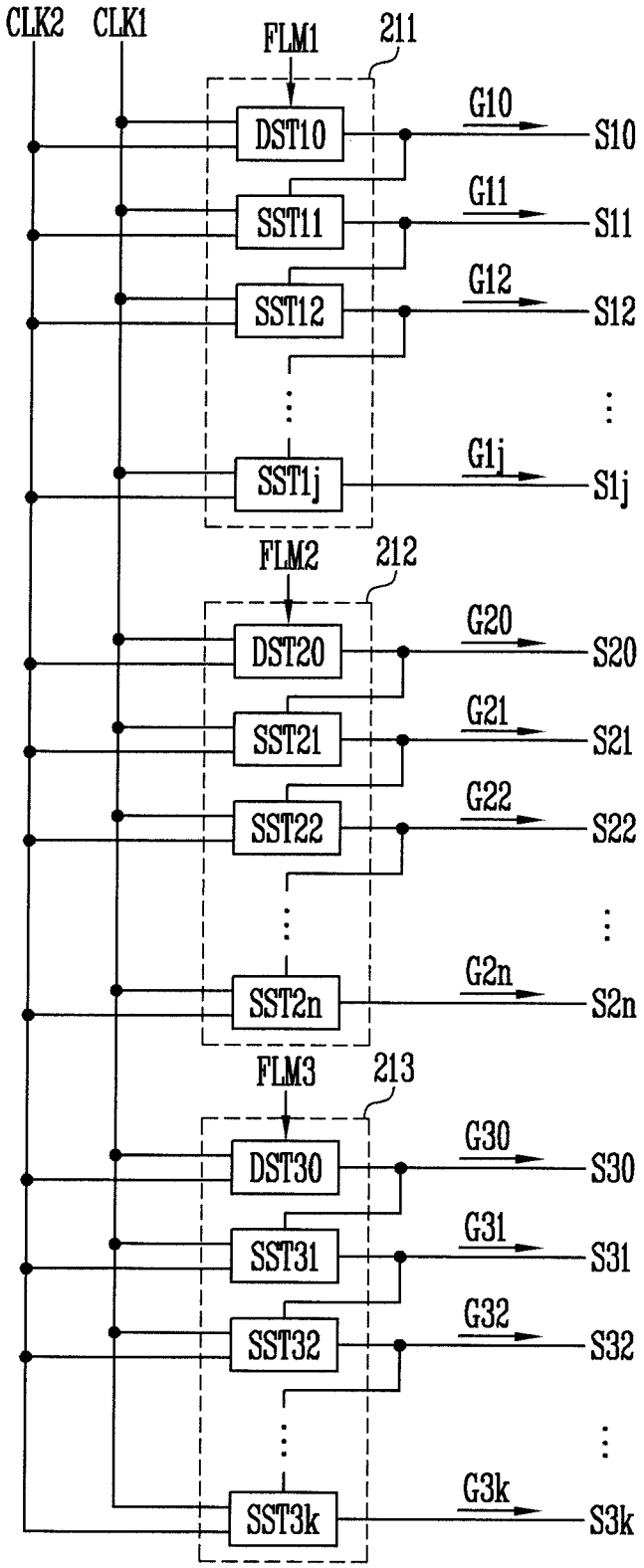
FIG. 6 is a diagram illustrating in more detail a configuration of scan drivers shown in FIG. 3.

FIG. 6 is a diagram illustrating in more detail a configuration of the scan drivers shown in FIG. 3.

Referring to FIG. 6, the first scan driver 211 may include a first dummy stage DST10 and first scan stages SST11 to SST1*j*.

The first dummy stage DST10 may be located prior to a first first scan stage SST11. The first dummy stage DST10 may be coupled to one end of the first dummy scan line S10, and may supply a first dummy scan signal G10 through the first dummy scan line S10.

The first scan stages SST11 to SST1*j* may be coupled to respective ends of the first scan lines S11 to S1*j*. Accordingly, the first scan stages SST11 to SST1*j* may supply first scan signals G11 to G1*j* to the first scan lines S11 to S1*j*, respectively.

The first dummy stage DST10 may be coupled to the first pixels PXL1 located on the first horizontal line of the first pixel area AA1 through the first dummy scan line S10. For example, the first dummy stage DST10 may be coupled to the gate electrode of the fourth transistor T4 of the first pixel PXL1 shown in FIG. 4.

In this case, the first first scan stage SST11 may be coupled to the first pixels PXL1 located on the first horizontal line of the first pixel area AA1 through the first first scan line S11. For example, the first first scan stage SST11 may be coupled to the gate electrodes of the second transistor T2 and the third transistor T3 of the first pixel PXL1 shown in FIG. 4.

In addition, a second first stage SST12 may be coupled to the first pixels PXL1 located on the first horizontal line of the first pixel area AA1 through a second first scan line S12. For example, the second first stage SST12 may be coupled to the gate electrode of the seventh transistor T7 of the first pixel PXL1 shown in FIG. 4.

The first dummy stage DST10 and the first scan stages SST11 to SST1*j* may be operated corresponding to the clock signals CLK1 and CLK2 supplied from the timing controller 250. Also, the first dummy stage DST10 and the first scan stages SST11 to SST1*j* may be implemented with the same circuit.

The first dummy stage DST10 may be supplied with the first start signal FLM1 supplied from the timing controller 250. In addition, each of the first scan stages SST11 to SST1*j* may be respectively supplied with an output signal (e.g., a scan signal) of the first dummy stage DST10 or of a previous scan stage thereof. For example, the first first scan stage SST11 may be supplied with an output signal G10 of the first dummy stage DST10, and each of the other first scan stages SST12 to SST1*j* may be supplied with an output signal (e.g., a first scan signal) of a respective previous scan stage thereof.

Next, the second scan driver 212 may include a second dummy stage DST20 and second scan stages SST21 to SST2*n*.

The second dummy stage DST20 may be located prior to a first second scan stage SST21. That is, the second dummy stage DST20 may be located between the last first scan stage SST1*j* and the first second scan stage SST21.

The second dummy stage DST20 may be coupled to one end of the second dummy scan line S20, and may supply a second dummy scan signal G20 through the second dummy scan line 20.

The second scan stages SST21 to SST2*n* may be coupled to respective ends of the second scan lines S21 to S2*n*. Accordingly, the second scan stages SST21 to SST2*n* may supply second scan signals G21 to G2*n* to the second scan lines S21 to S2*n*, respectively.

The second dummy stage DST20 may be coupled to the second pixels PXL2 located on the first horizontal line of the second pixel area AA2 through the second dummy scan line S20. Because the second pixels PXL2 have the same configuration as the first pixel PXL1 shown in FIG. 4, the second dummy stage DST20 may be coupled to a gate electrode of a fourth transistor included in the second pixel PXL2.

In an embodiment, as the second dummy stage DST20 is located prior to the second scan stages SST21 to SST2*n*, the second pixels PXL2 located on the first horizontal line of the second pixel area AA2 might not be coupled to the last first scan stage SST1*j*.

Meanwhile, the first second scan stage SST21 may be coupled to the second pixels PXL2 located on the first horizontal line of the second pixel area AA2 through the first second scan line S21. The first second scan stage SST21 may be coupled to gate electrodes of second and third transistors of the second pixel PXL2.

The second dummy stage DST20 and the second scan stages SST21 to SST2*n* may be operated corresponding to the clock signals CLK1 and CLK2 supplied from the timing controller 250. Also, the second dummy stage DST20 and the second scan stages SST21 to SST2*n* may be implemented with the same circuit.

The second dummy stage DST20 may be supplied with the second start signal FLM2 supplied from the timing controller 250. In addition, each of the second scan stages SST21 to SST2*n* may be respectively supplied with an output signal (e.g., a second scan signal) of the second dummy stage DST20 or of a previous scan stage thereof.

For example, the first second scan stage SST21 may be supplied with an output signal G20 of the second dummy stage DST20, and each of the other second scan stages SST22 to SST2*n* may be respectively supplied with an output signal of a previous stage thereof.

Next, the third scan driver 213 may include a third dummy stage DST30 and third scan stages SST31 to SST3*k*.

The third dummy stage DST30 may be located prior to a first third scan stage SST31. That is, the third dummy stage DST30 may be located between the last second scan stage SST2*n* and the first third scan stage SST31. The third dummy stage DST30 may be coupled to one end of the third dummy scan line S30, and may supply a third dummy scan signal G30 through the third dummy scan line S30.

The third scan stages SST31 to SST3*k* may be coupled to respective ends of the third scan lines S31 to S3*k*. Accordingly, the third scan stages SST31 to SST3*k* may supply third scan signals G31 to G3*k* to the third scan lines S31 to S3*k*, respectively.

The third dummy stage DST30 may be coupled to the third pixels PXL3 located on the first horizontal line of the third pixel area AA3 through the third dummy scan line S30. Because the third pixels PXL3 has the same configuration as the first pixel PXL1 shown in FIG. 4, the third dummy stage DST30 may be coupled to a gate electrode of a fourth transistor included in the third pixel PXL3.

In an embodiment, as the third dummy stage DST30 is located prior to the third scan stages SST31 to SST3*k*, the third pixels PXL3 located on the first horizontal line of the third pixel area AA3 might not be coupled to the last second scan stage SST2*n*.

Meanwhile, the first third scan stage SST31 may be coupled to the third pixels PXL3 located on the first horizontal line of the third pixel area AA3 through the first third scan line S31. The first third scan stage SST31 may be coupled to gate electrodes of second and third transistors of the third pixel PXL3.

The third dummy stage DST30 and the third scan stages SST31 to SST3*k* may be operated corresponding to the clock signals CLK1 and CLK2 supplied from the timing controller 250. Also, the third dummy stage DST30 and the third scan stages SST31 to SST3*k* may be implemented with the same circuit.

The third dummy stage DST30 may be supplied with the third start signal FLM3 supplied from the timing controller 250. In addition, each of the third scan stages SST31 to SST3*k* may be respectively supplied with an output signal (e.g., a third scan signal) of the third dummy stage DST30 or of a previous stage thereof. For example, the first third scan stage SST31 may be supplied with an output signal G30 of the third dummy stage DST30, and each of the other third scan stages SST32 to SST3*k* may be supplied with a respective output signal of a previous scan stage thereof.

Meanwhile, in FIGS. 3 and 6, it is illustrated that the clock signals include the first and second clock signals, but the present disclosure is not limited thereto. For example, the number of clock signals supplied to the scan drivers 211, 212, and 213 may be variously changed.

Figure 7A:
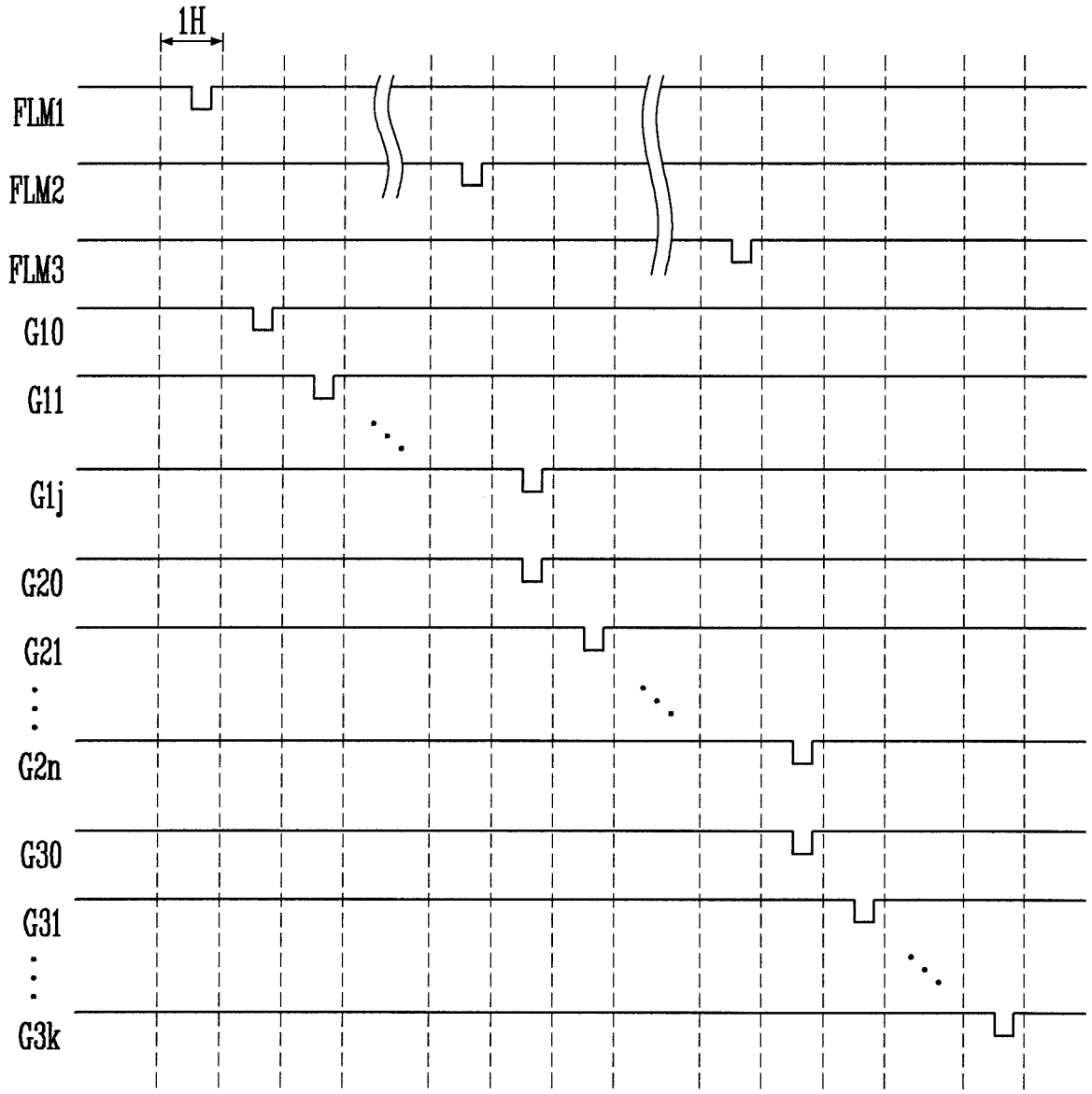
FIG. 7A is a waveform diagram illustrating output timings of scan signals output from the scan drivers when the display device shown in FIG. 3 is driven in a second mode.
Figure 7B:
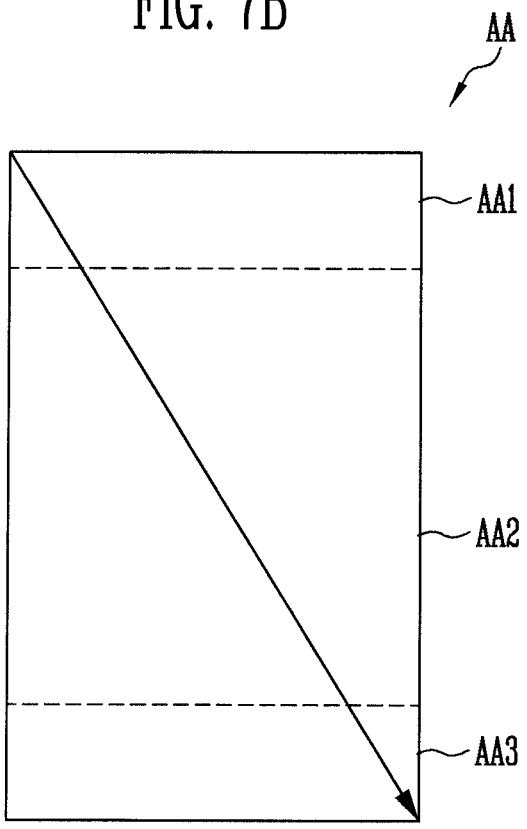
FIG. 7B is a diagram illustrating a supply order of scan signals supplied to a display area when the display device shown in FIG. 3 is driven in the second mode.

FIG. 7A is a waveform diagram illustrating output timings of scan signals output from the scan drivers when the display device shown in FIG. 3 is driven in the second mode. FIG. 7B is a diagram illustrating a supply order of scan signals supplied to the display area when the display device shown in FIG. 3 is driven in the second mode.

First, referring to FIG. 7A, when the display device 10 is driven in the second mode, the timing controller 250 may sequentially supply the first start signal FLM1, the second start signal FLM2, and the third start signal FLM3 respectively to the first dummy stage DST10, the second dummy stage DST20, and the third dummy stage DST30. Here, supply timings of the first start signal FLM1, the second start signal FLM2, and the third start signal FLM3 may be set such that the first scan signals G11 to G1*j*, the second scan signals G21 to G2*n*, and the third scan signals G31 to G3*k* are sequentially supplied. In addition, the first start signal FLM1, the second start signal FLM2, and the third start signal FLM3 may have the same width, and the width may be changed.

When the first start signal FLM1 is supplied, the first dummy scan signal G10 and the first scan signals G11 to G1*j* may be sequentially output. For example, the first dummy stage DST10 may output the first dummy scan signal G10 by shifting the first start signal FLM1 corresponding to the clock signals CLK1 and CLK2.

Next, the first first scan stage SST11 may output a first first scan signal G11 by shifting the first dummy scan signal G10. The other first scan signals G12 to G1*j* may be sequentially output in a manner similar to the above-described manner.

When the second start signal FLM2 is supplied, the second dummy scan signal G20 and the second scan signals G21 to G2*n* may be sequentially output. For example, the second dummy stage DST20 may output the second dummy scan signal G20 by shifting the second start signal FLM2 corresponding to the clock signals CLK1 and CLK2. In this case, an output timing of the second start signal FLM2 may be set such that the second dummy scan signal G20 overlaps with the last first scan signal G1*j*.

Next, the first second scan stage SST21 may output a first second scan signal G21 by shifting the second dummy scan signal G20. The other second scan signals G22 to G2*n* may be sequentially output in a manner similar to the above-described manner.

When the third start signal FLM3 is supplied, the third dummy scan signal G30 and the third scan signals G31 to G3*k* may be sequentially output. For example, the third dummy stage DST30 may output the third dummy scan signal G30 by shifting the third start signal FLM3 corresponding to the clock signals CLK1 and CLK2. In this case, an output timing of the third start signal FLM3 may be set such that the third dummy scan signal G30 overlaps with the last second scan signal G2*n*.

Next, the first third scan stage SST31 may output a first third scan signal G31 by shifting the third dummy scan signal G30. The other third scan signals G32 to G3*k* may be sequentially output in a manner similar to the above-described manner.

Accordingly, as shown in FIG. 7B, a data signal corresponding to an effective image can be supplied as first pixels PXL1 on each horizontal line of the first pixel area AA1, second pixels PXL2 on each horizontal line of the second pixel area AA2, and third pixels PXL3 on each horizontal line of the third pixel area AA3 are sequentially selected during one frame period for implementing one screen.

Figure 8A:
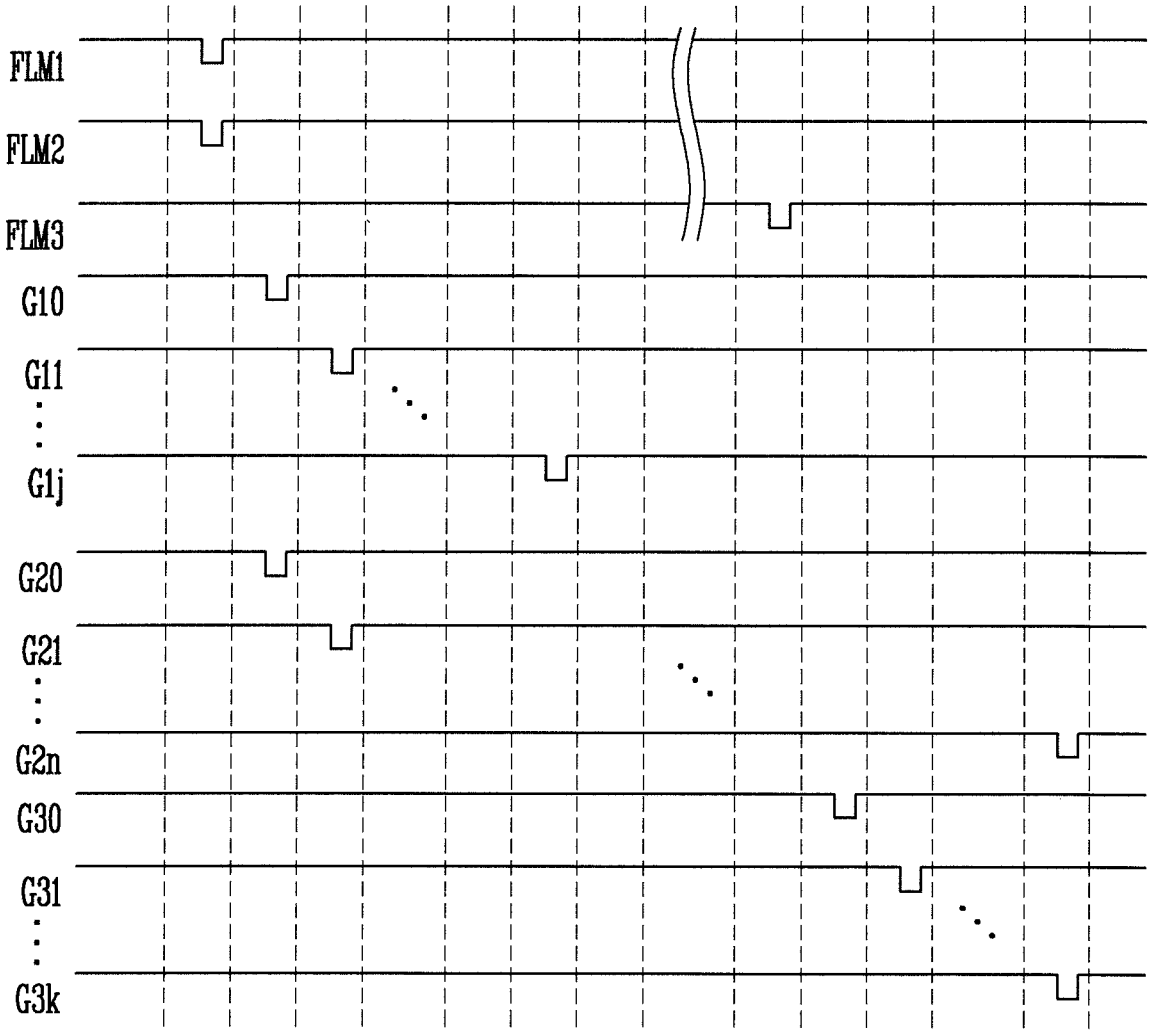
FIG. 8A is a waveform diagram illustrating output timings of scan signals output from the scan drivers when the display device shown in FIG. 3 is driven in a first mode.
Figure 8B:
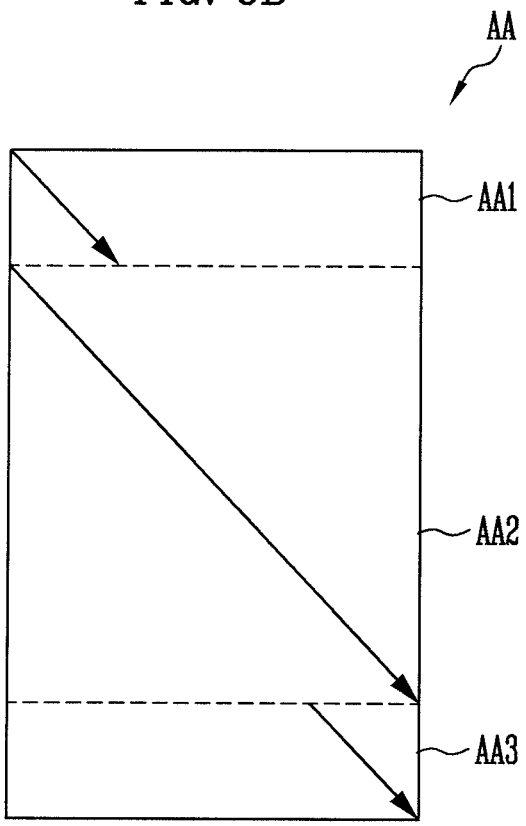
FIG. 8B is a diagram illustrating a supply order of scan signals supplied to the display area when the display device shown in FIG. 3 is driven in the first mode.

FIG. 8A is a waveform diagram illustrating output timings of scan signals output from the scan drivers when the display device shown in FIG. 3 is driven in the first mode. FIG. 8B is a diagram illustrating a supply order of scan signals supplied to the display area when the display device shown in FIG. 3 is driven in the first mode.

When the display device 10 is driven in the first mode, the timing controller 250 may sequentially supply the first start signal FLM1, the second start signal FLM2, and the third start signal FLM3 respectively to the first dummy stage DST10, the second dummy stage DST20, and the third dummy stage DST30. In this case, a supply order of the first start signal FLM1, the second start signal FLM2, and the third start signal FLM3 may be different from that when the display device 10 is driven in the second mode. That is, the timing controller 250 may set the supply order of the first start signal FLM1, the second start signal FLM2, and the third start signal FLM3 such that the first scan signals G11 to G1*j* and the third scan signals G31 to G3*k* are supplied while the second scan signals G21 to G2*n* are being sequentially supplied.

The supply order of the first start signal FLM1, the second start signal FLM2, and the third start signal FLM3 may be set such that the period in which the first scan signals G11 to G1*j* are supplied overlaps with a portion of the period in which the second scan signals G21 to G2*n* are supplied, and such that the period in which the third scan signals G31 to G3*k* are supplied also overlaps with a portion (e.g., another portion) of the period in which the second scan signals G21 to G2*n* are supplied. In this case, the period in which the first scan signals G11 to G1*k* are supplied may overlap or might not overlap with the period in which the third scan signals G31 to G3*k* are supplied.

Referring to FIG. 8A, when the first start signal FLM1 is supplied, the first dummy scan signal G10 and the first scan signals G11 to G1*j* may be sequentially output. For example, the first dummy stage DST10 may output the first dummy scan signal G10 by shifting the first start signal FLM1 corresponding to the clock signals CLK1 and CLK2.

Next, the first first scan stage SST11 may output the first first scan signal G11 by shifting the first dummy scan signal G10. The other first scan signals G12 to G1*j* may be sequentially output in a manner similar to the above-described manner. In this case, a dummy data signal is supplied to the first pixels PXL1, and accordingly, a dummy image may be displayed in the first pixel area AA1. The dummy image may be a portion of an effective image displayed in the second pixel area AA2.

The second start signal FLM2 may be concurrently or simultaneously supplied together with the first start signal FLM1. When the second start signal FLM2 is supplied, the second dummy scan signal G20 and the second scan signals G21 to G2*n* may be sequentially output. For example, the second dummy stage DST20 may output the second dummy scan signal G20 by shifting the second start signal FLM2 corresponding to the clock signals CLK1 and CLK2.

Next, the first second scan stage SST21 may output the first second scan signal G21 by shifting the second dummy scan signal G20. The other second scan signals G22 to G2*n* may be sequentially output in a manner similar to the above-described manner.

As the second start signal FLM2 and the first start signal FLM1 are concurrently or simultaneously supplied, the first scan signals G11 to G1*j* and some of the second scan signals G21 to G2*n* may be concurrently or simultaneously output.

As described above, when the display device 10 is driven in the first mode, the second scan signals G21 to G2*n* are not supplied after all of the first scan signals G11 to G1*j* are supplied. That is, the last first scan signal G1*j* and the first second scan signal G21 are not sequentially supplied.

When the last first scan line S1*j* is coupled to the second pixels PXL2 located on the first horizontal line of the second pixel area AA2, the second pixels PXL2 located on the first horizontal line of the second pixel area AA2 are influenced by the last first scan signal G1*j*. That is, the last first scan signal G1*j* may be supplied to the second pixels PXL2 located on the first horizontal line of the second pixel area AA2 while the second scan signals G21 to G2*n* are being supplied to the second pixel area AA2, and therefore, a bright or dark line may be displayed on the first horizontal line of the second pixel area AA2. In addition, the bright or dark line may remain as an afterimage at a boundary line between the first pixel area AA1 and the second pixel area AA2 when the driving mode of the display device 10 is changed from the first mode to the second mode. The above-described problem may also occur at a boundary line between the second pixel area AA2 and the third pixel area AA3.

According to the present embodiment, the last first scan line S1*j* is not coupled to the second pixels PXL2 located on the first horizontal line of the second pixel area AA2, and the second dummy scan line 20 is coupled to the second pixels PXL2 located on the first horizontal line of the second pixel area AA2, so that the second pixels PXL2 located on the first horizontal line of the second pixel area AA2 are not influenced by the last first scan signal G1*j*, thereby solving the above-described problem.

In addition, the last second scan line S2*n* is not coupled to the third pixels PXL3 located on the first horizontal line of the third pixel area AA3, and the third dummy scan line S30 is coupled to the third pixels PXL3 located on the first horizontal line of the third pixel area AA3, thereby solving the above-described problem.

When the third start signal FLM3 is supplied, the third dummy scan signal G30 and the third scan signals G31 to G3*k* may be sequentially output. For example, the third dummy stage DST30 may output the third dummy scan signal G30 by shifting the third start signal FLM3 corresponding to the clock signals CLK1 and CLK2. In this case, an output timing of the third start signal FLM3 may be set such that the last third scan signal G3*k* and the last second scan signal G2*n* are concurrently or simultaneously output.

Next, the first third scan stage SST31 may output the first third scan signal G31 by shifting the third dummy scan signal G30. The other third scan signals G32 to G3*k* may be sequentially output in a manner similar to the above-described manner.

The third scan signals G31 to G3*k* and some of the second scan signals G2*n*−*k*+1 to G2*n* may be concurrently or simultaneously supplied. In this case, a dummy data signal is supplied to the third pixels PXL3, and accordingly, a dummy image may be displayed in the third pixel area AA3. The dummy mage may be a portion of an effective image displayed in the second pixel area AA2.

Dummy images displayed in the first pixel area AA1 and in the third pixel area AA3 may be identical to, or different from, each other.

Meanwhile, when the display device 10 is driven in the first mode, the supply timings of the first start signal FLM1, the second start signal FLM2, and the third start signal FLM3 are not limited to those shown in FIG. 8.

That is, the supply timings of the first start signal FLM1, the second start signal FLM2, and the third start signal FLM3 may be variously changed within a section in which the second scan signals G21 to G2*n* are output.

Figure 9:
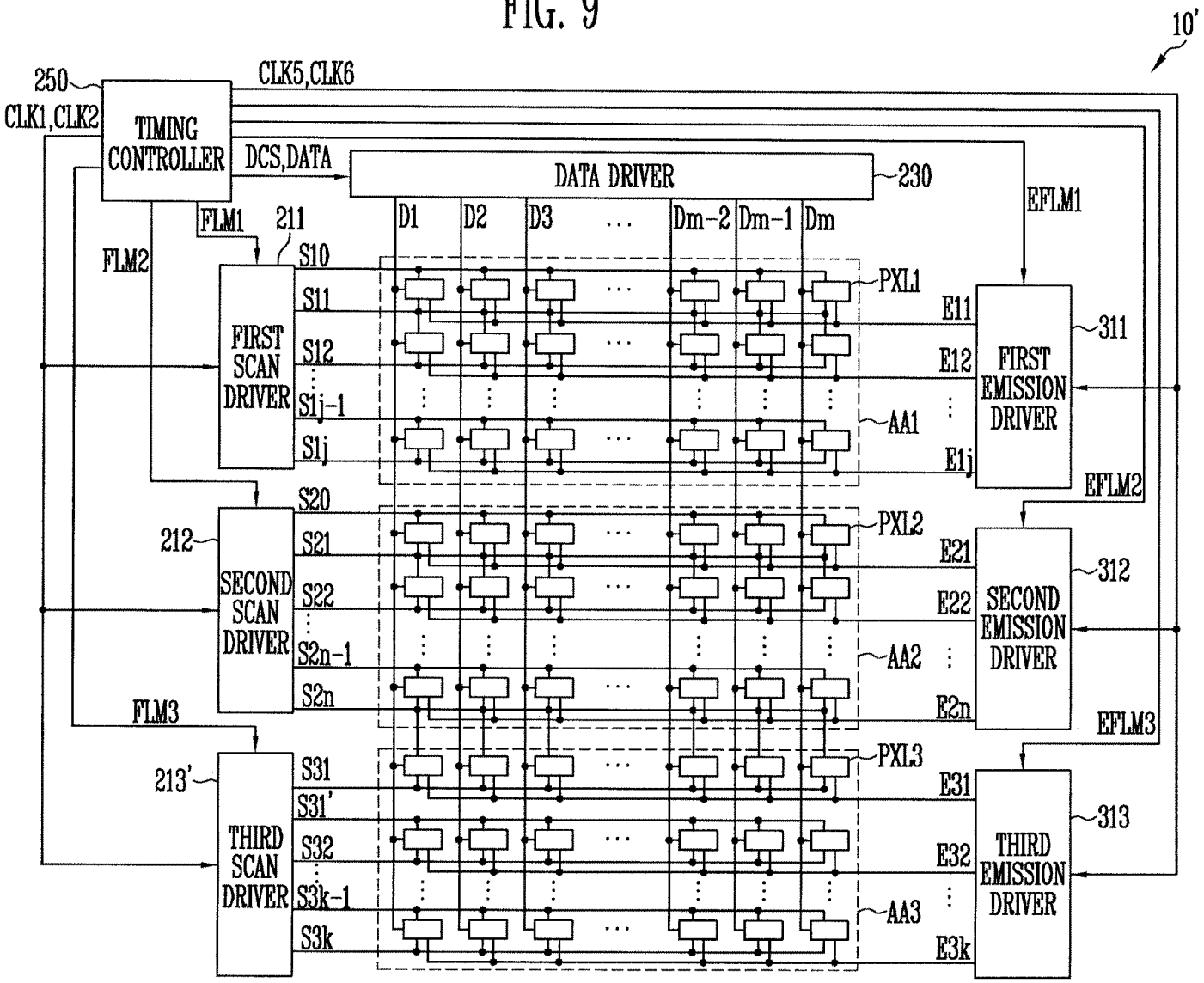
FIG. 9 is a diagram illustrating in detail a configuration of a display device according to another embodiment.
Figure 10:
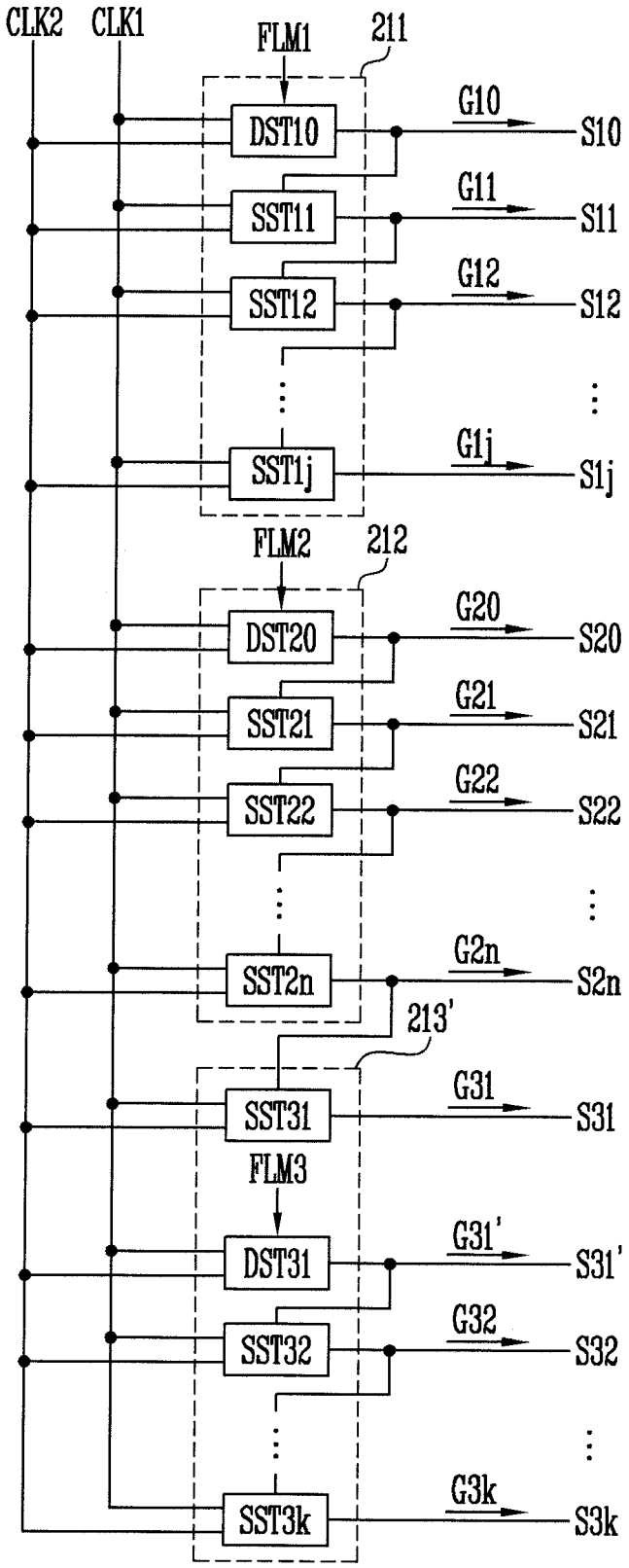
FIG. 10 is a diagram illustrating a configuration of scan drivers shown in FIG. 9.

FIG. 9 is a diagram illustrating in detail a configuration of a display device according to another embodiment. FIG. 10 is a diagram illustrating a configuration of scan drivers shown in FIG. 9.

A first scan driver 211 and a second scan driver 212, which are shown in FIGS. 9 and 10, may be implemented with the same configuration as the first scan driver 211 and the second scan driver 212 shown in FIGS. 3 and 6. Therefore, detailed descriptions of the first scan driver 211 and the second scan driver 212 will be omitted.

Referring to FIG. 9, third pixels PXL3 may be located in a third pixel area AA3 defined by a third dummy scan line S31', third scan lines S31 to S3*k*, and data lines D1 to Dm.

Third pixels PXL3 located on a first horizontal line of the third pixel area AA3 may be coupled to a last second scan line S2*n* and a first third scan line S31.

Third pixels PXL3 located on a second horizontal line of the third pixel area AA3 may be coupled to the third dummy scan line S31' and a second third scan line S32, and third pixels PXL3 located on any of a third horizontal line to the last horizontal line may be coupled to respective adjacent third scan lines S32 to S3*k*.

Referring to FIG. 10, a third scan driver 213' may include a third dummy stage DST31 and third scan stages SST31 to SST3*k*.

The third dummy stage DST31 may be located between a first third scan stage SST31 and a second third scan stage SST32. The third dummy stage DST31 may be coupled to one end of the third dummy scan line S31', and may supply a third dummy scan signal G31' through the third dummy scan line S31'.

The third scan stages SST31 to SST3*k* may be coupled to respective ends of the third scan lines S31 to S3*k*. Accordingly, the third scan stages SST31 to SST3*k* may supply third scan signals G31 to G3*k* to the third scan lines S31 to S3*k*, respectively.

The third dummy stage DST31 may be coupled to the third pixels PXL3 located on the second horizontal line of the third pixel area AA3 through the third dummy scan line S31'. In addition to the third dummy stage DST31, the second third scan stage SST32 and a third third scan stage SST33 may also be coupled to the third pixels PXL3 located on the second horizontal line of the third pixel area AA3.

The third dummy stage DST31 and the third scan stages SST31 to SST3*k* may be operated corresponding to clock signals CLK1 and CLK2 supplied from a timing controller 250. Also, the third dummy stage DST31 and the third scan stages SST31 to SST3*k* may be implemented with the same circuit.

The first third scan stage SST31 may be supplied with an output signal of a previous scan stage thereof. That is, the first third scan stage SST31 may be supplied with an output signal G2*n* of the last second scan stage SST2*n*.

The third dummy stage DST31 may be supplied with a third start signal FLM3 supplied from the timing controller 250. In addition, each of the other third scan stages SST32 to SST3*k* (excluding the first third scan stage SST31 and the third dummy stage DST31) may be supplied with a respective output signal (e.g., a scan signal) of the third dummy stage DST31 or of a previous stage thereof.

For example, the second third scan stage SST32 may be supplied with an output signal G31' of the third dummy stage DST31, and each of the other third scan stages SST33 to SST3*k* may be supplied with an output signal of a respective previous stage thereof.

Figure 11:
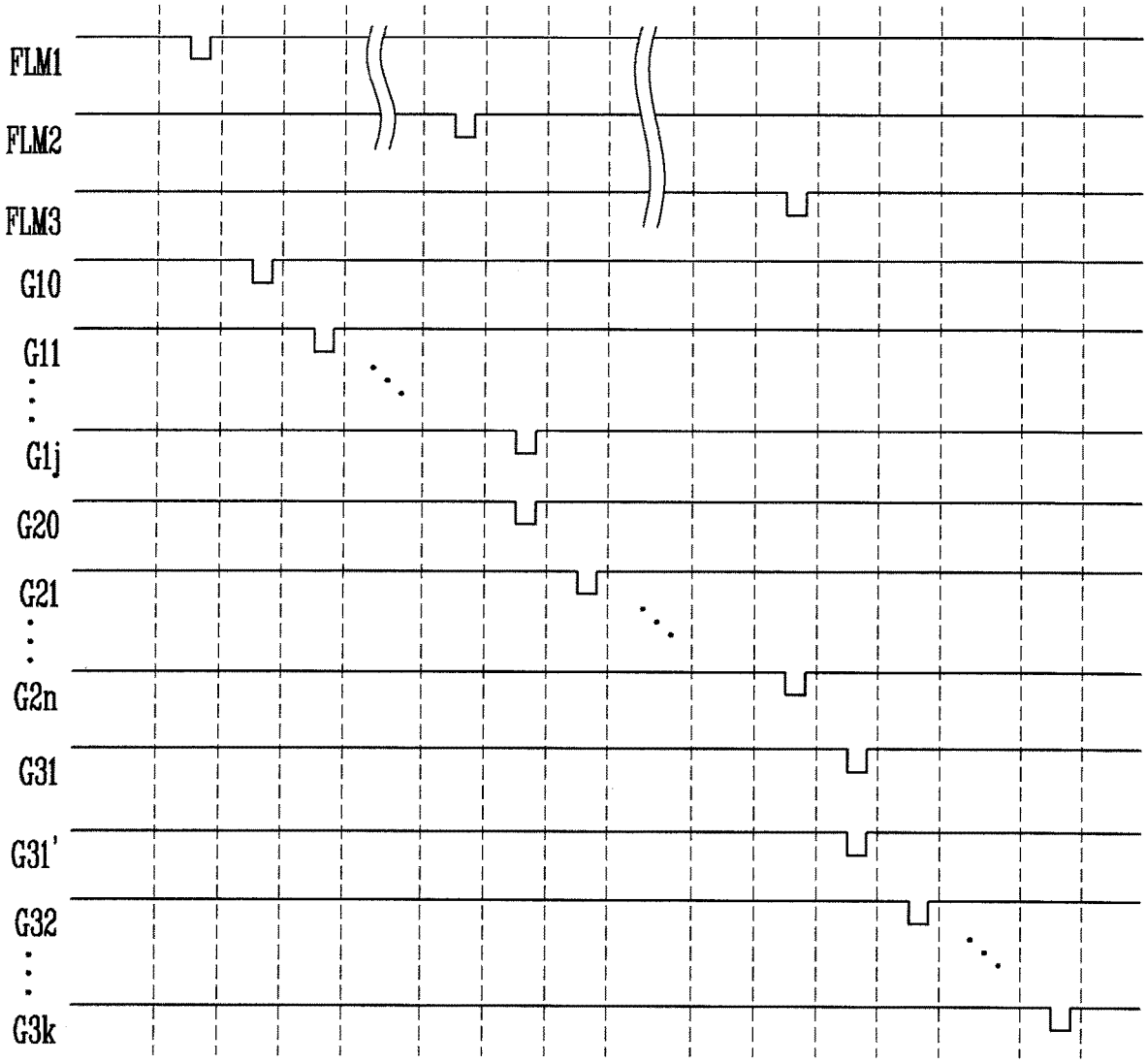
FIG. 11 is a waveform diagram illustrating output timings of scan signals output from the scan drivers shown in FIG. 10 when the display device is driven in the second mode.

FIG. 11 is a waveform diagram illustrating output timings of scan signals output from the scan drivers shown in FIG. 10 when the display device is driven in the second mode.

Output timings of a first start signal FLM1, a first dummy scan signal G10, first scan signals G11 to G1*j*, a second start signal FLM2, a second dummy scan signal G20, and second scan signals G21 to G2*n* may be identical to those of the first start signal FLM1, the first dummy scan signal G10, the first scan signals G11 to G1*j*, the second start signal FLM2, the second dummy scan signal G20, and the second scan signals G21 to G2*n*, respectively, which are shown in FIG. 7A. Therefore, their repeated detailed descriptions will be omitted.

Referring to FIG. 11, the first third scan stage SST31 may output a first third scan signal S31 by shifting the last second scan signal G2*n*.

Next, when the third start signal FLM3 is supplied, the third dummy scan signal G31' and the other third scan signals G32 to G3*k* may be sequentially supplied. For example, the third dummy stage DST31 may output the third dummy scan signal G31' by shifting the third start signal FLM3 corresponding to the clock signals CLK1 and CLK2. In this case, an output timing of the third start signal FLM3 may be set such that the third dummy scan signal S31' overlaps with the first third scan signal G31.

Next, the second third scan stage SST32 may output a second third scan signal G32 by shifting the third dummy scan signal G31'. The other third scan signals G33 to G3*k* may be sequentially output in a manner similar to the above-described manner.

Figure 12:
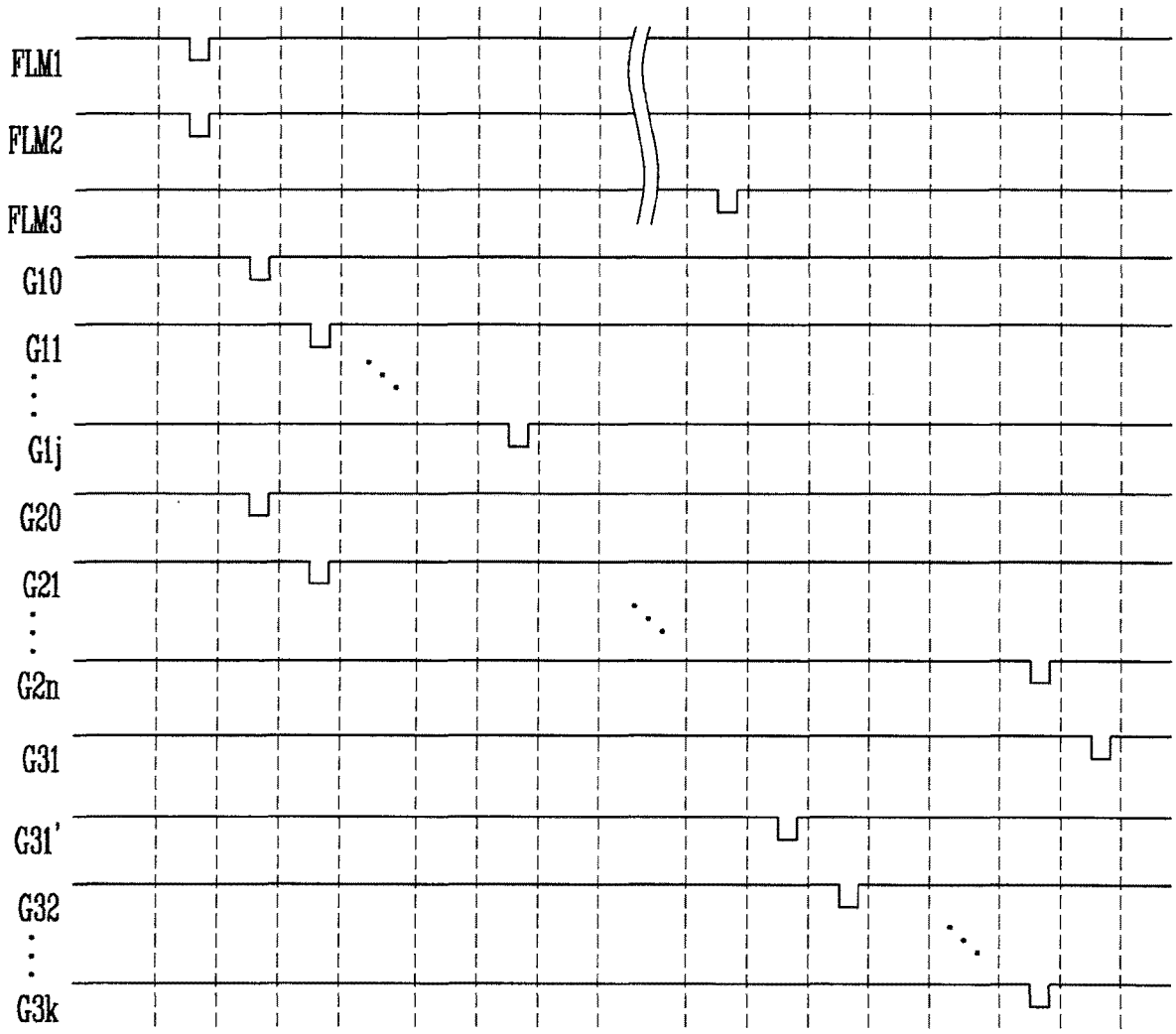
FIG. 12 is a waveform diagram illustrating output timings of scan signals output from the scan drivers shown in FIG. 10 when the display device is driven in the first mode.

FIG. 12 is a waveform diagram illustrating output timings of scan signals output from the scan drivers shown in FIG. 10 when the display device is driven in the first mode.

Output timings of the first dummy scan signal G10, the first scan signals G11 to G1*j*, the second dummy scan signal G20, and the second scan signals G21 to G2*n* may be respectively identical to those of the first dummy scan signal G10, the first scan signals G11 to G1*j*, the second dummy scan signal G20, and the second scan signals G21 to G2*n*, which are shown in FIG. 8A. Therefore, their repeated detailed descriptions will be omitted.

Referring to FIG. 12, the first third scan stage SST31 may output the first third scan signal S31 by shifting the last second scan signal G2*n*. Therefore, the second scan signals G21 to G2*n* and the first third scan signal G31 may be sequentially supplied.

When the third start signal FLM3 is supplied, the third dummy scan signal G31' and the other third scan signals G32 to G3*k* may be sequentially output. For example, the third dummy stage DST31 may output the third dummy scan signal G31' by shifting the third start signal FLM3 corresponding to the clock signals CLK1 and CLK2. In this case, the output timing of the third start signal FLM3 may be set such that the last third scan signal G3*k* and the last second scan signal G2*n* are concurrently or simultaneously output.

Next, the second third scan stage SST32 may output the second third scan signal G32 by shifting the third dummy scan signal G31'. The other third scan signals G33 to G3*k* may be sequentially output in the same manner.

As described above, when the display device 10' of the present embodiment is driven in the first mode, the third scan signals G31 to G3*k* are supplied to the third pixel area AA3 while some of the second scan signals G21 to G2*n* are supplied to the second pixel area AA2.

When a start signal is applied to the first third scan stage SST31 to individually drive the second pixel area AA2 and the third pixel area AA3 in the first mode, the last second scan signal G2*n* and the first third scan signal G31 are not sequentially output.

Referring to FIG. 4, each of second pixels PXL2 located on the last horizontal line of the second pixel area AA2 initializes the organic light emitting diode thereof corresponding to the first third scan signal G31. However, the last second scan signal G2*n* and the first third scan signal G31 are not sequentially output, and a turn-on signal is not supplied to the gate electrode of the seventh transistor at a timing where each of the second pixels PXL2 located on the last horizontal line of the second pixel area AA2 is to thereby initialize the organic light emitting diode thereof. Therefore, an image may be erroneously displayed on the last horizontal line of the second pixel area AA2, and a lateral line may remain as an afterimage at a boundary line between the second pixel area AA2 and the third pixel area AA3 when the driving mode of the display device 10' is changed from the first mode to the second mode.

According to the present embodiment, the second pixels PXL2 located on the last horizontal line of the second pixel area AA2 are coupled to the first third scan line S31, and the third dummy stage DST31 is located after the first third scan stage SST31, thereby solving the above-described problem. Further, the third pixel area AA3 can be driven separately from the second pixel area AA2.

Figure 13:
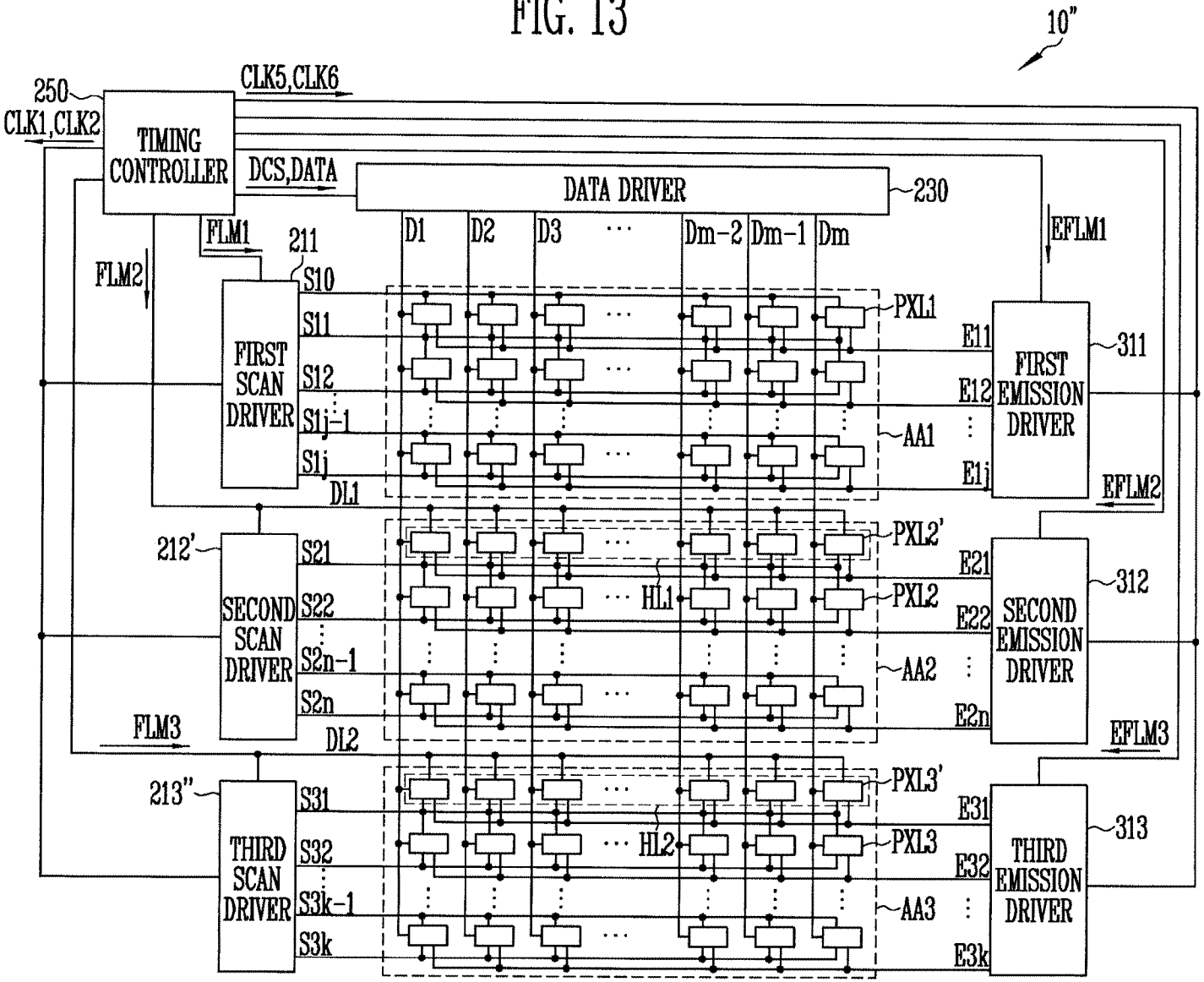
FIG. 13 is a diagram illustrating in detail a configuration of a display device according to still another embodiment.

FIG. 13 is a diagram illustrating in detail a configuration of a display device according to still another embodiment. Here, portions changed by comparing this embodiment with the embodiment described with reference to FIG. 3 will be mainly described, and repeated descriptions of portions overlapping with those of the above-described embodiment will be omitted.

Referring to FIG. 13, the display device 10" according to the present embodiment may include a first scan driver 211, a second scan driver 212', a third scan driver 213", a first auxiliary line DL1, and a second auxiliary line DL2.

Second pixels PXL2' located on a first horizontal line HL1 and second pixels PXL2 located on other horizontal lines may be provided in a second pixel area AA2. Here, the configuration and operation method of the second pixels PXL2 located on the other horizontal lines may be identical to those of the second pixels PXL2 shown in FIG. 3.

Third pixels PXL3' located on a first horizontal line HL2 and third pixels PXL3 located on other horizontal lines may be provided in a third pixel area AA3. Here, the configuration and operation method of the third pixels PXL3 located on the other horizontal lines may be identical to those of the third pixels PXL3 shown in FIG. 3.

The second scan driver 212' may be coupled to second scan lines S21 to S2*n*.

The third scan driver 213" may be coupled to third scan lines S31 to S3*k*.

The first auxiliary line DL1 may be coupled to the second pixels PXL2' located on the first horizontal line HL1 of the second pixel area AA2.

A timing controller 250 may supply a second start signal FLM2 to the second scan driver 212' and the first auxiliary line DL1.

Accordingly, the second pixels PXL2' located on the first horizontal line HL1 may be driven corresponding to a scan signal output to a first second scan line S21 and the second start signal FLM2 transmitted through the first auxiliary line DL1.

The second auxiliary line DL2 may be coupled to the third pixels PXL3' located on the first horizontal line HL2 of the third pixel region AA3.

The timing controller 250 may supply a third start signal FLM3 to the third scan driver 213" and the second auxiliary line DL2.

Accordingly, the third pixels PXL3' located on the first horizontal line HL2 may be driven corresponding to a scan signal output to a first third scan line and the third start signal FLM3 transmitted through the second auxiliary line DL2.

Figure 14A:
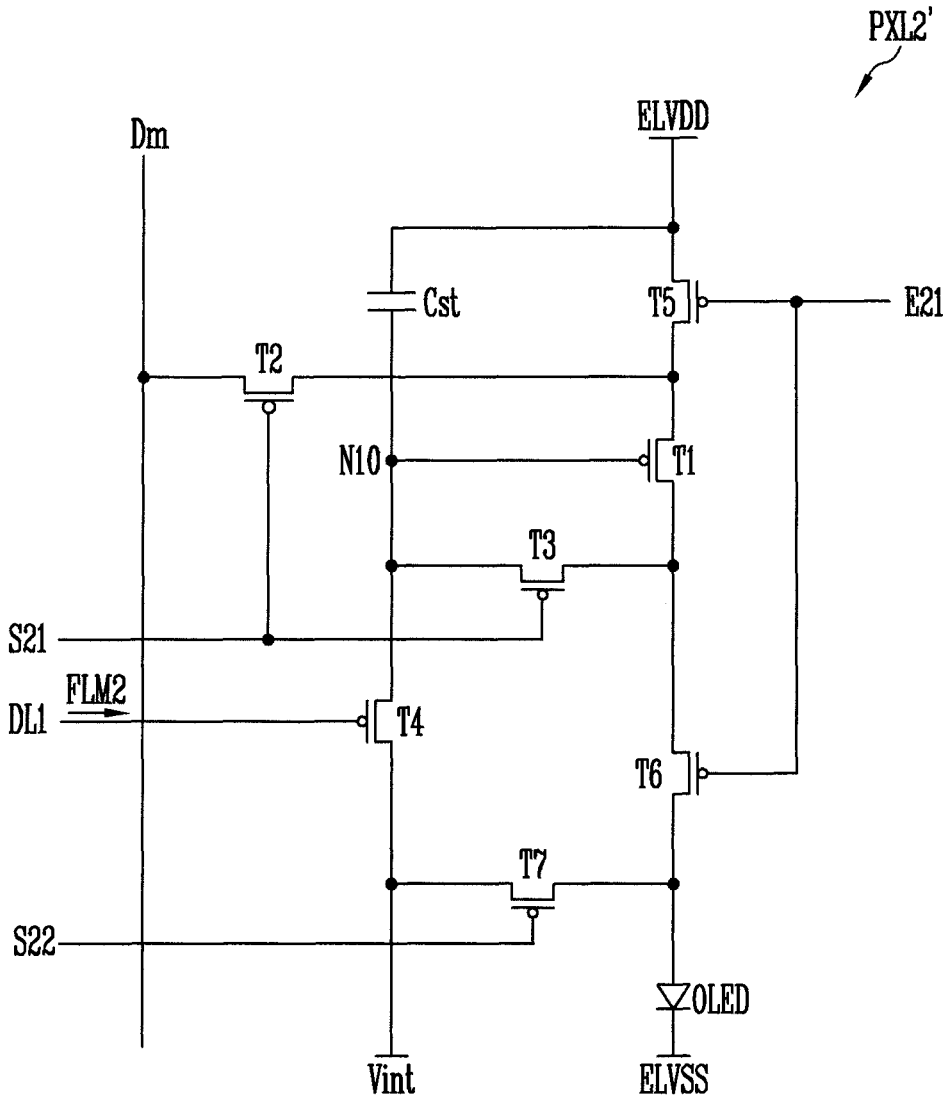
FIG. 14A is a diagram illustrating a second pixel located on a first horizontal line of a second pixel area shown in FIG. 13.
Figure 14B:
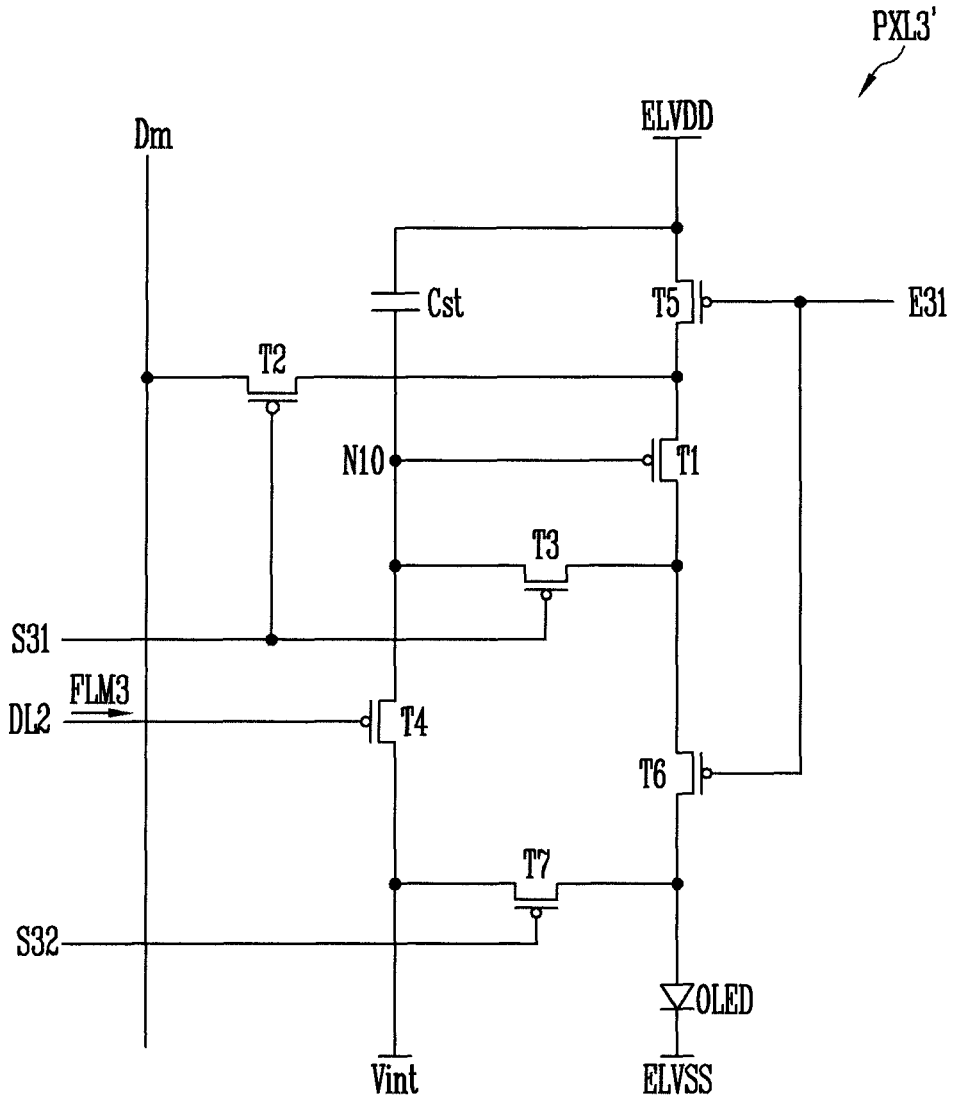
FIG. 14B is a diagram illustrating a third pixel located on a first horizontal line of a third pixel area shown in FIG. 13.

FIG. 14A is a diagram illustrating a second pixel located on the first horizontal line of the second pixel area shown in FIG. 13. FIG. 14B is a diagram illustrating a third pixel located on the first horizontal line of the third pixel area shown in FIG. 13.

For convenience of description, a second pixel PXL2' and a third pixel PXL3', which are coupled to an mth data line Dm, are illustrated in FIGS. 14A and 14B, respectively. In addition, portions changed by comparing this embodiment with the embodiment described with reference to FIG. 4 will be mainly described, and descriptions of portions overlapping with those of the above-described embodiment will be omitted.

Referring to FIG. 14A, the second pixel PXL2' located on the first horizontal line HL1 of the second pixel area AA2 may include an organic light emitting diode OLED, first to seventh transistor T1 to T7, and a storage capacitor Cst.

The seventh transistor T7 may be coupled between an initialization power source Vint and an anode of the organic light emitting diode OLED. In addition, a gate electrode of the seventh transistor T7 may be coupled to a second second scan line S22. The seventh transistor T7 may be turned on when a scan signal is supplied to the second second scan line S22 to supply the voltage of the initialization power source Vint to the anode of the organic light emitting diode OLED.

The third transistor T3 may be coupled between a second electrode of the first transistor T1 and a tenth node N10. In addition, a gate electrode of the third transistor T3 may be coupled to the first second scan line S21. The third transistor T3 may be turned on when a scan signal is supplied to the first second scan line S21 to allow the second electrode of the first transistor T1 and the tenth node N10 to be electrically coupled to each other.

The fourth transistor T4 may be coupled between the tenth node N10 and the initialization power source Vint. In addition, a gate electrode of the fourth transistor T4 may be coupled to the first auxiliary line DL1. The fourth transistor T4 may be turned on when the second start signal FLM2 is supplied to the first auxiliary line DL1 to supply the voltage of the initialization power Vint to the tenth node N10.

The second transistor T2 may be coupled between the mth data line Dm and a first electrode of the first transistor T1. In addition, a gate electrode of the second transistor T2 may be coupled to the first second scan line S21. The second transistor T2 may be turned on when the scan signal is supplied to the first second scan line S21 to allow the mth data line Dm and the first electrode of the first transistor T1 to be electrically coupled to each other.

Referring to FIG. 14B, the third pixel PXL3' located on the first horizontal line HL2 of the third pixel region AA3 may include an organic light emitting diode OLED, first to seventh transistor T7, and a storage capacitor Cst.

The seventh transistor T7 may be coupled between the initialization power source Vint and an anode of the organic light emitting diode OLED. In addition, a gate electrode of the seventh transistor T7 may be coupled to a second third scan line S32. The seventh transistor T7 may be turned on when a scan signal is supplied to the second their scan line S32 to supply the voltage of the initialization power source Vint to the anode of the organic light emitting diode OLED.

The third transistor T3 may be coupled between a second electrode of the first transistor T1 and a tenth node N10. In addition, a gate electrode of the third transistor T3 may be coupled to a first third scan line S31. The third transistor T3 may be turned on when a scan signal is supplied to the first third scan line S31 to allow the second electrode of the first transistor T1 and the tenth node N10 to be electrically coupled to each other.

The fourth transistor T4 may be coupled between the tenth node N10 and the initialization power source Vint. In addition, a gate electrode of the fourth transistor T4 may be coupled to the second auxiliary line DL2. The fourth transistor T4 may be turned on when the third start signal FLM3 is supplied to the second auxiliary line DL2 to supply the voltage of the initialization power source Vint to the tenth node N10.

The second transistor T2 may be coupled between the mth data line Dm and a first electrode of the first transistor T1. In addition, a gate electrode of the second transistor T2 may be coupled to the first third scan line S31. The second transistor T2 may be turned on when the scan signal is supplied to the first third scan line S31 to allow the mth data line and the first electrode of the first transistor T1 to be electrically coupled to each other.

Figure 15:
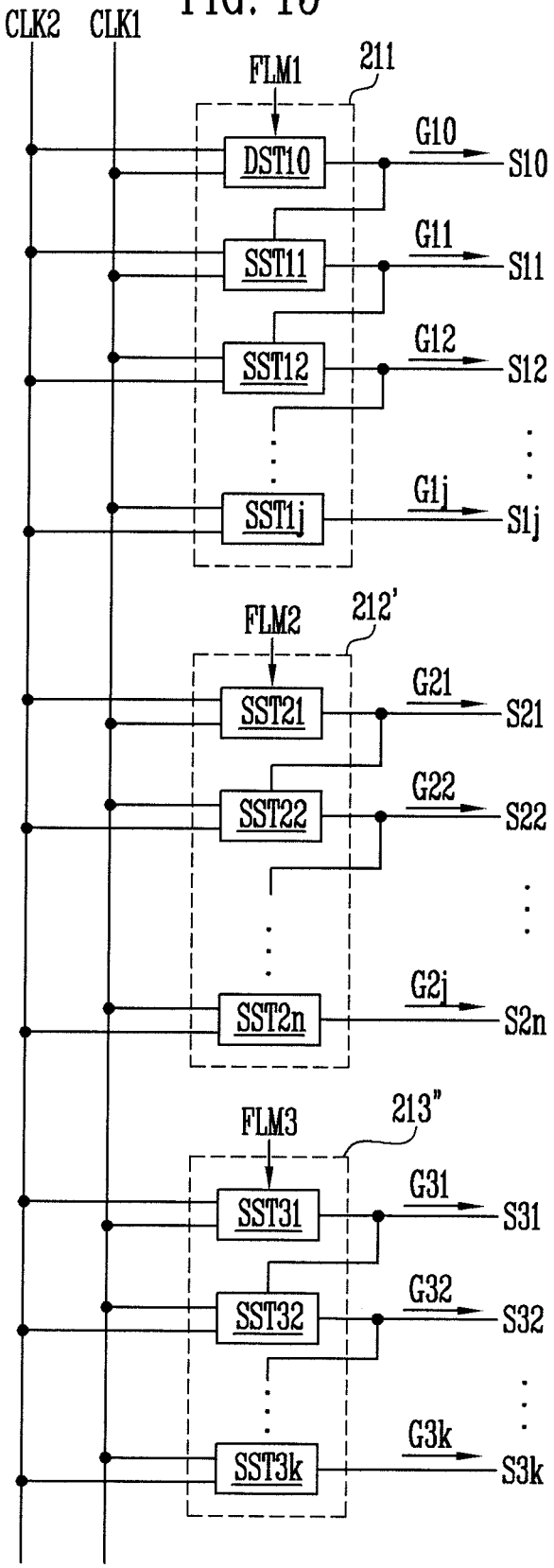
FIG. 15 is a diagram illustrating in more detail a configuration of scan drivers shown in FIG. 13.

FIG. 15 is a diagram illustrating in more detail a configuration of the scan drivers shown in FIG. 13. In FIG. 15, components identical to those shown in FIGS. 6 and 10 are designated by like reference numerals. Therefore, their repeated detailed descriptions will be omitted, and portions changed by comparing this embodiment with the embodiments described with reference to FIGS. 6 and 10 will be mainly described.

Referring to FIG. 15, the second scan driver 212' may include second scan stages SST21 to SST2*n*. The second scan stages SST21 to SST2*n* may be coupled to respective ends of the second scan lines S21 to S2*n*. Accordingly, the second scan stages SST21 to SST2*n* may supply second scan signals G21 to G2*n* to the second scan lines S21 to S2*n*, respectively.

The second scan stages SST21 to SST2*n* may be operated corresponding to clock signals CLK1 and CLK2 supplied from the timing controller 250.

A first second scan stage SST21 may be supplied with the second start signal FLM2 supplied from the timing controller 250. Each of the other second scan stages SST22 to SST2*n* may be respectively supplied with an output signal (e.g., a second scan signal) of a previous scan stage thereof.

Next, the third scan driver 213" may include third scan stages SST31 to SST3*k*.

The third scan stages SST31 to SST3*k* may be coupled to respective ends of the third scan lines S31 to S3*k*. Accordingly, the third scan stages SST31 to SST3*k* may supply third scan signals G31 to G3*k* to the third scan lines S31 to S3*k*, respectively.

The third scan stages SST31 to SST3*k* may be operated corresponding to clock signals CLK1 and CLK2 supplied from the timing controller 250.

A first third scan stage SST31 may be supplied with the third start signal FLM3 supplied from the timing controller 250. Each of the other third scan stages SST32 to SST3*k* may be respectively supplied an output signal (e.g., a third scan signal) of a previous scan stage thereof.

Figure 16A:
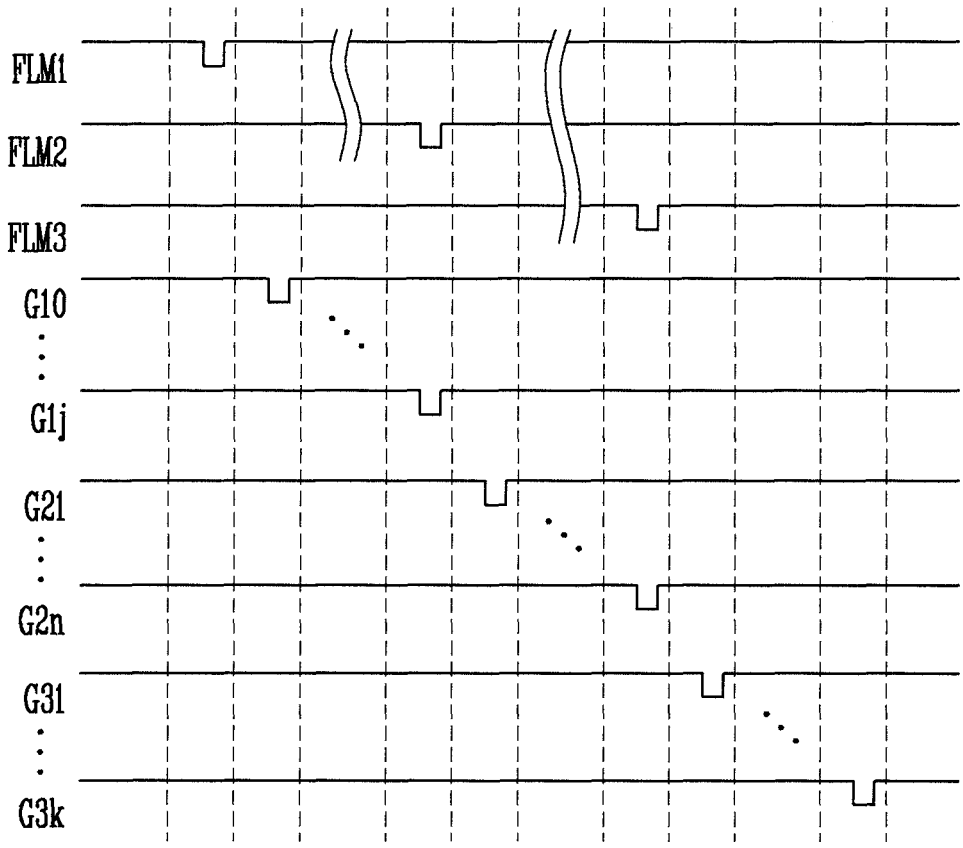
FIG. 16A is a waveform diagram illustrating output timings of scan signals output from the scan drivers shown in FIG. 15 when the display device is driven in the second mode.

FIG. 16A is a waveform diagram illustrating output timings of scan signals output from the scan drivers shown in FIG. 15 when the display device is driven in the second mode.

Referring to FIG. 16A, when the display device 10" is driven in the second mode, the timing controller 250 may sequentially supply a first start signal FLM1, the second start signal FLM2, and the third start signal FLM3 respectively to a first dummy stage DST10, the first second scan stage SST21, and the first third scan stage SST31.

Here, supply timings of the first start signal FLM1, the second start signal FLM2, and the third start signal FLM3 may be set such that first scan signals G11 to G1*j*, the second scan signals G21 to G2*n*, and the third scan signals G31 to G3*k* are sequentially supplied.

When the first start signal FLM1 is supplied, a first dummy scan signal G10 and the first scan signals G11 to G1*j* may be sequentially output. When the second start signal FLM2 is supplied, the second scan signals G21 to G2*n* may be sequentially output. In this case, the output timing of the second start signal FLM2 may be set such that a first second scan signal G21 is output next to (e.g., concurrently with) the last first scan signal G1*j*.

When the third start signal FLM3 is supplied, the third scan signals G31 to G3*k* may be sequentially output. In this case, the output timing of the third start signal FLM3 may be set such that a first third scan signal G31 is output next to (e.g., concurrently with) the last second scan signal G2*n*.

Figure 16B:
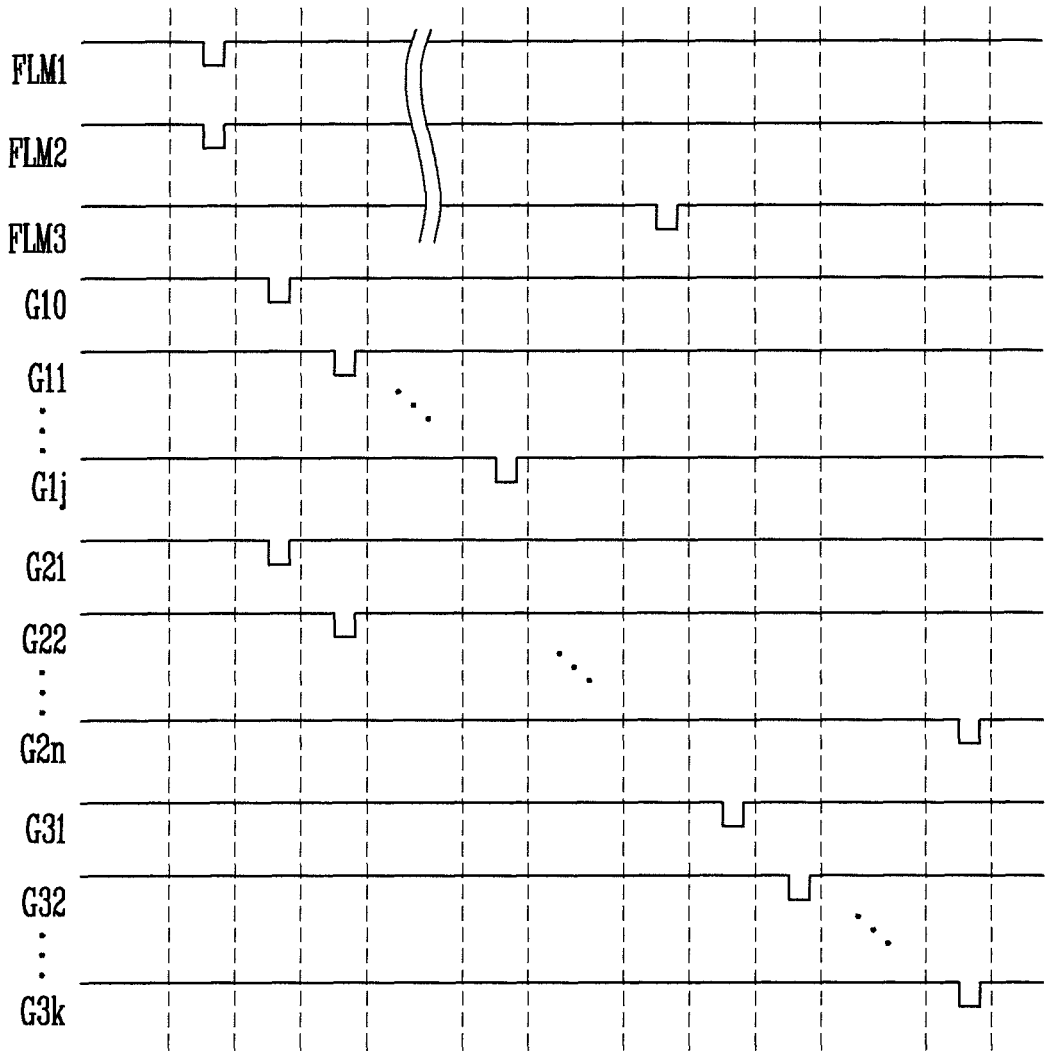
FIG. 16B is a waveform diagram illustrating output timings of scan signals output from the scan drivers shown in FIG. 15 when the display device is driven in the first mode.

FIG. 16B is a waveform diagram illustrating output timings of scan signals output from the scan drivers shown in FIG. 15 when the display device is driven in the first mode.

When the display device 10" is driven in the first mode, the timing controller 250 may sequentially supply the first start signal FLM1, the second start signal FLM2, and the third start signal FLM3 respectively to the first dummy stage DST10, the first second scan stage SST21, and the third scan stage SST31. In this case, a supply order of the first start signal FLM1, the second start signal FLM2, and the third start signal FLM3 may be different from that when the display device 10" is driven in the second mode. That is, the timing controller 250 may set the supply order of the first start signal FLM1, the second start signal FLM2, and the third start signal FLM3 such that the first scan signals G11 to G1*j* and the third scan signals G31 to G3*k* are supplied while the second scan signals G21 to G2*n* are being sequentially supplied.

The supply order of the first start signal FLM1, the second start signal FLM2, and the third start signal FLM3 may be set such that the period in which the first scan signals G11 to G1*j* are supplied overlaps with a portion of the period in which the second scan signals G21 to G2*n* are supplied, and the period in which the third scan signals G31 to G3*k* are supplied overlaps with a portion (e.g., another portion) of the period in which the second scan signals G21 to G2*n* are supplied. In this case, the period in which the first scan signals G11 to G1*k* are supplied may overlap or might not overlap with the period in which the third scan signals G31 to G3*k* are supplied.

Referring to FIG. 16B, when the first start signal FLM1 is supplied, the first dummy scan signal G10 and the first scan signals G11 to G1*j* may be sequentially output. In this case, a dummy data signal is supplied to the first pixels PXL1, and accordingly, a dummy image may be displayed in the first pixel area AA1. The dummy image may be a portion of an effective image displayed in the second pixel area AA2.

As shown in FIG. 16B, the second start signal FLM2 may be concurrently or simultaneously supplied together with the first start signal FLM1, or may be supplied such that the first first scan signal G11 and the first second scan signal G21 are concurrently or simultaneously supplied.

When the second start signal FLM2 is supplied, the second scan signals G21 to G2*n* may be sequentially output. When the third start signal FLM3 is supplied, the third scan signals G31 to G3*k* may be sequentially output. In this case, the output timing of the third start signal FLM3 may be set such that the last third scan signal G3*k* and the last second scan signal G2*n* are concurrently or simultaneously output.

In this case, a dummy data signal is supplied to the third pixels PXL3' and PXL3, and accordingly, a dummy image may be displayed in the third pixel area AA3. The dummy image may be a portion of an effective image displayed in the second pixel area AA2. In addition, the dummy image displayed in the third pixel area AA3 may be identical to, or different from, that displayed in the first pixel area AA1.

As described above, when the display device 10" is driven in the first mode, the second scan signals G21 to G2*n* are not supplied after all of the first scan signals G11 to G1*j* are supplied (e.g., some of the second scan signals G21 to G2*n* may be supplied before all of the first scan signals G11 to G1*j* have been supplied). That is, the last first scan signal G1*j* and the first second scan signal G21 are not sequentially supplied.

When the last first scan line S1*j* is coupled to the second pixels PXL2' located on the first horizontal line HL1 of the second pixel area AA2, the second pixels PXL2' located on the first horizontal line HL1 of the second pixel area AA2 are influenced by the last first scan signal G1*j*. That is, the last first scan signal G1*j* is supplied to the second pixels PXL2' located on the first horizontal line HL1 of the second pixel area AA2 while the second scan signals G21 to G2*n* are being supplied to the second pixel area AA2. Therefore, a bright or dark line may be displayed on the first horizontal line HL1 of the second pixel area AA2. In addition, the bright or dark line may remain as an afterimage at a boundary line between the first pixel area AA1 and the second pixel area AA2 when the driving mode of the display device 10" is changed from the first mode to the second mode. The above-described problem may also occur at a boundary line between the second pixel area AA2 and the third pixel area AA3.

According to the present embodiment, the last first scan line S1*j* is not coupled to the second pixels PXL2' located on the first horizontal line HL1 of the second pixel area AA2. Instead, the first auxiliary line DL1 is coupled to the second pixels PXL2' located on the first horizontal line HL1 of the second pixel area AA2, so that the second pixels PXL2' located on the first horizontal line HL1 of the second pixel area AA2 are not influenced by the last first scan signal G1*j*, thereby solving the above-described problem.

In addition, the last second scan line S2*n* is not coupled to the third pixels PXL3' located on the first horizontal line HL2 of the third pixel area AA3. Instead, the second auxiliary line DL2 is coupled to the third pixels PXL3' located on the first horizontal line HL2 of the third pixel area AA3, thereby solving the above-described problem.

Figure 17:
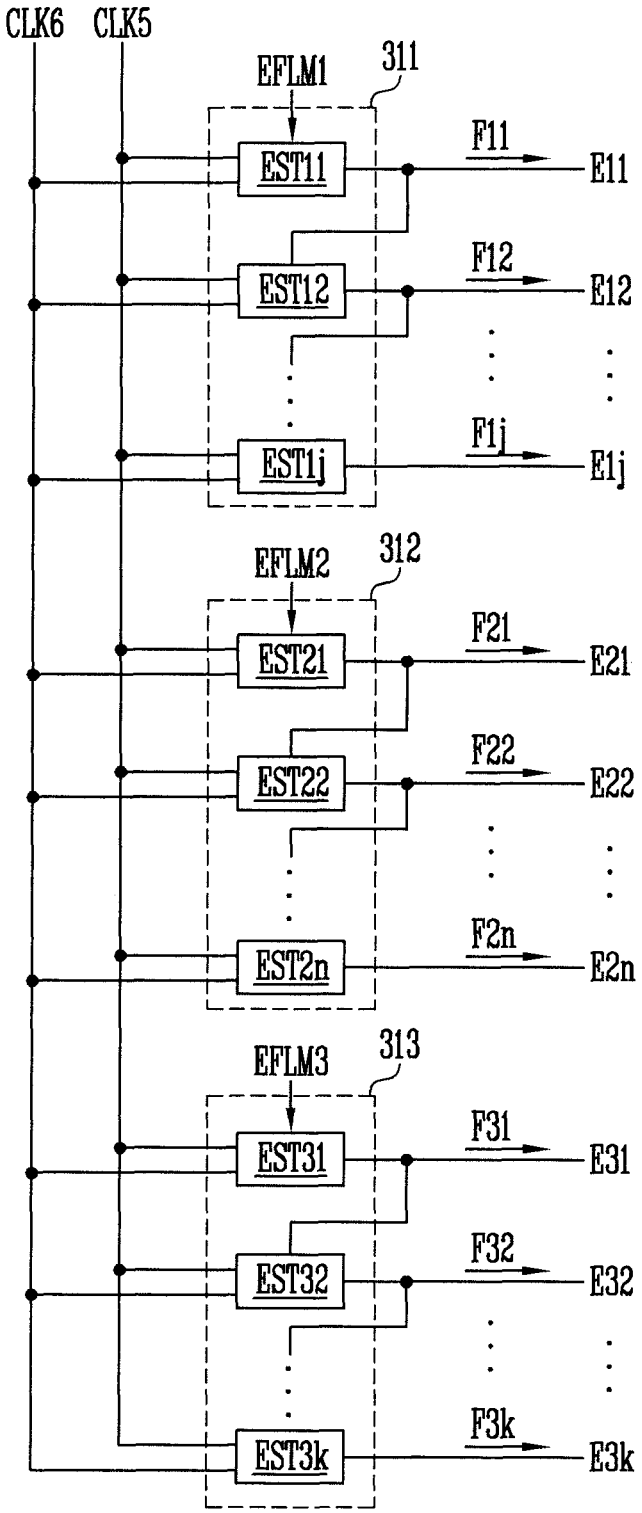
FIG. 17 is a diagram illustrating a configuration of emission drivers according to an embodiment.

FIG. 17 is a diagram illustrating a configuration of emission drivers according to an embodiment.

Referring to FIG. 17, a first emission driver 311 may include a plurality of first emission stages EST11 to EST1*j*.

The first emission stages EST11 to EST1*j* may be coupled to respective ends of the first emission control lines E11 to E1*j*. Accordingly, the first emission stages EST11 to EST1*j* may supply first emission control signals F11 to F1*j* to the first emission control lines E11 to E1*j*, respectively. In this case, the first emission stages EST11 to EST1*j* may be operated corresponding to the clock signals CLK5 and CLK6 supplied from the timing controller 250. Also, the first emission stages EST11 to EST1*j* may be implemented with the same circuit.

Each of the first emission stages EST11 to EST1*j* may be respectively supplied with an output signal (e.g., an emission control signal) of a previous emission stage thereof or a fourth start signal EFLM1. For example, a first first emission stage EST11 may be supplied with the fourth start signal EFLM1, and each of the other first emission stages EST12 to EST1*j* may be supplied with an output signal of a previous emission stage thereof.

Next, a second emission driver 312 may include a plurality of second emission stages EST21 to EST2*n*. The second emission stages EST21 to EST2*n* may be coupled to respective ends of the second emission control lines E21 to E2*n*. Accordingly, the second emission stages EST21 to EST2*n* may supply second emission control signals F21 to F2*n* to the second emission control lines E21 to E2*n*, respectively.

In this case, the second emission stages EST21 to EST2*n* may be operated corresponding to the clock signals CLK5 and CLK6 supplied from the timing controller 250. Also, the second emission stages EST21 to EST2*n* may be implemented with the same circuit.

Each of the second emission stages EST21 to EST2*n* may be respectively supplied with an output signal (e.g., an emission control signal) of a previous emission stage thereof or a fifth start signal EFLM2. For example, a first second emission stage EST21 may be supplied with the fifth start signal EFLM2, and each of the other second emission stages EST22 to EST2*n* may be supplied with an output signal of a previous emission stage thereof.

Next, a third emission driver 313 may include a plurality of third emission stages EST31 to EST3*k*.

The third emission stages EST31 to EST3*k* may be coupled to respective ends of the third emission control lines E31 to E3*k*. Accordingly, the third emission stages EST31 to EST3*k* may respectively supply third emission control signals F31 to F3*k* to the third emission control lines E31 to E3*k*.

In this case, the third emission stages EST31 to EST3*k* may be operated corresponding to the clock signals CLK5 and CLK6 supplied from the timing controller 250. Also, the third emission stages EST31 to EST3*k* may be implemented with the same circuit.

Each of the third emission stages EST31 to EST3*k* may be respectively supplied with an output signal (e.g., an emission control signal) of a previous emission stage thereof or the sixth start signal EFLM3. For example, a first third emission stage EST31 may use, as a start signal, the sixth start signal EFLM3, and each of the other third emission stages EST32 to EST3*k* may be supplied with an output signal of a previous emission stage thereof.

Meanwhile, a width of the emission control signals F11 to F1*j*, F21 to F2*n*, and F31 to F3*k* may be determined corresponding to a width of the fifth start signal EFLM2. In other words, as the width of the fifth start signal EFLM2 is widened, the width of the emission control signals F11 to F1*j*, F21 to F2*n*, and F31 to F3*k* may be widened. The width of the fifth start signal EFLM2 may be variously set corresponding to driving methods.

Figure 18A:
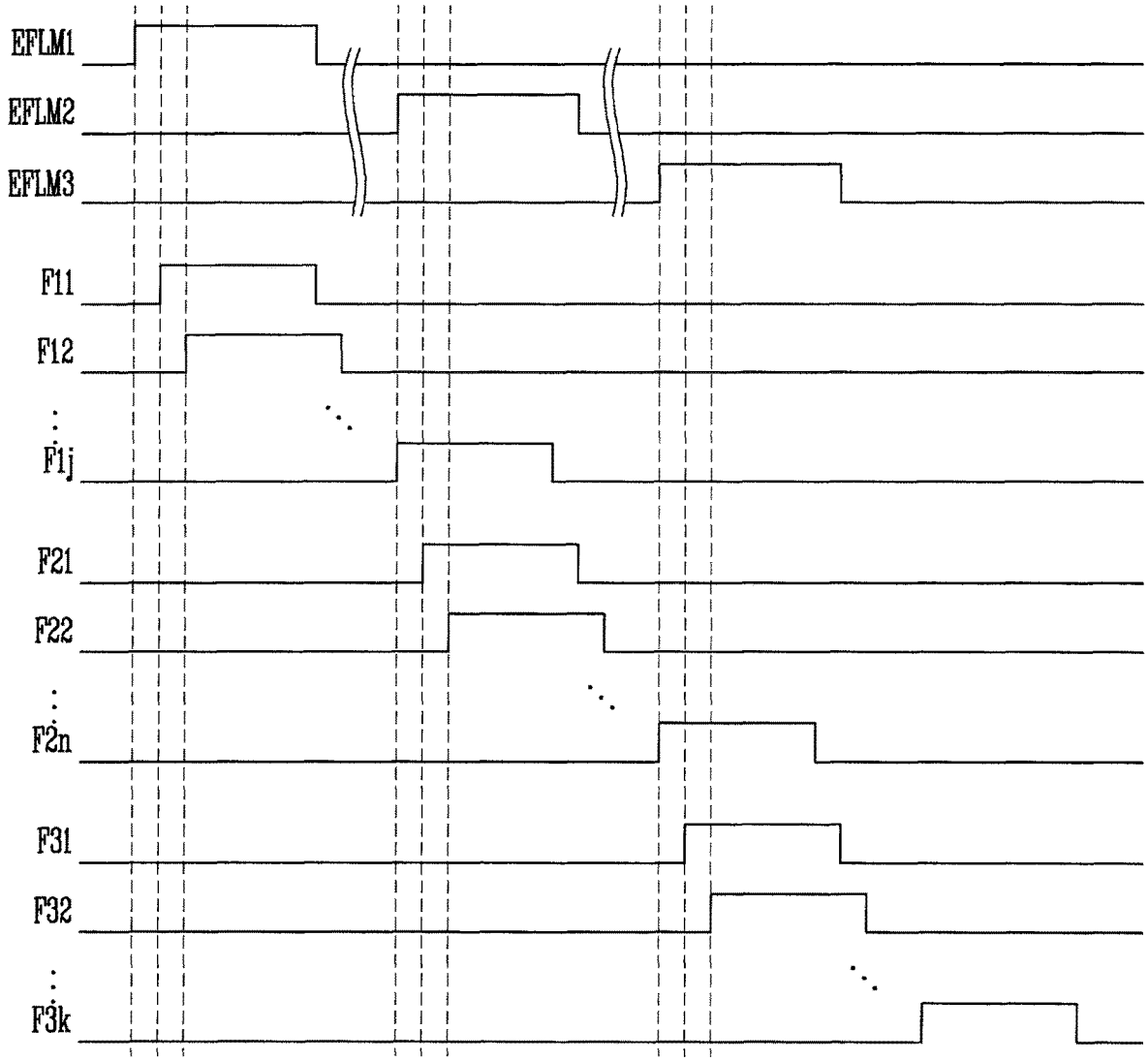
FIG. 18A is a waveform diagram illustrating output timings of emission control signals output from the emission drivers shown in FIG. 17 when the display device is driven in the second mode.

FIG. 18A is a waveform diagram illustrating output timings of emission control signals output from the emission drivers shown in FIG. 17 when the display device is driven in the second mode.

Referring to FIG. 18A, when the display device 10, 10', or 10" is driven in the second mode, the timing controller 250 may sequentially supply the fourth start signal EFLM1, the fifth start signal EFLM2, and the sixth start signal EFLM3 respectively to the first emission driver 311, the second emission driver 312, and the third emission driver 313.

Here, supply timings of the fourth start signal EFLM1, the fifth start signal EFLM2, and the sixth start signal EFLM3 may be set such that the first emission control signals F11 to F1*j*, the second emission control signals F21 to F2*n*, and the third emission control signals F31 to F3*k* are sequentially supplied.

The fourth start signal EFLM1, the fifth start signal EFLM2, and the sixth start signal EFLM3 may have the same width.

When the fourth start signal EFLM1 is supplied, the first emission control signals F11 to F1*j* may be sequentially output. In this case, an ith first emission control signal F1*i* supplied to an ith first emission control line E1*i* may be supplied to overlap with an ith first scan signal G1*i* supplied to an ith first scan line S1*i*.

When the fifth start signal EFLM2 is supplied, the second emission control signals F21 to F2*n* may be sequentially output. In this case, an ith second emission control signal F2*i* that is supplied to an ith second emission control line E2*i* may overlap with an ith second scan signal G2*i* that is supplied to an ith second scan line S2*i*.

When the sixth start signal EFLM3 is supplied, the third emission control signals F31 to F3*k* may be sequentially output. In this case, an ith third emission control signal F3*i* that is supplied to an ith third emission control line E3*i* may overlap with an ith third scan signal G3*i* supplied to an ith third scan line S3*i*.

Figure 18B:
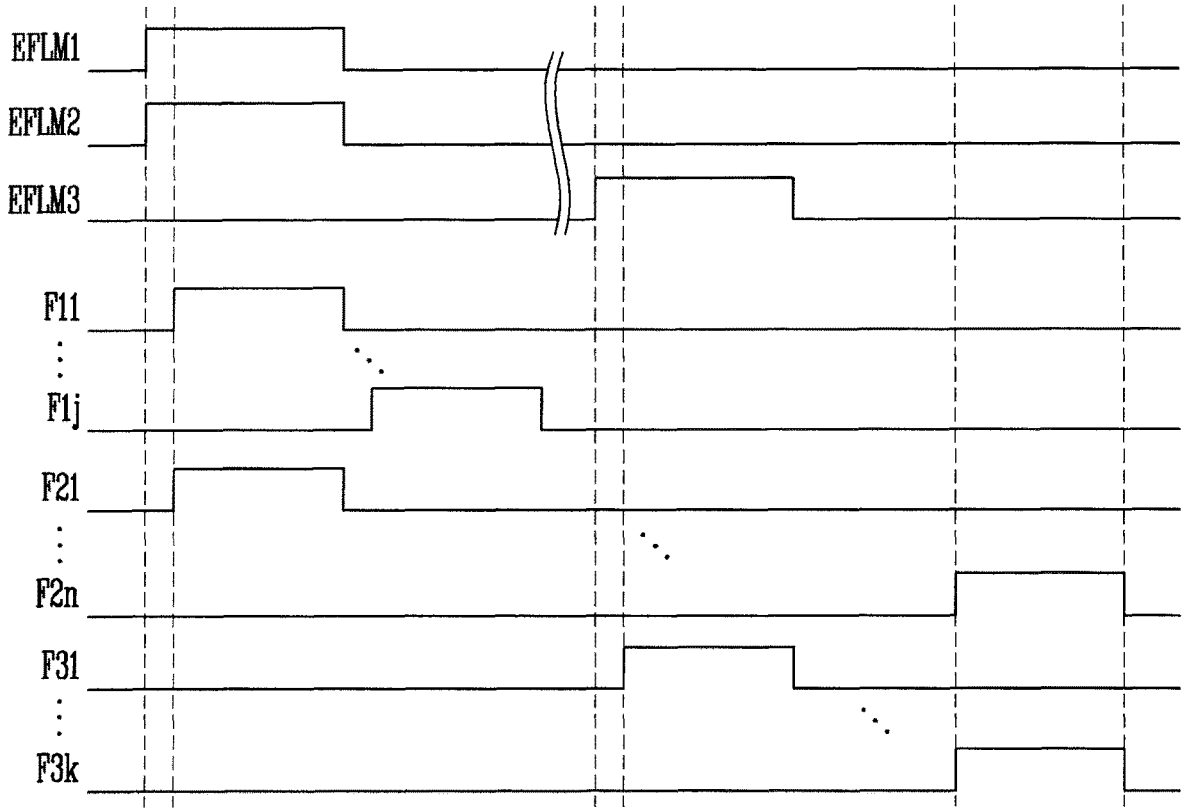
FIG. 18B is a waveform diagram illustrating output timings of emission control signals output from the emission drivers shown in FIG. 17 when the display device is driven in the first mode.

FIG. 18B is a waveform diagram illustrating output timings of emission control signals output from the emission drivers shown in FIG. 17 when the display device is driven in the first mode.

Referring to FIG. 18B, when the display device 10, 10', or 10" is driven in the first mode, the timing controller 250 may supply the fourth start signal EFLM1, the fifth start signal EFLM2, and the sixth start signal EFLM3 respectively to the first emission driver 311, the second emission driver 312, and the third emission driver 313. In this case, the timing controller 250 may supply the fourth start signal EFLM1, the fifth start signal EFLM2, and the sixth start signal EFLM3 respectively to the first emission driver 311, the second emission driver 312, and the third emission driver 313 according to a predetermined order. That is, the timing controller 250 may set the supply order of the fourth start signal EFLM1, the fifth start signal EFLM2, and the sixth start signal EFLM3 such that the first emission control signals F11 to F1*k* and the third emission control signals F31 to F3*k* are supplied while the second emission control signal F21 to F2*n* are being sequentially supplied.

The period in which the first emission control signals F11 to F1*k* are supplied may overlap with a portion of the period in which the second emission control signals F21 to F2*n* are supplied, and the period in which the third emission control signals F31 to F3*k* are supplied may overlap with a portion of the period (e.g., another portion) in which the second emission control signals F21 to F2*n* are supplied. The period in which the first emission control signal F11 to F1*k* are supplied may overlap or might not overlap with the period in which the third emission control signals F31 to F3*k* are supplied.

When the fourth start signal EFLM1 is supplied, the first emission control signals F11 to F1*j* may be sequentially output. When the fifth start signal EFLM2 is supplied, the second emission control signals F21 to F2*n* may be sequentially output. The fourth start signal EFLM1 and the fifth start signal EFLM2 may be concurrently or simultaneously supplied. In this case, the first emission control signals F11 to F1*j* and some of the second emission control signals F21 to F2*n* may respectively overlap.

When the sixth start signal EFLM3 is supplied, the third emission control signals F31 to F3*k* may be sequentially output. The supply timing of the sixth start signal EFLM3 may be set such that the last second emission control signal F2*n* and the last third emission control F3*k* are concurrently or simultaneously output.

When the display device 10, 10', and 10" is driven in the first mode, the supply order of the fourth start signal EFLM1, the fifth start signal EFLM2, and the sixth start signal EFLM3 is not limited to that shown in FIG. 18B. For example, the fourth start signal EFLM1 may be supplied later than the sixth start signal EFLM3, and each of the fourth start signal EFLM1 and the sixth start signal EFLM3 may be supplied several times.

Figure 19:
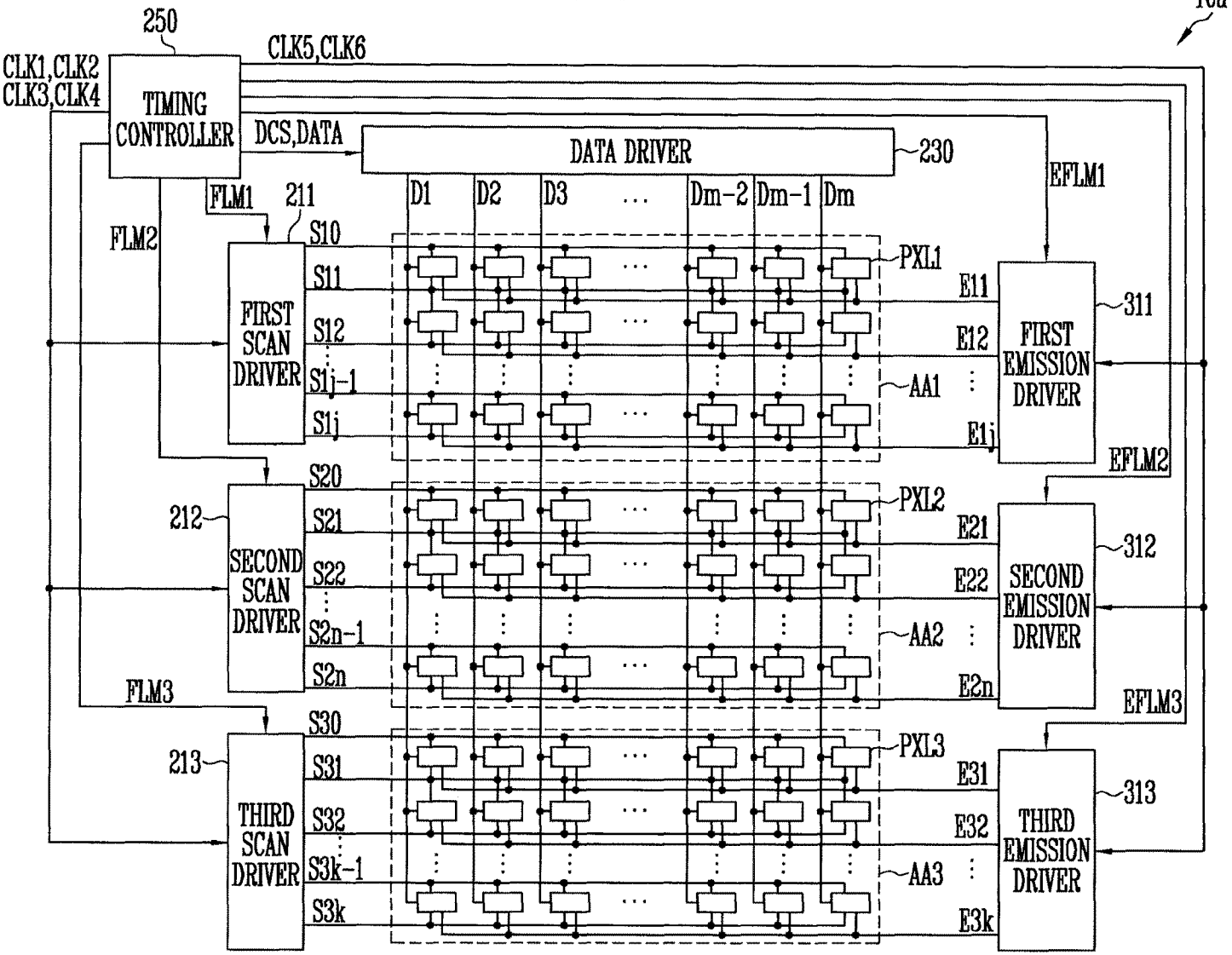
FIG. 19 is a diagram illustrating a configuration of a display device according to still another embodiment.

FIG. 19 is a diagram illustrating a configuration of a display device according to still another embodiment.

When the configuration and operation of the display device 10*a* according to the present embodiment are described with reference to FIG. 19, repeated descriptions of components identical to those of the display device 10 shown in FIG. 3 will be omitted, and differences will be mainly described.

Referring to FIG. 19, a first scan driver 211 may supply a first dummy scan signal to a first dummy scan line S10, and may supply first scan signals to first scan lines S11 to S1*j*, corresponding to a first scan driver control signal(s) FLM1, CLK1, CLK2, CLK3, and CLK4.

A second scan driver 212 may supply a second dummy scan signal to a second dummy scan line S20, and may supply second scan signals to second scan lines S21 to S2*n*, corresponding to a second scan driver control signal(s) FLM2, CLK1, CLK2, CLK3, and CLK4.

A third scan driver 213 may supply a third dummy scan signal to a third dummy scan line S30, and may supply third scan signals to third scan lines S31 to S3*k*, corresponding to a third scan driver control signal(s) FLM3, CLK1, CLK2, CLK3, and CLK4.

A timing controller 250 may supply, to the scan drivers 211, 212, and 213, the scan driver control signals FLM1, FLM2, FLM3, CLK1, CLK2, CLK3, and CLK4 generated based on externally supplied timing signals.

The first scan driver control signal may include a first start signal FLM1 and clock signals CLK1, CLK2, CLK3, and CLK4. The first start signal FLM1 may control a supply timing of the first dummy scan signal, and the clock signals CLK1, CLK2, CLK3, and CLK4 may be used to shift the first start signal FLM1.

The second scan driver control signal may include a second start signal FLM2 and the clock signals CLK1, CLK2, CLK3, and CLK4. The second start signal FLM2 may control a supply timing of the second dummy scan signal, and the clock signals CLK1, CLK2, CLK3, and CLK4 may be used to shift the second start signal FLM2.

The third scan driver control signal may include a third start signal FLM3 and the clock signals CLK1, CLK2, CLK3, and CLK4. The third start signal FLM3 may control a supply timing of the third dummy scan signal, and the clock signals CLK1, CLK2, CLK3, and CLK4 may be used to shift the third start signal FLM3.

The same clock signals CLK1, CLK2, CLK3, and CLK4 may be supplied to the scan drivers 211, 212, and 213.

Figure 20:
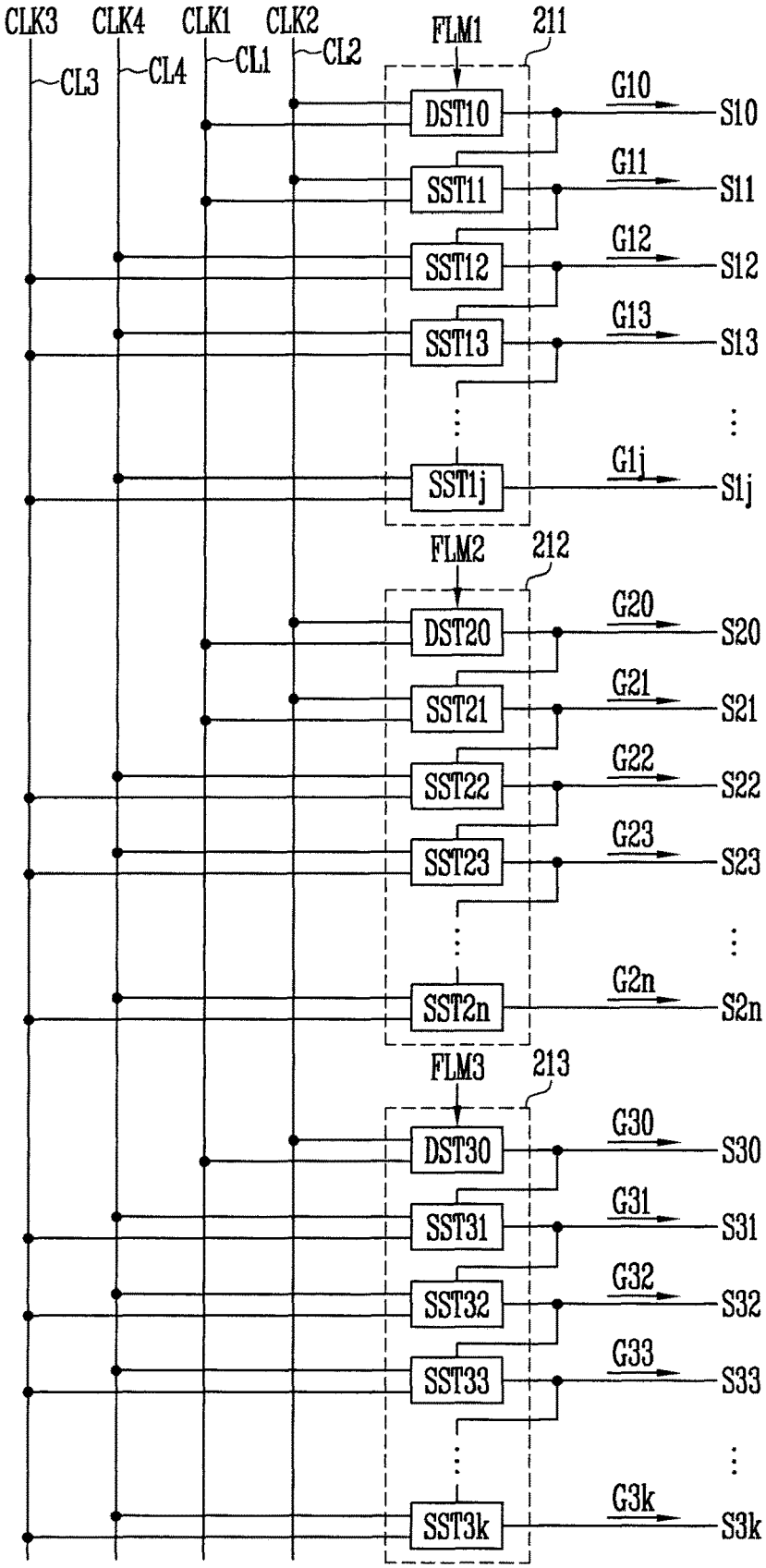
FIG. 20 is a diagram illustrating in more detail a configuration of scan drivers shown in FIG. 19.

FIG. 20 is a diagram illustrating in more detail a configuration of the scan drivers shown in FIG. 19.

When configurations and operations of the scan drivers 211, 212, and 213 according to the present embodiment are described with reference to FIG. 20, repeated descriptions of the configurations and operations identical to those of the scan drivers 211, 212, 213 shown in FIG. 6 will be omitted, and differences will be mainly described.

Referring to FIG. 20, the first scan driver 211 may include a first dummy stage DST10 and first scan stages SST11 to SST1*j*.

The first dummy stage DST10 may be coupled to one end of the first dummy scan line S10, and may supply a first dummy scan signal G10 through the first dummy scan line S10.

The first scan stages SST11 to SST1*j* may be coupled to respective ends of first scan lines S11 to S1*j*. Accordingly, the first scan stages SST11 to SST1*j* may supply first scan signals G11 to G1*j* to the first scan lines S11 to S1*j*, respectively.

The first dummy stage DST10 and the first scan stages SST11 to SST1*j* may be operated corresponding to clock signals CLK1, CLK2, CLK3, and CLK4 supplied from the timing controller 250. The clock signals CLK1, CLK2, CLK3, and CLK4 may include a first clock signal CLK1, a second clock signal CLK2, a third clock signal CLK3, and a fourth clock signal CLK4.

Some stages among the stages DST10 and SST11 to SST1*j* included in the first scan driver 211 may be coupled to a first clock line CL1 through which the first clock signal CLK1 is supplied, and to a second clock line CL2 through which the second clock signal CLK2 is supplied. The other stages included in the first scan driver 211 may be coupled to a third clock line CL3 through which the third clock signal CLK3 is supplied, and to a fourth clock line CL4 through which the fourth clock signal CLK4 is supplied. For example, the first dummy stage DST10 and a first scan stage SST11 may be supplied with the first clock signal CLK1 and the second clock signal CLK2, and a second first scan stage SST12 and a third first scan stage SST13 may be supplied with the third clock signal CLK3 and the fourth clock signal CLK4.

The clock signals CLK1, CLK2, CLK3, and CLK4 may be alternately supplied to a fourth first scan stage SST14 to the last first scan stage SST1*j*.

Next, a second scan driver 212 may include a second dummy stage DST20 and second scan stages SST21 to SST2*n*. The second dummy stage DST20 may be coupled to one end of the second dummy scan line S20, and may supply a second dummy scan signal G20 through the second dummy scan line S20.

The second scan stages SST21 to SST2*n* may be coupled to respective ends of second scan lines S21 to S2*n*. Accordingly, the second scan stages SST21 to SST2*n* may supply second scan signals G21 to G2*n* to the second scan lines S21 to S2*n*, respectively.

The second dummy stage DST20 and the second scan stages SST21 to SST2*n* may be operated corresponding to the clock signals CLK1, CLK2, CLK3, and CLK4 supplied from the timing controller 250.

Some stages among the stages DST20 and SST21 to SST2*n* included in the second scan driver 212 may be coupled to the first clock line CL1 through which the first clock signal CLK1 is supplied, and to the second clock line CL2 through which the second clock signal CLK2 is supplied, while the other stages may be coupled to the third clock line CL3 through which the third clock signal CLK3 is supplied, and to the fourth clock line CL4 through which the fourth clock signal CLK4 is supplied. For example, the second dummy stage DST20 and a first second scan stage SST21 may be supplied with the first clock signal CLK1 and the second clock signal CLK2, and a second second scan stage SST22 and a third second scan stage SST23 may be supplied with the third clock signal CLK3 and the fourth clock signal CLK4.

The clock signals CLK1, CLK2, CLK3, and CLK4 may be alternately supplied to a fourth second scan stage SST24 to the last second stage SST2*n*.

Finally, the third scan driver 213 may include a third dummy stage DST30 and third scan stages SST31 to SST3*k*.

The third dummy stage DST30 may be coupled to one end of the third dummy scan line S30, and may supply a third dummy scan signal G30 through the third dummy scan line S30.

The third scan stages SST31 to SST3*k* may be coupled to respective ends of third scan lines S31 to S3*k*, respectively. Accordingly, the third scan stages SST31 to SST3*k* may supply third scan signals G31 to G3*k* to the third scan lines S31 to S3*k*, respectively.

The third dummy stage DST30 and the third scan stages SST31 to SST3*k* may be operated corresponding to the clock signals CLK1, CLK2, CLK3, and CLK4 supplied from the timing controller 250.

Some stages among the stages DST30 and SST31 to SST3*k* included in the third scan driver 213 may be coupled to the first clock line CL1 through which the first clock signal CLK1 is supplied, and to the second clock line CL2 through which the second clock signal CLK2 is supplied, while the other stages may be coupled to the third clock line CL3 through which the third clock signal CLK3 is supplied, and to the fourth clock line CL4 through which the fourth clock signal CLK4 is supplied.

For example, the third dummy stage DST30 and a first third scan stage SST31 may be supplied with the first clock signal CLK1 and the second clock signal CLK2, and a second third scan stage SST32 and a third third scan stage SST33 may be supplied with the third clock signal CLK3 and the fourth clock signal CLK4.

The clock signals CLK1, CLK2, CLK3, and CLK4 may be alternately supplied to a fourth third scan stage SST34 to the last third scan stage SST3*k*.

Figure 21:
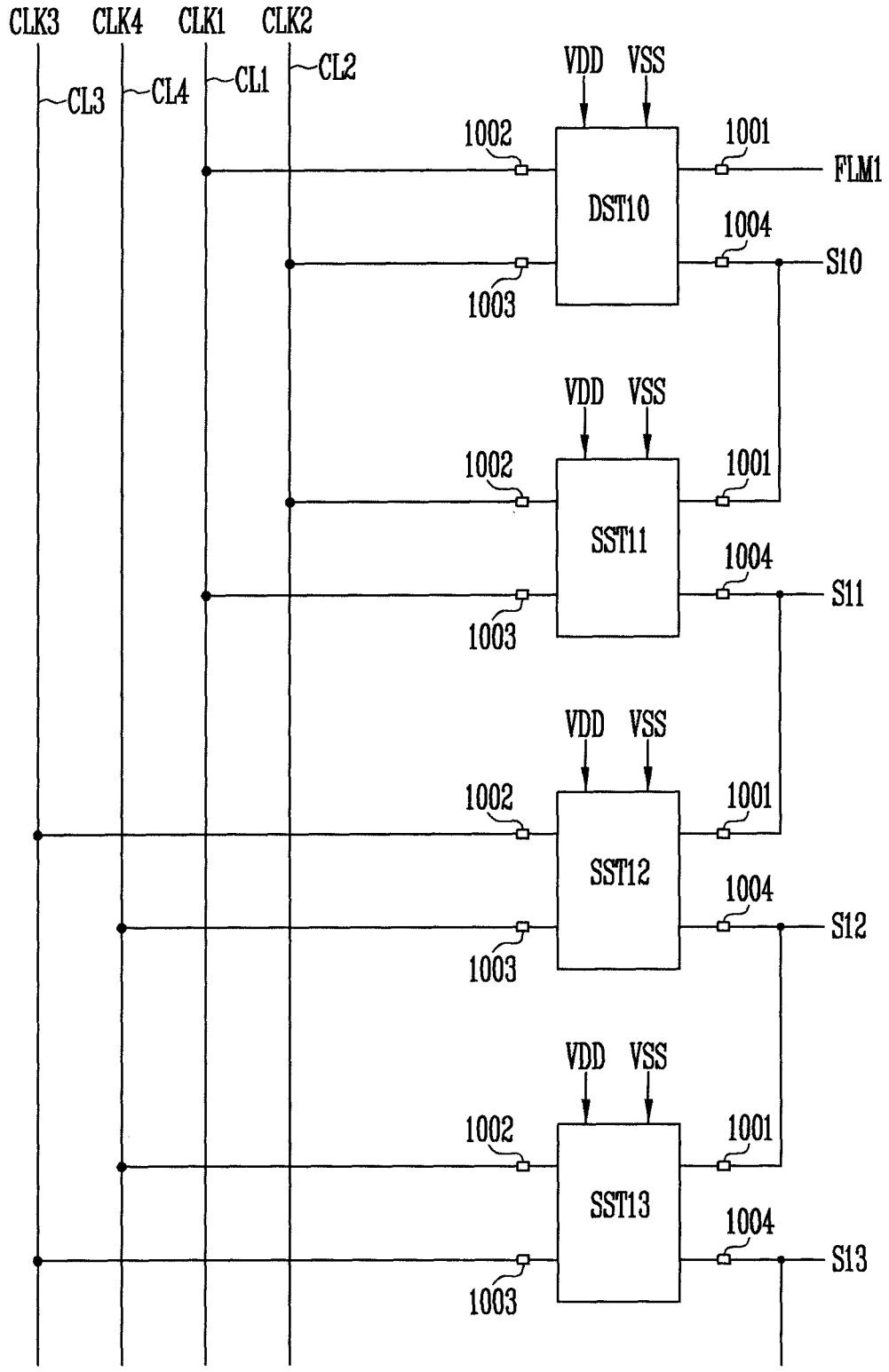
FIG. 21 is a diagram illustrating an embodiment of a first scan driver shown in FIG. 20.

FIG. 21 is a diagram illustrating an embodiment of the first scan driver shown in FIG. 20. For convenience of description, four stages DST10 and SST11 to SST13 are illustrated in FIG. 21.

Referring to FIG. 21, each of the stages DST10 and SST11 to SST13 is driven corresponding to two of the clock signals among the clock signals CLK1, CLK2, CLK3, and CLK4. For example, each of the stages DST10 and SST11 to SST13 may be driven corresponding to the first clock signal CLK1 and the second clock signal CLK2, or may be driven corresponding to the third clock signal CLK3 and the fourth clock signal CLK4.

The stages DST10 and SST11 to SST13 may be implemented with the same circuit. Each of the stages DST10 and SST11 to SST13 may include first to third input terminals 1001 to 1003 and an output terminal 1004.

The first input terminal 1001 of each of the stages DST10 and SST11 to SST13 is respectively supplied with an output signal (e.g., a scan signal) of a previous stage or the first start signal FLM1. For example, the first input terminal 1001 of the first dummy stage DST10 is supplied with the first start signal FLM1, and the first input terminal 1001 of each of the other scan stages SST11 to SST13 is supplied with an output signal of a previous stage.

The second input terminal 1002 of each of odd stages (e.g., the first dummy stage DST10 and the second first scan stage SST12) may be coupled to the first clock line CL1 or the third clock line CL3, and the third input terminal 1003 of each of the odd stages may be coupled to the second clock line CL2 or the fourth clock line CL4.

The second input terminal 1002 of each of even stages (e.g., the first first scan stage SST11 and the third first scan stage SST13) may be coupled to the second clock line CL2 or the fourth clock line CL4, and the third input terminal 1003 of each of the even stages may be coupled to the first clock line CL1 or the third clock line CL3.

The first clock signal CLK1 and the second clock signal CLK2 may have phases that are different from each other. For example, the second clock signal CLK2 may have a phase difference of 180 degrees from the first clock signal CLK1.

The third clock signal CLK3 and the first clock signal CLK1 may be the same, and the fourth clock signal CLK4 and the second clock signal CLK2 may be the same. Therefore, the third clock signal CLK3 and the fourth clock signal CLK4 may have phases that are different from each other. For example, the fourth clock signal CLK4 may have a phase difference of 180 degrees from the third clock signal CLK3.

Each of the stages DST10 and SST11 to SST13 may be supplied with a first power source VDD and a second power source VSS. Here, the first power source VDD may be set to a gate-off voltage (e.g., a high voltage). In addition, the second power source VSS may be set to a gate-on voltage (e.g., a low voltage).

The other first scan stages SST13 to SST1*j* may also have the same configuration as the stages DST10 and SST11 to SST13 shown in FIG. 21.

In addition, the respective stages of each of the second scan driver 212 and the third scan driver 213 may be set in a manner similar to, or identical to, the stages DST10 and SST11 to SST13 shown in FIG. 21.

Meanwhile, in FIG. 21, it is illustrated that each of the stages DST10 and SST11 to SST13 has three input terminals, but the present disclosure is not limited thereto. That is, the number of input terminals provided in each stage may be variously changed as the circuit configuration of the stage is changed.

Figure 22A:
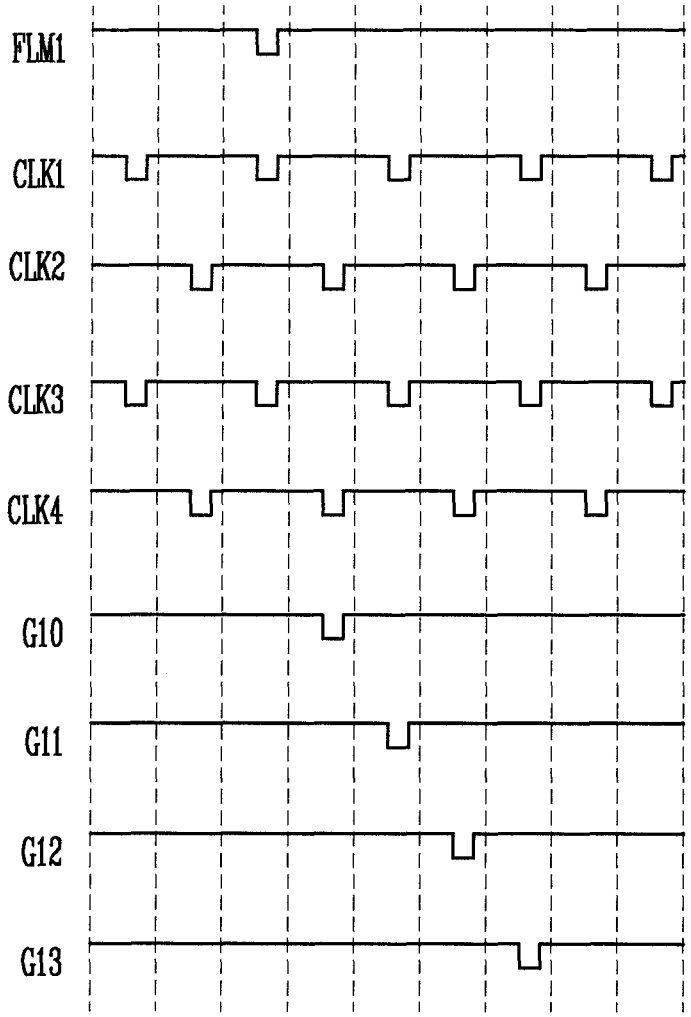
FIGS. 22A and 22B are waveform diagrams illustrating first to fourth clock signals input to stages shown in FIG. 21 and scan signals output from the stages shown in FIG. 21.
Figure 22B:
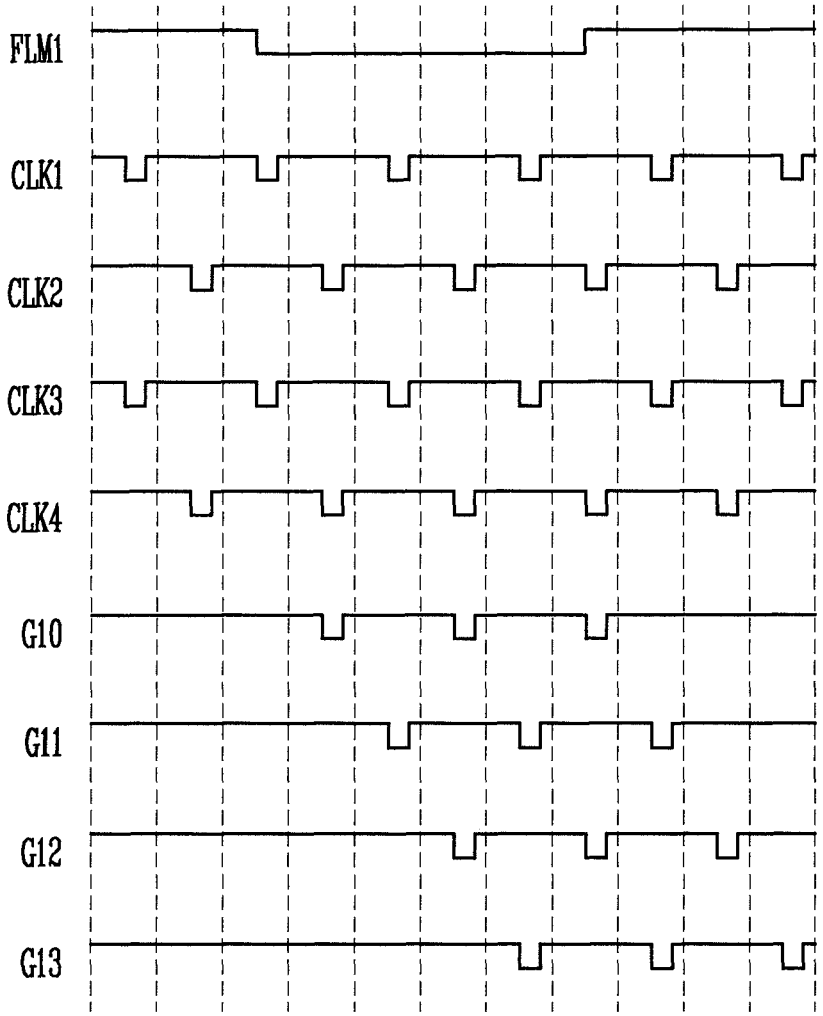

FIGS. 22A and 22B are waveform diagrams illustrating the first to fourth clock signals input to the stages shown in FIG. 21, and illustrating scan signals output from the stages shown in FIG. 21.

Referring to FIG. 22A, each of the clock signals CLK1, CLK2, CLK3, and CLK4 may be a clock signal that swings between a low voltage and a high voltage. For example, the first clock signal CLK1 may be the same as the third clock signal CLK3, and the second clock signal CLK2 may be the same as the fourth clock signal CLK4.

When the first start signal FLM1 is supplied to the first dummy stage DST10, the first dummy scan signal G10 may be output by shifting the first start signal FLM1 corresponding to the first and second clock signals CLK1 and CLK2.

The first first scan stage SST11 may output a first first scan signal G11 by shifting the first dummy scan signal G10 corresponding to the first and second clock signals CLK1 and CLK2.

The second first scan stage SST12 may output a second first scan signal G12 by shifting the first first scan signal G11 corresponding to the third and fourth clock signals CLK3 and CLK4.

The third first scan stage SST13 may output a third first scan signal G13 by shifting the second first scan signal G12 corresponding to the third and fourth clock signals CLK3 and CLK4.

The other first scan signals G14 to G1*j* may be sequentially output in a manner similar to the above-described manner. In addition, the stages included in each of the second scan driver 212 and the third scan driver 213 may be similarly or identically operated.

In FIG. 22A, it is illustrated that a low level section of the first start signal FLM1 overlaps with that of one first clock signal CLK1, but the present disclosure is not limited thereto. In another embodiment, the low level section of the first start signal FLM1 may overlap with that of two or more first clock signals CLK1. That is, the low level section of the first start signal FLM1 may have a given width, which may be different than that of the clock signals. For example, as shown in FIG. 22B, the low level section of the first start signal FLM1 may overlap with that of three first clock signals CLK1.

Referring to FIG. 22B, when the first start signal FLM1 is supplied to the first dummy stage DST10, the first dummy stage DST10 may output the first dummy scan signal G10 by shifting the first start signal FLM1 corresponding to the first and second clock signals CLK1 and CLK2.

For example, a number of low level sections of the first dummy scan signal G10 may correspond to that of low level sections of the first clock signal CLK1 that overlap with the low level section of the first start signal FLM1. That is, the first dummy scan signal G10 may have three low level sections when the low level section of the first start signal FLM1 overlaps three low level section of the first clock signal CLK1.

Next, the first first scan stage SST11 may output the first first scan signal G11 by shifting the first dummy scan signal G10 corresponding to the first and second clock signals CLK1 and CLK2. In this case, a number of low level sections of the first first scan signal G11 may correspond to a number of low level sections of the first dummy scan signal G10. That is, the first first scan signal G11 may have three low level sections.

The other first scan signals G12 to G1*j* may be sequentially output in a manner similar to the above-described manner.

Further, the second start signal FLM2 and the third start signal FLM3 may be set to have the same with as the first start signal FLM1, and the stages DST20, SST21 to SST2*n*, DST30, and SST31 to SST3*k* respectively included in the second scan driver 212 and the third scan driver 213 may be operated in a manner similar to the above-described manner.

That is, according to the present embodiment, characteristics of scan signals output from the stages DST10, SST11 to SST1*j*, DST20, SST21 to SST2*n*, DST30, and SST31 to SST3*k* can be controlled using widths of the start signals FLM1, FLM2, and FLM3. Meanwhile, the width of each of the start signals FLM1, FLM2, and FLM3 is not limited to those shown in FIGS. 22A and 22B, and may be variously changed in some cases.

When a large number of stages are coupled to a clock line through which a clock signal is supplied, a scan signal output corresponding to the clock signal may be delayed due to delay of the clock signal, or the swing width of the scan signal may be decreased.

In the present embodiment, the first clock line CL1 and the second clock line CL2 are connected to some of the stages provided in the first to third scan drivers 211, 212, and 213, and the third clock line CL3 and the fourth clock line CL4 are coupled to the other stages, so that the number of stages coupled to one clock line can be decreased, thereby solving the above-described problem.

Figure 23:
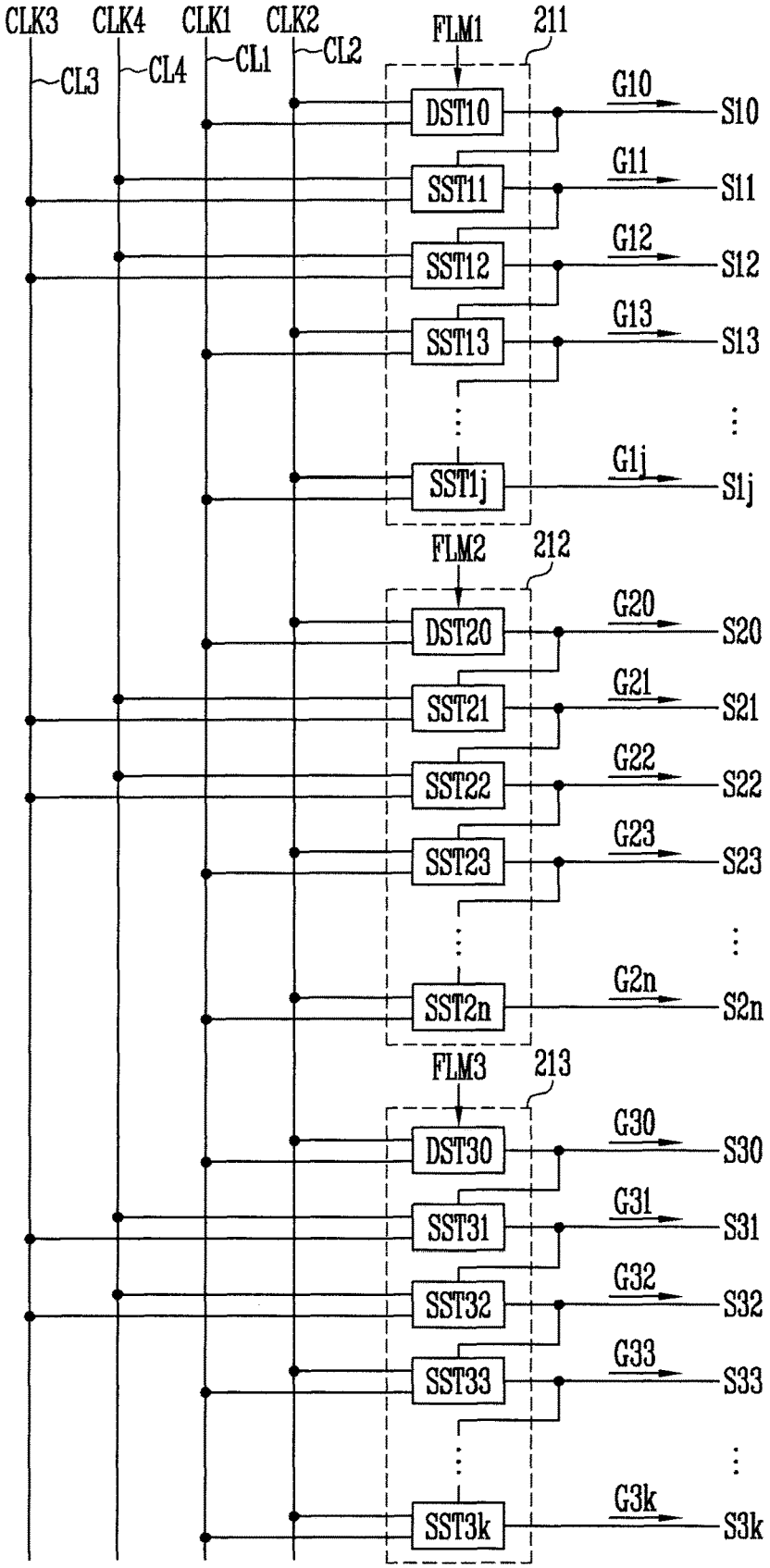
FIGS. 23 and 24 are diagrams illustrating various embodiments of a connection relationship between clock lines and stages.
Figure 24:
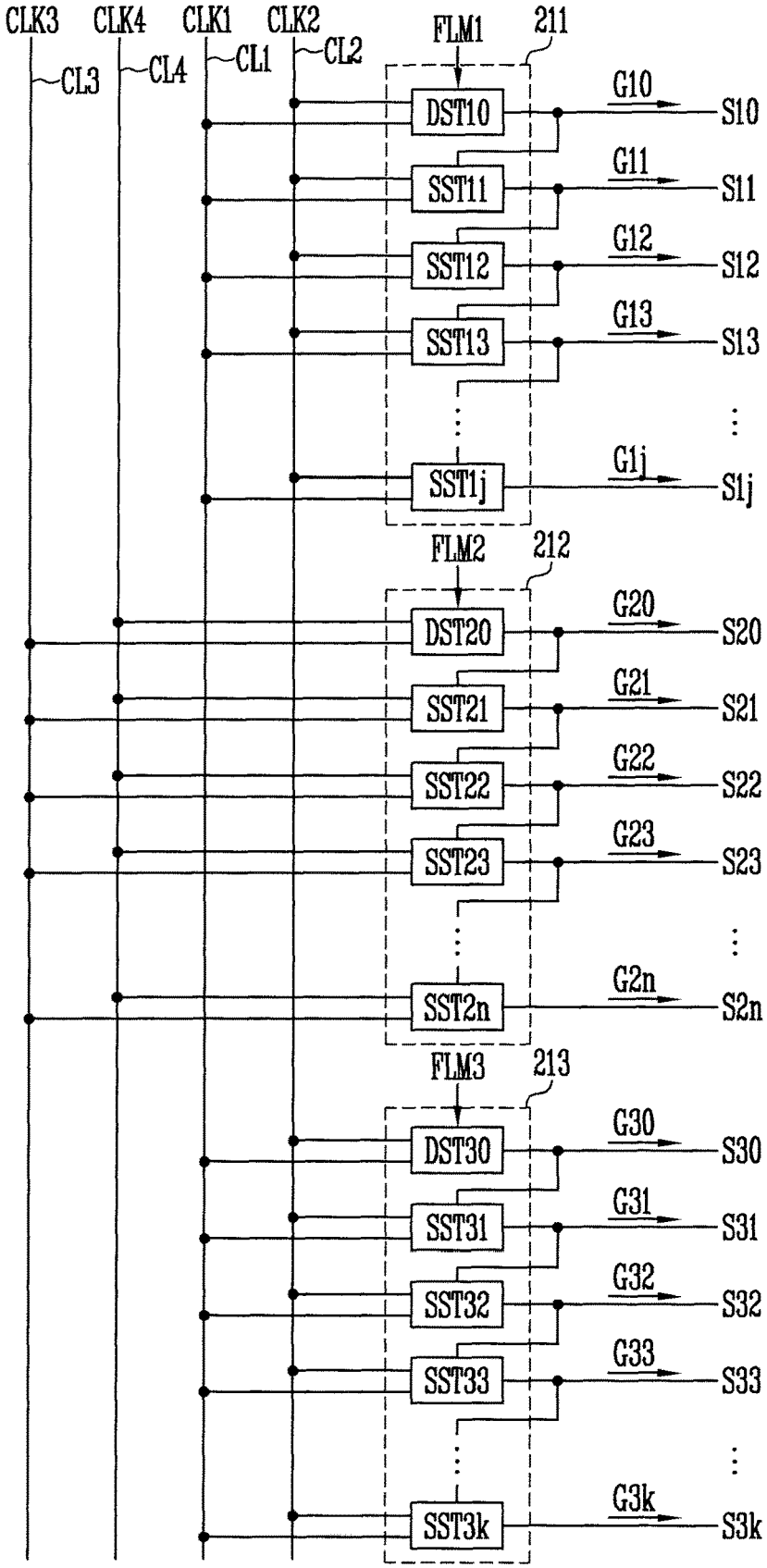

FIGS. 23 and 24 are diagrams illustrating various embodiments of a connection relationship between the clock lines and the stages.

Referring to FIG. 23, in the stages DST10 and SST11 to SST1*j* included in the first scan driver 211, (4*(a−1)+1)-numbered stages (e.g., the first dummy stage DST10, the fourth first scan stage SST14, an eighth first scan stage SST18, etc.) and (4*a)-numbered stages (e.g., the third first scan stage SST13, a seventh first scan stage SST17, etc.) may be coupled to the first clock line CL1 and the second clock line CL2 (here, a is a natural number).

The other stages not including the stages coupled to the first clock line CL1 and the second clock line CL2 may be coupled to the third clock line CL3 and the fourth clock line CL4.

A connection relationship between the stages and the clock lines of each of the second scan driver 212 and the third scan driver 213 may be the same as described above.

Referring to FIG. 24, the first scan driver 211 and the third scan driver 213 may be coupled to the first clock line CL1 and the second clock line CL2, and the second scan driver 212 may be coupled to the third clock line CL3 and the fourth clock line CL4.

Figure 25:
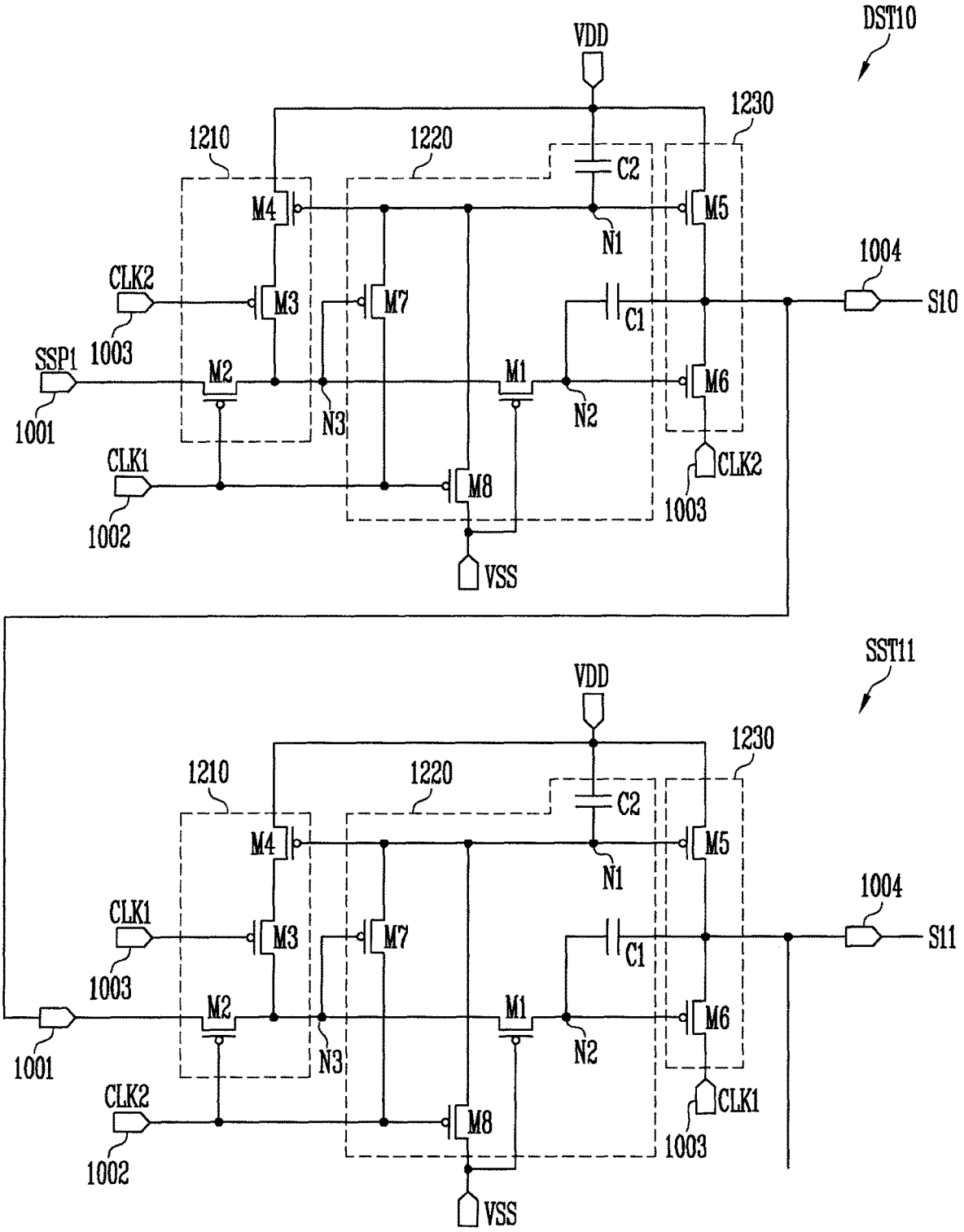
FIG. 25 is a circuit diagram illustrating an embodiment of a scan stage.

FIG. 25 is a circuit diagram illustrating an embodiment of a scan stage.

For convenience of description, the first dummy stage DST10 and the first scan stage SST11 are illustrated in FIG. 25. Referring to FIG. 25, the first dummy stage DST10 according to the present embodiment includes a first driver 1210, a second driver 1220, an output unit (or buffer) 1230, and a first transistor M1.

The output unit 1230 controls a voltage supplied to the output terminal 1004 corresponding to voltages of a first node N1 and a second node N2. To this end, the output unit 1230 includes a fifth transistor M5 and a sixth transistor M6.

The fifth transistor M5 is located between the first power source VDD and the output terminal 1004, and has a gate electrode coupled to the first node N1. The fifth transistor M5 controls the coupling between the first power source VDD and the output terminal 1004 corresponding to the voltage applied to the first node N1.

The sixth transistor M6 is located between the output terminal 1004 and the third input terminal 1003, and has a gate electrode coupled to the second node N2. The sixth transistor M6 controls the coupling between the output terminal 1004 and the third input terminal 1003, corresponding to the voltage applied to the second node N2. The output unit 1230 is driven as a buffer. Additionally, the fifth transistor M5 and/or the sixth transistor M6 may be configured such that a plurality of transistors are coupled in parallel.

The first driver 1210 controls a voltage of a third node N3 corresponding to signals supplied to the first to third input terminal 1001 to 1003. To this end, the first driver 1210 includes second to fourth transistors M2 to M4.

The second transistor M2 is located between the first input terminal 1001 and the third node N3, and has a gate electrode coupled to the second input terminal 1002. The second transistor M2 controls the coupling between the first input terminal 1001 and the third node N3 corresponding to a signal supplied to the second input terminal 1002.

Meanwhile, in other embodiments, the first driver 1210 may further include a transistor that is located between a second electrode of the second transistor M2 and a second electrode of the third transistor M3 (e.g., to be coupled in series with the second transistor M2), and that has a gate electrode coupled to the second input terminal 1002.

The third transistor M3 and the fourth transistor M4 are coupled in series between the third node N3 and the first power source VDD. Further, the third transistor M3 is located between the fourth transistor M4 and the third node N3, and has a gate electrode that is coupled to the third input terminal 1003. The third transistor M3 controls the coupling between the fourth transistor M4 and the third node N3, corresponding to a signal supplied to the third input terminal 1003.

The fourth transistor M4 is located between the third transistor M3 and the first power source VDD, and has a gate electrode that is coupled to the first node N1. The fourth transistor M4 controls the coupling between the third transistor M3 and the first power source VDD corresponding to the voltage of the first node N1.

The second driver 1220 controls the voltage of the first node N1 corresponding to voltages of the second input terminal 1002 and the third node N3. To this end, the second driver 1220 includes a seventh transistor M7, an eighth transistor M8, a first capacitor C1, and a second capacitor C2.

The first capacitor C1 is coupled between the second node N2 and the output terminal 1004. The first capacitor C1 charges a voltage corresponding to the turn-on/turn-off state of the sixth transistor M6.

The second capacitor C2 is coupled between the first node N1 and the first power source VDD. The second capacitor C2 charges the voltage applied to the first node N1.

The seventh transistor M7 is located between the first node N1 and the second input terminal 1002, and has a gate electrode coupled to the third node N3. The seventh transistor M7 controls the coupling between the first node N1 and the second input terminal 1002 corresponding to the voltage of the third node N3.

The eighth transistor M8 is located between the first node N1 and the second power source VSS, and has a gate electrode coupled to the second input terminal 1002. The eighth transistor M8 controls the coupling between the first node N1 and the second power source VSS corresponding to the signal supplied to the second input terminal 1002.

The first transistor M1 is located between the third node N3 and the second node N2, and has a gate electrode coupled to the second power source VSS. The first transistor M1 maintains the electrical coupling between the third node N3 and the second node N2 while maintaining a turn-on state. Additionally, the first transistor M1 limits a voltage drop width of the third node N3 corresponding to the voltage of the second node N2. In other words, although the voltage of the second node N2 drops to a voltage that is lower than that of the second power source VSS, the voltage of the third node N3 does not become lower than a voltage obtained by subtracting a threshold voltage of the first transistor M1 from the voltage of the second power source VSS.

The first first scan stage SST11 and the other first scan stages SST12 to SST1*j* may have the same configuration as the first dummy stage DST10.

In addition, the stages included in the first scan driver 211 are illustrated in FIG. 25, but the stages included in the second scan driver 212 and the third scan driver 213 may also have the same configuration.

According to the present disclosure, it is possible to provide a display device having improved display quality.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims with functional equivalents thereof to be included.

What is claimed is:

1. A display device comprising:

first pixels in a first pixel area and coupled to first scan lines;

a first scan driver configured to supply first scan signals to the first scan lines;

second pixels in a second pixel area and coupled to second scan lines;

a second scan driver configured to supply second scan signals to the second scan lines;

third pixels in a third pixel area and coupled to third scan lines;

a third scan driver configured to supply third scan signals to the third scan lines; and a timing controller configured to supply a first start signal to the first scan driver, to supply a second start signal to the second scan driver, and to supply a third start signal to the third scan driver, wherein the second pixel area is between the first pixel area and the third pixel area, wherein the first scan driver comprises a first dummy stage and first scan stages, wherein the second scan driver comprises a second dummy stage and second scan stages, wherein the second dummy stage is configured to receive the second start signal, wherein a first one of the second scan stages is configured to receive an output signal of the second dummy stage, and wherein a dummy scan line is coupled between the second dummy stage and a gate electrode of a transistor of one of the second pixels.

2. The display device of claim 1, wherein an effective image is displayed in the second pixel area in a first mode, and wherein the effective image is displayed in the first pixel area, the second pixel area, and the third pixel area in a second mode.

3. The display device of claim 1, wherein the display device is configured to be driven in a first mode when the display device is mounted in a wearable device, and is configured to be driven in a second mode otherwise.

4. The display device of claim 1, wherein the first scan driver is configured to start the supply of the first scan signals corresponding to the first start signal, wherein the second scan driver is configured to start the supply of the second scan signals corresponding to the second start signal, and wherein the third scan driver is configured to start the supply of the third scan signals corresponding to the third start signal.

5. The display device of claim 4, wherein the first dummy stage is configured to receive the first start signal, and wherein a first one of the first scan stages is configured to receive an output signal of the first dummy stage.

6. The display device of claim 5, wherein ones of the first pixels on a first horizontal line of the first pixel area are coupled to the first dummy stage and to the first one of the first scan stages.

7. The display device of claim 6, wherein ones of the second pixels on a first horizontal line of the second pixel area are coupled to the second dummy stage and the first one of the second scan stages.

8. The display device of claim 7, wherein the third scan driver comprises a third dummy stage and third scan stages, wherein the third dummy stage is configured to receive the third start signal, and wherein a first one of the third scan stages is configured to receive an output signal of the third dummy stage.

9. The display device of claim 8, wherein ones of the third pixels on a first horizontal line of the third pixel area are coupled to the third dummy stage and the first one of the third scan stages.

10. The display device of claim 7, wherein the third scan driver comprises third scan stages, and a third dummy stage between two of the third scan stages that is configured to receive the third start signal.

11. The display device of claim 10, wherein the third dummy stage is between a first one of the third scan stages and a second one of the third scan stages.

12. The display device of claim 11, wherein the first one of the third scan stages is configured to receive an output signal of a last one of the second scan stages, and wherein the second one of the third scan stages is configured to receive an output signal of the third dummy stage.

13. The display device of claim 12, wherein ones of the third pixels on a first horizontal line of the third pixel area are coupled to the last one of the second scan stages and the first one of the third scan stages.

14. The display device of claim 12, wherein ones of the third pixels on a second horizontal line of the third pixel area are coupled to the third dummy stage and the second one of the third scan stages.

15. The display device of claim 1, wherein, in a second mode, the timing controller is configured to sequentially supply the first start signal, the second start signal, and the third start signal.

16. The display device of claim 1, wherein, in a first mode, the timing controller is configured to set a supply order of the first start signal, the second start signal, and the third start signal such that the first scan signals and the third scan signals are supplied while the second scan signals are being supplied.

17. A display device comprising:

first pixels in a first pixel area and coupled to first scan lines;

a first scan driver configured to supply first scan signals to the first scan lines;

second pixels in a second pixel area and coupled to second scan lines;

a second scan driver configured to supply second scan signals to the second scan lines;

third pixels in a third pixel area and coupled to third scan lines;

a third scan driver configured to supply third scan signals to the third scan lines;

a timing controller configured to supply a first start signal to the first scan driver, to supply a second start signal to the second scan driver, and to supply a third start signal to the third scan driver; and a first auxiliary line coupled to ones of the second pixels on a first horizontal line of the second pixel area, wherein the second pixel area is between the first pixel area and the third pixel area, and wherein the timing controller is configured to supply the second start signal to the ones of the second pixels through the first auxiliary line and the second scan driver.

18. The display device of claim 17, wherein the ones of the second pixels on the first horizontal line of the second pixel area are configured to be driven corresponding to the second start signal and a second scan signal supplied from a first one of the second scan lines.

19. The display device of claim 17, further comprising a second auxiliary line coupled to ones of the third pixels on a first horizontal line of the third pixel area.

20. The display device of claim 19, wherein the timing controller is configured to supply the third start signal to the second auxiliary line and the third scan driver.

21. The display device of claim 20, wherein the ones of the third pixels on the first horizontal line of the third pixel area are configured to be driven corresponding to the third start signal and a third scan signal supplied from a first one of the third scan lines.

22. The display device of claim 19, wherein the timing controller is configured to supply a first clock signal to a first clock line, to supply a second clock signal to a second clock line, to supply a third clock signal to a third clock line, and to supply a fourth clock signal to a fourth clock line.

23. The display device of claim 22, wherein signal characteristics of the first clock signal and the third clock signal are substantially identical, and wherein signal characteristics of the second clock signal and the fourth clock signal are substantially identical.

24. The display device of claim 22, wherein the first scan driver comprises a first dummy stage and first scan stages, wherein the first dummy stage is configured to receive the first start signal, wherein a first one of the first scan stages is configured to receive an output signal of the first dummy stage, wherein the first dummy stage and some stages among the first scan stages are configured to receive the first clock signal and the second clock signal through the first clock line and the second clock line, and wherein the first dummy stage and other stages among the first scan stages are configured to receive the third clock signal and the fourth clock signal through the third clock line and the fourth clock line.

25. The display device of claim 22, wherein the first scan driver and the third scan driver are configured to receive the first clock signal and the second clock signal through the first clock line and the second clock line, and wherein the second scan driver is configured to receive the third clock signal and the fourth clock signal through the third clock line and the fourth clock line.

* * * * *